US005912834A

United States Patent [19]

Kimura

[11] Patent Number: 5,912,834

[45] Date of Patent: Jun. 15, 1999

[54] BIPOLAR TRANSLINEAR FOUR-QUADRANT ANALOG MULTIPLIER

[75] Inventor: Katsuji Kimura, Tokyo, Japan

[73] Assignee: NEC Corporation, Tokyo, Japan

[21] Appl. No.: 08/834,103

[22] Filed: Apr. 14, 1997

[30] Foreign Application Priority Data

Apr. 12, 1996 [JP] Japan ..... 8-115720
Apr. 12, 1996 [JP] Japan ..... 8-115721

[51] Int. Cl.[6] ..... G06G 7/16
[52] U.S. Cl. ..... 364/841; 327/357
[58] Field of Search ..... 364/841; 327/357

[56] References Cited

U.S. PATENT DOCUMENTS 5,107,150 4/1992 Kimura .
5,357,149 10/1994 Kimura .
5,381,113 1/1995 Kimura .
5,438,296 8/1995 Kimura .
5,444,648 8/1995 Kimura .
5,481,224 1/1996 Kimura .
5,485,119 1/1996 Kimura .
5,500,623 3/1996 Kimura .
5,521,542 5/1996 Kimura .
5,523,717 6/1996 Kimura .
5,552,734 9/1996 Kimura .
5,576,653 11/1996 Kimura .
5,578,965 11/1996 Kimura .
5,581,210 12/1996 Kimura .
5,581,211 12/1996 Kimura .
5,583,456 12/1996 Kimura .
5,602,509 2/1997 Kimura .
5,617,052 4/1997 Kimura .

FOREIGN PATENT DOCUMENTS 0672992 9/1995 European Pat. Off. .

OTHER PUBLICATIONS

B. Gilbert, "A Precise Four–Quadrant Multiplier with Subnanosecond Response," IEEE Journal of Solid–State Circuits, vol. SC–3, No. 4, Dec. 1968, pp. 365–373.

*Primary Examiner*—Tan V. Mai
*Attorney, Agent, or Firm*—Sughrue, Mion, Zinn, Macpeak & Seas, PLLC

[57] ABSTRACT

A bipolar analog multiplier is provided, which is capable of complete four-quadrant multiplication operation. This multiplier has a quadritail cell serving as a multiplier core circuit, and an input circuit. In the input circuit, first and second linear V-I converters linearly convert the applied first and second initial input voltages to first and third pairs of differential output currents, respectively. The first and third pairs of differential output currents are converted to first and second differential output voltages through logarithmic compression, respectively. First and second linear transconductance amplifiers amplify the first and second differential output voltage to generate second and fourth pairs of differential output currents. The second and fourth pairs of differential output currents are added to generate first, second, third, and fourth input currents. The I-V converter converts the applied first, second, third, and fourth input currents to the first, second, third, and fourth input voltages, which are applied to the quadritail cell, respectively.

27 Claims, 24 Drawing Sheets

Vcc
R4
R1
R3
R2
V4
V1
V3
V2
P4
P1
P3
P2
I4
I1
I3
I2
21
22
23
24
Io
Io
Io
Io
Q25
Q26
Q27
Q28
Q21
Q22
Q23
Q24
R11
R12
ΔVx
ΔVy
Ix1−
Ix1+
Iy1+
Iy1−
Q31
Q32
Q33
Q34
Q41
Q42
Q43
Q44
Q51
Q52
25
26
27
105
106

NONUPLE-TAIL CELL
308
CURRENT ADDER
307
309
R9
R3
R2
R1
$V_{CC}$
$R_L$
$V_{out1}$
$V_{out2}$
$\Delta V_{out}$
T5
T6
$V_1$
$V_2$
$V_3$
$V_9$
$I_1$
$I_2$
$I_3$
$I_9$
$I^+$
$I^-$
LTA
105
106
V-I
101
102
p-n
303A
303B
304A
304B
$2\Delta V_x$
$2\Delta V_y$
$I_{x1}^+$
$I_{x1}^-$
$I_{y1}^+$
$I_{y1}^-$
$I_x^+$
$I_x^-$
$I_y^+$
$I_y^-$
T1
T2
T3
T4
$V_x$
$V_y$ $V_{CC}$
106
105
224
223
222
221
$I_0$
Q228
Q224
Q223
Q227
Q226
Q222
Q221
Q225
R212
R211
$2\Delta V_y$
$2\Delta V_x$
R8
R5
R7
R3
R6
R1
R4
R2
R9
$V_8$
$V_5$
$V_7$
$V_3$
$V_6$
$V_1$
$V_4$
$V_2$
$V_9'$
P8
P5
P7
P3
P6
P1
P4
P2
P9
$I_8$
$I_5$
$I_7$
$I_3$
$I_6$
$I_1$
$I_4$
$I_2$
$I_9$
249
$I_{y1}^-$
$I_{y1}^+$
$I_{x1}^+$
$I_{x1}^-$
Q234
Q233
Q232
Q231
Q241
Q242
Q243
Q244
Q245
Q246
Q267
Q268
Q269
Q270
Q271
Q272
x2
227
226
225

$V_{CC}$
106
105
R9
R5
R7
R2
R6
R4
R1
R3
R8
$V_9$
$V_5$
$V_7$
$V_2$
$V_6$
$V_4$
$V_1$
$V_3$
$V_8'$
P9
P5
P7
P2
P6
P4
P1
P3
P8
$I_9$
$I_5$
$I_7$
$I_2$
$I_6$
$I_4$
$I_1$
$I_3$
$I_8$
$2\Delta V_y$
$2\Delta V_x$
224
223
221
222
$I_0$
Q228
Q227
Q223
Q224
Q225
Q226
Q221
Q222
R212
R211
$I_{y1}^-$
$I_{y1}^+$
$I_{x1}^+$
$I_{x1}^-$
Q312
Q311
Q310
Q309
Q308
Q307
Q233
Q234
Q231
Q232
Q246
Q245
Q244
Q243
Q242
Q241
X2
228
226
225
248

$V_{CC}$
105
106
226
227
221
222
223
224
$I_0$
R1
R2
R3
R4
R5
R6
R7
R8
R9
R211
R212
Q221
Q222
Q223
Q224
Q225
Q226
Q227
Q228
Q231
Q232
Q233
Q234
Q261
Q262
Q263
Q264
Q265
Q266
Q267
Q268
Q269
Q270
Q271
Q272
X2
242
$2\Delta V_x$
$2\Delta V_y$
$V_1$
$V_2$
$V_3$
$V_4$
$V_5$
$V_6$
$V_7$
$V_8$
$V_9$
$V_{10}$
$V_{11}$
$V_{12}$
$V_{14}$
P1
P2
P3
P4
P5
P6
P7
P8
P9
P10
P11
P12
P13
P14

$V_{CC}$
105
106
221
222
223
224
$I_0$
Q225
Q226
Q227
Q228
Q221
Q222
Q223
Q224
R211
R212
R1
R2
R3
R4
R5
R6
R7
R8
R9
$V_1$
$V_2$
$V_3$
$V_4$
$V_5$
$V_6$
$V_7$
$V_8$
$V_9$
$V_{10}$
$V_{11}$
$V_{12}$
$V_{13}$
$V_{14}$
P1
P2
P3
P4
P5
P6
P7
P8
P9
P10
P11
P12
P13
P14
$2\Delta V_x$
$2\Delta V_y$
249
Q241
Q242
Q243
Q244
Q245
Q246
Q231
Q232
Q233
Q234
Q267
Q268
Q269
Q270
Q271
Q272
X2
225
226
227

BIPOLAR TRANSLINEAR FOUR-QUADRANT ANALOG MULTIPLIER

BACKGROUND OF THE INVENTION

1. Field of the Invention

The present invention relates to a multiplier circuit for multiplying two input signals and more particularly, to a bipolar analog multiplier capable of perfect four-quadrant multiplication operation by using a multitail cell as a multiplier core circuit, which is preferably formed on a bipolar semiconductor integrated circuit (IC), and which is operable at a low supply voltage.

2. Description of the Related Art

A typical example of the conventional bipolar analog multipliers is the "Gilbert multiplier cell" shown in FIG. 1, which was disclosed in IEEE Journal of Solid-State Circuits, Vol. SC-3, No. 4, pp. 353–365, December, 1968, entitled "A Precise Four quadrant Analog Multiplier with Subnanosecond Response", and written by B. Gilbert.

In FIG. 1, npn bipolar transistors Q901 and Q902 form a first emitter-coupled differential pair, npn bipolar transistors Q903 and Q904 form a second emitter-coupled differential pair, and npn bipolar transistors Q907 and Q908 form a third emitter-coupled differential pair.

Collectors of the transistors Q901, Q902, Q903 and Q904 are cross-coupled. A collector of the transistor Q907 is connected to the coupled emitters of the transistors Q901 and Q902. A collector of the transistor Q908 is connected to the coupled emitters of the transistors Q903 and Q904. The coupled emitters of the transistors Q907 and Q908 are connected to a constant current sink sinking a constant current $I_0$. Bases of the transistors Q901 and Q904 are coupled together. Bases of the transistors Q902 and Q903 are also coupled together.

A first input signal voltage $V_x$ is applied across the coupled bases of the transistors Q901 and Q904 and those of the transistors Q902 and Q903. A second input signal voltage $V_y$ is applied across the bases of the transistors Q907 and Q908.

The third differential pair of the transistors Q907 and Q908 and the corresponding constant current sink constitute a differential voltage-current (V-I) converter for the voltage $V_y$ A collector current of the transistor Q907 is expressed as $[(I_0/2)+(I_y/2)]$, and a collector current of the transistor Q908 is expressed as $[(I_0/2)-(I_y/2)]$, where $I_y$ is a collector current generated by the input voltage $V_y$.

An output current $I^+$ is derived from the coupled collectors of the transistors Q901 and Q903, and another output current $I^-$ is derived from the coupled collectors of the transistors Q902 and Q904. A differential output current $\Delta I$ of the Gilbert multiplier cell containing the multiplication result of the first and second input signal voltages $V_x$ and $V_y$ is obtained by the difference of the two output currents $I^+$ and $I^-$; i.e., $\Delta I=I^+-I^-$.

The differential output current $\Delta I$ is expressed as $$\Delta I = I^+ - I^- = I_0\left\{\tanh\left(\frac{V_y}{2V_T}\right)\cdot\tanh\left(\frac{V_y}{2V_T}\right)\right\} \quad (1)$$

where $V_T$ is the thermal voltage defined as $V_T=kT/q$, where k is the Boltzmann's constant, T is absolute temperature in degrees Kelvin, and q is the charge of an electron.

When $V_x \leqq V_T$ and $V_y \leqq V_T$, the differential output current $\Delta I$ is approximated as $$\Delta I = I_0\left(\frac{V_y}{2V_T}\right)\cdot\left(\frac{V_y}{2V_T}\right) \quad (2)$$

The well-known Gilbert multiplier of FIG. 1 is unable to realize the perfect four-quadrant multiplication operation, which is due to the hyperbolic tangent (tanh) characteristic of the cross-coupled, emitter-coupled differential pairs of the transistors Q901, Q902, Q903, and Q904 and the nonlinear operation of the V-I converter formed by the transistors Q907 and Q908.

FIG. 2 shows a conventional analog multiplier realizing the perfect four-quadrant multiplication operation. This multiplier has the same cross-coupled, emitter-coupled differential pairs formed by the transistors Q901, 0902, 0903, and Q904 as those in the Gilbert multiplier cell of FIG. 1

Instead of the V-I converter formed by the transistors Q907 and Q908 in FIG. 1, a perfect-linear V-I converter 973 is provided. An arc hyperbolic tangent ($\tanh^{-1}$) converter 971 and a perfect-linear V-I converter 972 are additionally provided.

The $\tanh^{-1}$ converter 971 is formed by diode-connected npn bipolar transistors Q905 and Q906, and the coupled bases and collectors of the transistors Q905 and Q906 are connected to a power supply (supply voltage: $V_{cc}$). The converter 971 serves as a p-n junction element.

The first input signal voltage $V_x$ is applied across the input terminals of the V-I converter 972, and then, is converted to a pair of differential output currents $I_x^+$ and $I_x^-$. The differential output currents $I_x^+$ and $I_x^-$ are then $\tanh^{-1}$-converted by the $\tanh^{-1}$ converter 971, thereby generating a differential output voltage $\Delta V_x$ at the emitters of the transistors Q905 and Q906.

The differential output voltage $\Delta V_x$ is proportional to $\tanh^{-1}$ of the first input signal voltage $V_x$. The voltage $\Delta V_x$ is applied across the coupled bases of the transistors Q901 and Q904 and those of the transistors Q902 and Q903.

Since the applied voltage $\Delta V_x$ is proportional to $\tanh^{-1}$ of the first input signal voltage $V_x$, the tanh characteristic of the cross-coupled, emitter-coupled pair formedby the transistors Q901, Q902, Q903, and Q904 is compensated, resulting in a perfect-linear operation with respect to the first input signal voltage $V_x$.

On the other hand, the second input signal voltage $V_y$ is applied across the perfect-linear V-I converter 973, and then, is linearly converted to a pair of differential output currents $I_y^+$ and $I_y^-$; The cross-coupled, emitter-coupled pairs formed by the transistors Q901, Q902, QD03, and Q904 are driven by the pair of differential output currents $I_y^+$ and $I_y^-$. Accordingly, the operation of the cross-coupled, emitter-coupled pairs become linear with respect to the second input signal voltage $V_y$.

As a result, the perfect four-quadrant multiplication operation can be realized with respect to both of the first and second input signals $V_x$ and $V_y$. This means that the four-quadrant multiplier capable of perfect-linear operation can be realized.

The perfect-linear V-I converters 972 and 973 are termed "linear transconductance amplifiers" or "linear gain cells".

Next, the circuit operation of the conventional multiplier of FIG. 2 is explained below.

Supposing that the base-width modulation (i.e., the Early voltage) is ignored, a collector current Ic of abipolar transistor is typically expressed as the following equation (3) based on the exponential-law characteristic.

$$I_C = I_S\left\{\exp\left(\frac{V_{BE}}{V_T}\right) - 1\right\} \tag{3}$$

where $V_{BE}$ is the base-to-emitter voltage of the transistor, and $I_s$ is the saturation current thereof.

In the equation (3), the term of $\exp(V_{BE}/V_T)$ has a value of approximately $e^{10}$ during the normal operation of a bipolar transistor when the base-to-emitter voltage $V_{BE}$ is approximately 600 mV. Therefore, the term of (−1) can be ignored.

Thus, the equation (3) is approximated to the following equation (4).

$$I_C = I_S\exp\left(\frac{V_{BE}}{V_T}\right) \tag{4}$$

In the following analysis, for the sake of simplification, it is supposed that the common-base current gain factor of the transistor is approximately equal to unity and therefore, the base current can be ignored.

In the V-I converter 972, the following equations (5) and (6) are established.

$$I_x^+ = I_{0x} + G_xV_x = I_S\exp\left(\frac{V_{BE905}}{V_T}\right) \tag{5}$$

$$I_x^+ = I_{0x} - G_xV_x = I_S\exp\left(\frac{V_{BE906}}{V_T}\right) \tag{6}$$

where $V_{BE905}$ and $V_{BE906}$ are the base-to-emitter voltages of the transistors Q905 and Q906, respectively, and $2G_x$ is the conductance of the V-I converter 972 (i.e., $I_x^+-I_x^-=2G_xV_x$).

Accordingly, the differential output voltage $\Delta V_x$ of the converter 971 is given by the following equation (7).

$$\Delta V_x = V_{BE906} - V_{BE905} = V_T\ln\left(\frac{I_{0x} + G_xV_x}{I_{0x} - G_xV_x}\right) \tag{7}$$

On the other hand, the differential output current ΔI of the multiplier in FIG. 2 is expressed as the following equation (8).

$$\begin{aligned}\Delta I &= (I_y^+ - I_y^-)\tanh\left(\frac{\Delta V_x}{2V_T}\right) \\ &= (I_y^+ - I_y^-)\tanh\left\{\frac{1}{2}\ln\left(\frac{I_{0x} + G_xV_x}{I_{0x} - G_xV_x}\right)\right\} \\ &= (I_y^+ - I_y^-)\frac{G_xV_x}{I_{0x}}\end{aligned} \tag{8}$$

It is seen from the equation (8) that the differential output current ΔI is proportional to the tanh of the differential input voltage $\Delta V_x$.

The equation (8) is obtained by using the equation (7) and the following identity (9).

$$\tanh^{-1}z = \frac{1}{2}\ln\left(\frac{1+z}{1-z}\right), \qquad z = \frac{G_xV_x}{I_{0x}} \tag{9}$$

The difference of the pair of differential output currents $I_y^+$ and $I_y^-$, i.e., $(I_y^+-I_y^-)$ in the equation (8) is expressed as $$\begin{aligned}(I_y^+ - I_y^-) &= I_0\tanh\left(\frac{\Delta V_y}{2V_T}\right) \\ &= I_0\tanh\left\{\frac{1}{2}\ln\left(\frac{I_{0y} + G_yV_y}{I_{0y} - G_yV_y}\right)\right\} \\ &= I_0\frac{G_yV_y}{I_{0y}}\end{aligned} \tag{10}$$

The expression (10) is obtained by using the following identity (11).

$$\tanh^{-1}z = \frac{1}{2}\ln\left(\frac{1+z}{1-z}\right) \qquad z = \frac{G_yV_y}{I_{0y}} \tag{11}$$

Thus, the differential output current ΔI in the equation (8) is rewritten to the following expression (12).

$$\Delta I = I_0\frac{G_xG_yV_xV_y}{I_{0x}I_{0y}} \tag{12}$$

The expression (12) shows that the conventional multiplier of FIG. 2 is capable of the perfect four-quadrant multiplication operation with respect to both of the first and second input signals $V_x$ and $V_y$. In other words, it can be said that the conventional multiplier of FIG. 2 is a "translinear multiplier".

An analog multiplier is an essential, basic function block in analog signal applications. Recently, the need for an analog multiplier capable of perfect four-quadrant multiplication operation, which is linear for the two input signal voltages, has been increased.

SUMMARY OF THE INVENTION

Accordingly, an object of the present invention is to provide a bipolar analog multiplier capable of perfect four-quadrant multiplication operation.

Another object of the present invention is to provide a bipolar analog multiplier operable at a low power supply voltage The above objects together with others not specifically mentioned will become clear to those skilled in the art from the following description.

A bipolar analog multiplier according to a first aspect of the present invention has a quadritail cell serving as a multiplier core circuit, and an input circuit for the quadritail cell.

The quadritail cell is formed by emitter-coupled first, second, third, and fourth bipolar transistors driven by a single constant current source/sink. Collectors of the first and second transistors are coupled together to form a first output terminal. Collectors of the third and fourth transistors are coupled together to form a second output terminal. Bases of the first, second, third, and fourth transistors are applied with first, second, third, and fourth input voltages generated by the input circuit, respectively.

An output of the multiplier including the multiplication result of first and second initial input signal voltages is differentially derived from the first and second output terminals.

The input circuit includes a first linear V-I converter for linearly converting the applied first initial input signal voltage to a first pair of differential output currents, a first pair of p-n junction elements for converting the first pair of differential output currents to a first differential output voltage due to logarithmic compression, and a first linear transconductance amplifier (LTA) for amplifying the first differential output voltage to generate a second pair of differential output currents.

Also, the input circuit includes a second linear V-I converter for converting the applied second initial input signal voltage to a third pair of differential output currents, a second pair of p-n junction elements for converting the third pair of differential output currents to a second differential output voltage due to logarithmic compression, a second linear transconductance amplifier (LTA) for amplifying the second differential output voltage to generate a fourth pair of differential output currents.

The input circuit further includes a current adder and a current-voltage (I-V) converter.

The current adder adds the second pair of differential output currents generated by the first linear transconductance amplifier and the fourth pair of differential output currents generated by the second linear transconductance amplifier to generate first, second, third, and fourth input currents.

The I-V converter converts the applied first, second, third, and fourth input currents to the first, second, third, and fourth input voltages for the quadritail cell, respectively.

With the bipolar analog multiplier according to the first aspect, the applied first initial input signal voltage is linearly converted to the first pair of differential output currents by the first linear V-I converter. Then, the first pair of differential output currents are converted to the first differential output voltage due to logarithmic compression by the first pair of p-n junction elements. Thus, the first differential output voltage is proportional to the $\tanh^{-1}$ of the first initial input signal voltage. In other words, the first initial input signal voltage is $\tanh^{-1}$-converted to the first differential output voltage.

Similarly, the applied second initial input signal voltage is linearly converted to the third pair of differential output currents by the second linear V-I converter. Then, the third pair of differential output currents are converted to the second differential output voltage due to logarithmic compression by the second pair of p-n junction elements. Thus, the second differential output voltage is proportional to the $\tanh^{-1}$ of the second initial input signal voltage. In other words, the second initial input signal voltage is $\tanh^{-1}$-converted to the second differential output voltage.

Further, the first differential output voltage is applied to the first linear transconductance amplifier, thereby generating the second pair of differential output currents that are proportional to the $\tanh^{-1}$ of the first initial input signal voltage. Similarly, the second differential output voltage is applied to the second linear transconductance amplifier, thereby generating the fourth pair of differential output currents that are proportional to the $\tanh^{-1}$ of the second initial input signal voltage.

Using the second and third pairs of differential output currents, the current adder generates the first, second, third, and fourth input currents. The I-V converter converts the first, second, third, and fourth input currents thus generated to the first, second, third, andfourth input voltages, which are applied to the bases of the first, second, third, and fourth transistors of the quadritail cell having the same transfer characteristic as that of the well-known Gilbert multiplier cell.

Accordingly, the bipolar analog multiplier according to the first aspect of the present invention is capable of perfect four-quadrant multiplication operation.

Also, since the quadritail cell is used as the multiplier core circuit, this bipolar analog multiplier is operable at a power supply voltage as low as approximately 1.9 V if the first and second V-I converters and the first and second linear transconductance amplifiers are designed to be operable at the same power supply voltage.

In a preferred embodiment of the multiplier according to the first aspect, when the first, second, third, and fourth input voltages are defined as $V_1$, $V_2$, $V_3$, and $V_4$, and the first and second differential output voltages are defined as $\Delta V_x$ and $\Delta V_y$, respectively, the first, second, third, and fourth input voltages are expressed as $$V_1=a\Delta V_x+b\Delta V_y,$$

$$V_2=(a-1)\Delta V_x+(b-1)\Delta V_y,$$

$$V_3=(a-1)\Delta V_x+b\Delta V_y,$$

and $$V_4=a\Delta V_x+(b-1)\Delta V_y,$$

where a and b are constants.

In this case, it is preferred that the constants a and b are set as (i) a=b=1, (ii) a=½ and b =1, (iii) a=½ and b=0, or (iv) a=b=½.

A bipolar analog multiplier according to a second aspect of the present invention corresponds to one obtained by replacing the quadritail cell serving as the multiplier core circuit in the multiplier according to the first aspect with a nonuple-tail cell.

The nonuple-tail cell is formed by emitter-coupled first, second, third, fourth, fifth, sixth, seventh, eighth, and ninth bipolar transistors driven by a single constant current source/sink. The first and second transistors form a differential pair, and the third and fourth transistors form another differential pair.

Collectors of the first and second transistors are coupled together to form a first output terminal. Collectors of the third and fourth transistors are coupled together to form a second output terminal. Collectors of the fifth, sixth, seventh, eighth, and ninth transistors are connected to the coupled collectors of the first and second transistors. A bypass current flows through the fifth, sixth, seventh, eighth, and ninth transistors.

Bases of the first, second, third, fourth, fifth, sixth, seventh, eighth, and ninth transistors are applied with first, second, third, fourth, fifth, sixth, seventh, eighth, and ninth input voltages generated by the input circuit, respectively.

An output of the multiplier including the multiplication result of first and second initial input signal voltages is derived from at least one of the first and second output terminals.

With the bipolar analog multiplier according to the second aspect, the same advantages as those of the multiplier according to the first aspect is provided.

In a preferred embodiment of the multiplier according to the second aspect, when the first, second, third, fourth, fifth, sixth, seventh, eighth, and ninth input voltages are defined as $V_1$, $V_2$, $V_3$, $V_4$, $V_5$, $V_6$, $V_7$, $V_8$, and $V_9$, and the first and second differential output voltages are defined as $2\Delta V_x$ and $2\Delta V_y$, respectively, the first, second, third, fourth, fifth, sixth, seventh, eighth, and ninth input voltages are expressed as $$V_1=a(2\Delta V_x)+b(2\Delta V_y),$$

$$V_2=(a-1)(2\Delta V_x)+(b-1)(2\Delta V_x),$$

$$V_3=(a-1)(2\Delta V_x)+b(2\Delta V_x),$$

$$V_4=a(2\Delta V_x)+(b-1)(2\Delta V_x),$$

$$V_5=(a-½)(2\Delta V_x)+(b-½)(2\Delta V_y)+V_T\bullet ln2,$$

$$V_6=a(2\Delta V_x)+(b-½)(2\Delta V_x),$$

$$V_7=(a-1)(2\Delta V_x)+(b-½)(2\Delta V_x),$$

$$V_8=(a-½)(2\Delta V_x)+b(2\Delta V_x),$$

and $$V_9=(a-½)(2\Delta V_x)+(b-1)(2\Delta V_x),$$

where a and b are constants and $V_T$ is the thermal voltage.

In this case, it is preferred that the constants a and b are set as (i) a=b=1, (ii) a=½ and b=1, (iii) a =½ and b=0, or (iv) a=b=½.

A bipolar analog multiplier according to a third aspect of the present invention corresponds to one obtained by replacing the quadritail cell serving as the multiplier core circuit in the multiplier according to the first aspect with a quadridecimal-tail cell.

The quadridecimal-tail cell is formed by emitter-coupled first, second, third, fourth, fifth, sixth, seventh, eighth, ninth, tenth, eleventh, twelfth, thirteenth, and fourteenth bipolar transistors driven by a single constant current source/sink. The first and second transistors form a differential pair, and the third and fourth transistors form another differential pair.

Collectors of the first and second transistors are coupled together to form a first output terminal. Collectors of the fifth, sixth, seventh, eighth, and ninth transistors are connected to the coupled collectors of the first and second transistors.

Collectors of the third and fourth transistors are coupled together to form a second output terminal. Collectors of the tenth, eleventh, twelfth, thirteenth, and fourteenth transistors are connected to the coupled collectors of the third and fourth transistors.

Bases of the first, second, third, fourth, fifth, sixth, seventh, eighth, ninth, tenth, eleventh, twelfth, thirteenth, and fourteenth bipolar transistors are applied with first, second, third, fourth, fifth, sixth, seventh, eighth, ninth, tenth, eleventh, twelfth, thirteenth, and fourteenth input voltages generated by the input circuit, respectively.

An output of the multiplier including the multiplication result of first and second initial 'nput signal voltages is derived from at least one of the first and second output terminals.

With the bipolar analog multiplier according to the third aspect, the same advantages as those of the multiplier according to the first aspect is provided.

In a preferred embodiment of the multiplier according to the third aspect, when the first, second, third, fourth, fifth, sixth, seventh, eighth, ninth, tenth, eleventh, twelfth, thirteenth, and fourteenth input voltages are defined as $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$, and the first and second differential output voltages are defined as $2\Delta V_x$ and $2\Delta V_y$, respectively, the first, second, third, fourth, fifth, sixth, seventh, eighth, ninth, tenth, eleventh, twelfth, thirteenth, and fourteenth input voltages are expressed as $$V_1=a(2\Delta V_x)+b(2\Delta V_y)+V_T\bullet ln2,$$

$$V_2=(a-1)(2\Delta V_x)+(b-1)\ (2\Delta V_x)+V_T\bullet ln2,$$

$$V_3=(a-1)(2\Delta V_x)+b(2\Delta V_x)+V_T\bullet ln2,$$

$$V_4=a(2\Delta V_x)+(b-1)(2\Delta V_x)+V_T.ln2,$$

$$V_5=V_{10}=(a-½)(2\Delta V_x)+(b-½)(2\Delta V_y)+V_T\bullet ln2,$$

$$V_6=V_{11}=a(2\Delta V_x)+(b-½)(2\Delta V_x),$$

$$V_7=V_{12}=(a-1)(2\Delta V_x)+(b-½)(2\Delta V_x),$$

$$V_8=V_{13}=(a-½)(2\Delta V_x)+b(2\Delta V_x),$$

and $$V_9=V_{14}=(a-½)(2\Delta V_x)+(b-1)(2\Delta V_x),$$

where a and b are constants and $V_T$ is the thermal voltage.

In this case, it is preferred that the constants a and b are set as (i) a=b=1, (ii) a=½ and b=1, (iii) a=½ and b=0, or (iv) a=b=½.

In the multipliers according to the first, second, and third aspects, any element or device having a p-n junction, such as a bipolar transistor, or a diode, are preferably used as the p-n junction element.

In a preferred embodiment of the multipliers according to the first, second, and third aspects, each of the first and second linear transconductance amplifiers includes a differential pair of bipolar transistors and an emitter resistor connected to emitters of the two transistors. A corresponding one of the first and second initial input signal voltages is applied across bases of the two transistors.

In this case, it is preferred that each of the first and second linear transconductance amplifiers further includes first and second current mirror circuits. The second pair of output currents and the fourth pair of output currents are derived through the first and second current mirror circuits, respectively.

It is preferred that each of the first and second current mirror circuits has an emitter-follower bipolar transistor.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
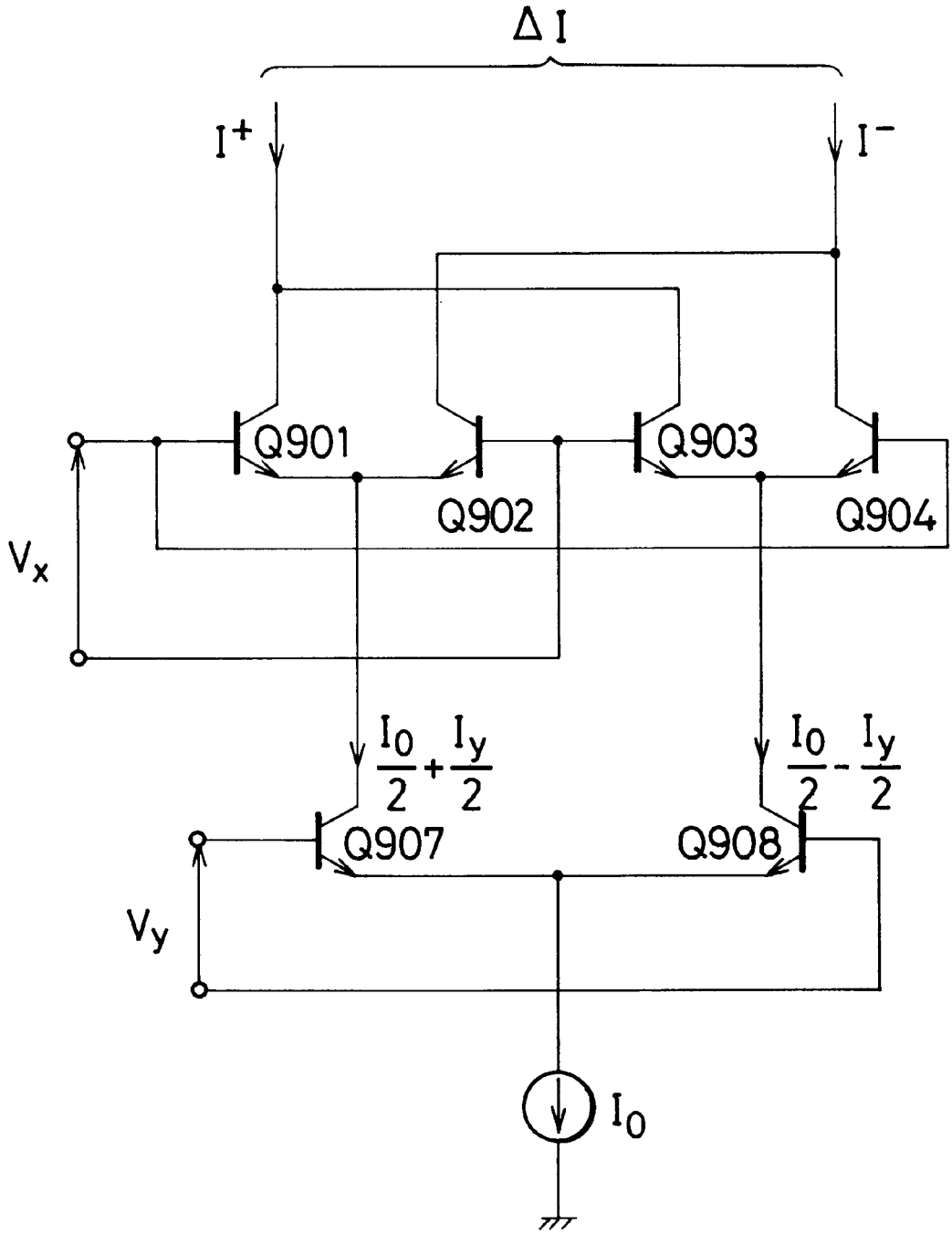
FIG. 1 PRIOR ART
FIG. 1 is a circuit diagram of the well-known Gilbert multiplier cell.
Figure 2:
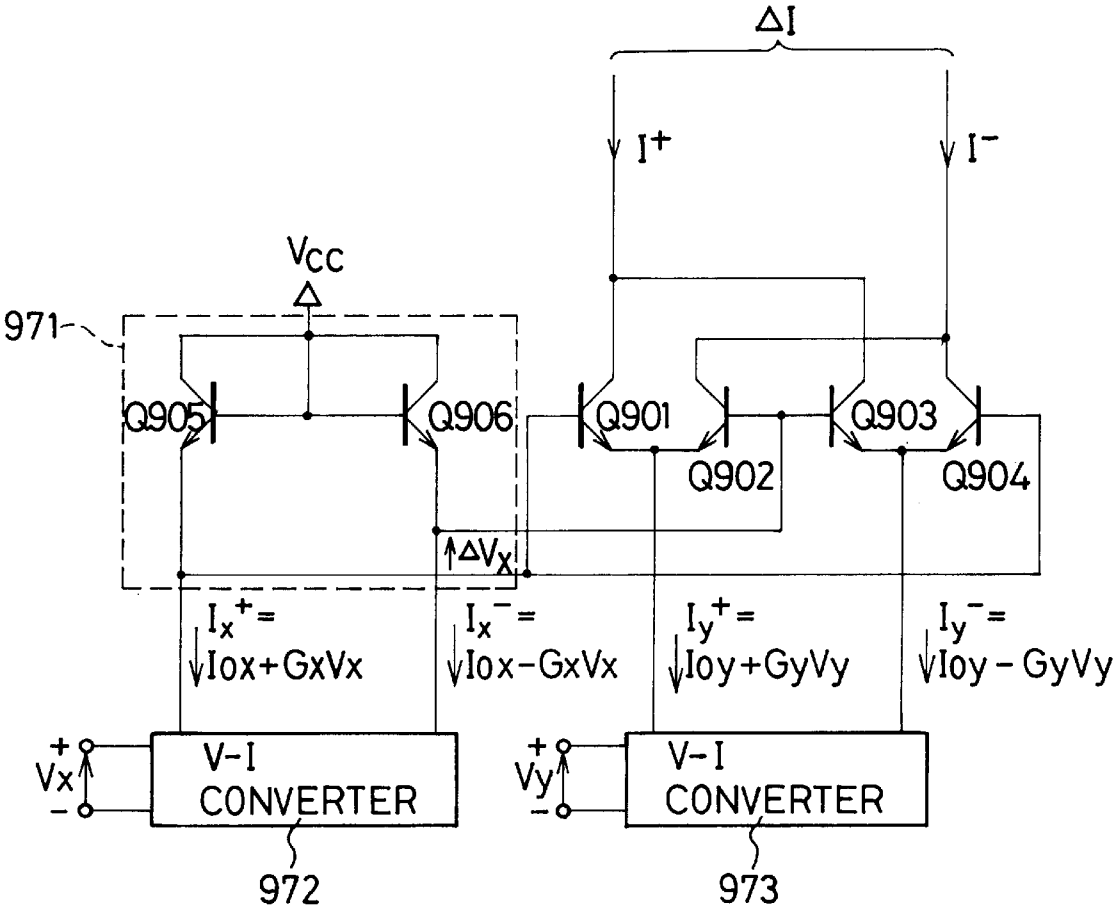
FIG. 2 PRIOR ART
FIG. 2 is a circuit diagram of a conventional bipolar perfect four-quadrant analog multiplier.

Preferred embodiments of the present invention will be described in detail below while referring to the drawings attached.

FIRST EMBODIMENT

Figure 3:
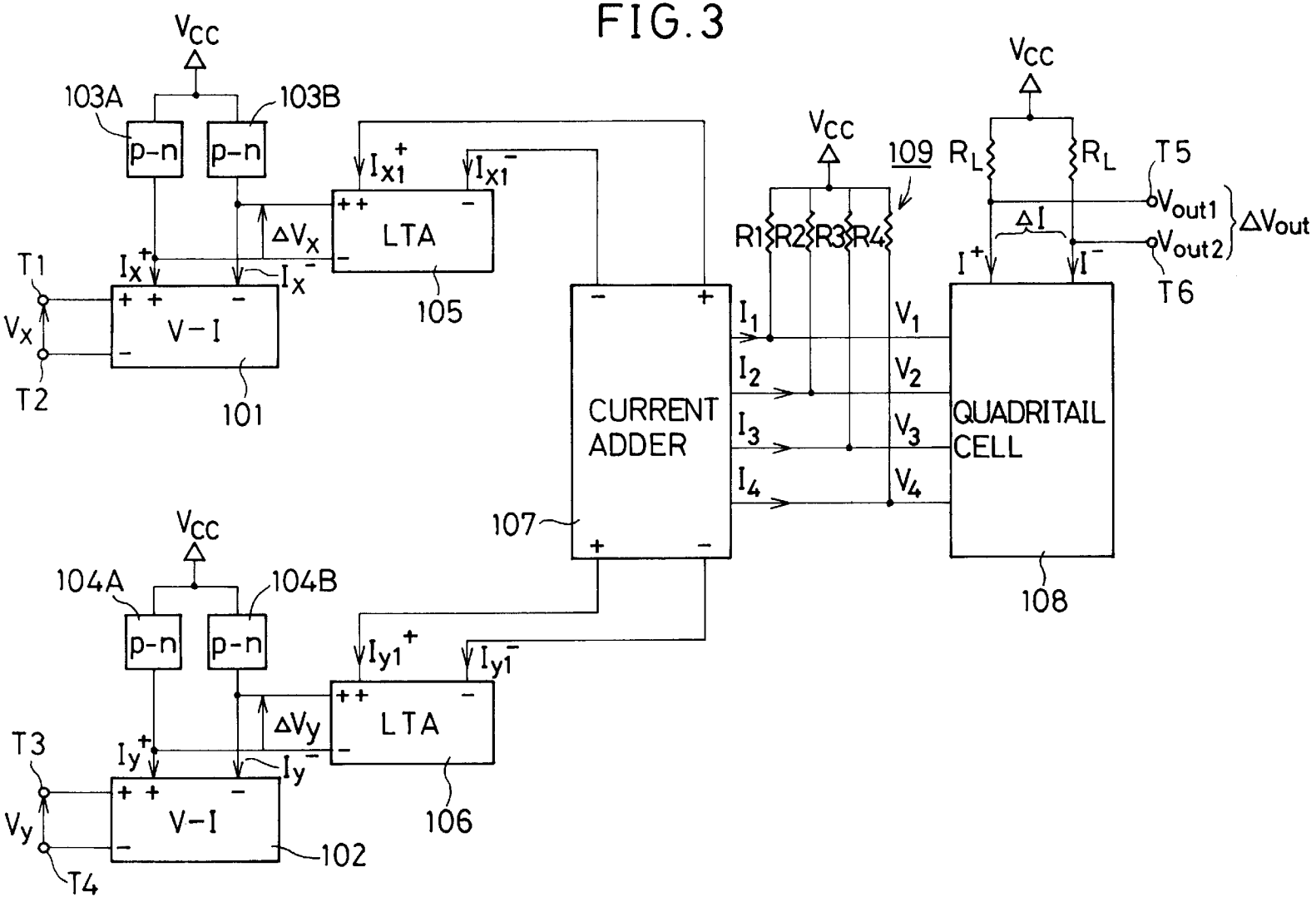
FIG. 3 is a block diagram showing a bipolar perfect four-quadrant analog multiplier according to a first embodiment of the present invention, where a quadritail cell is used as a multiplier core circuit.

As shown in FIG. 3, a bipolar perfect four-quadrant analog multiplier according to a first embodiment has a quadritail cell 108 serving as a multiplier core circuit, and an input circuit for the cell 108.

The input circuit includes first and second linear V-I converters 101 and 102, a first pair of p-n junction elements 103A and 103B, a second pair of p-n junction elements 104A and 104B, first and second linear transconductance amplifiers (LTAS) 105 and 106, a current adder 107, and an I-V converter 109.

Figure 4:
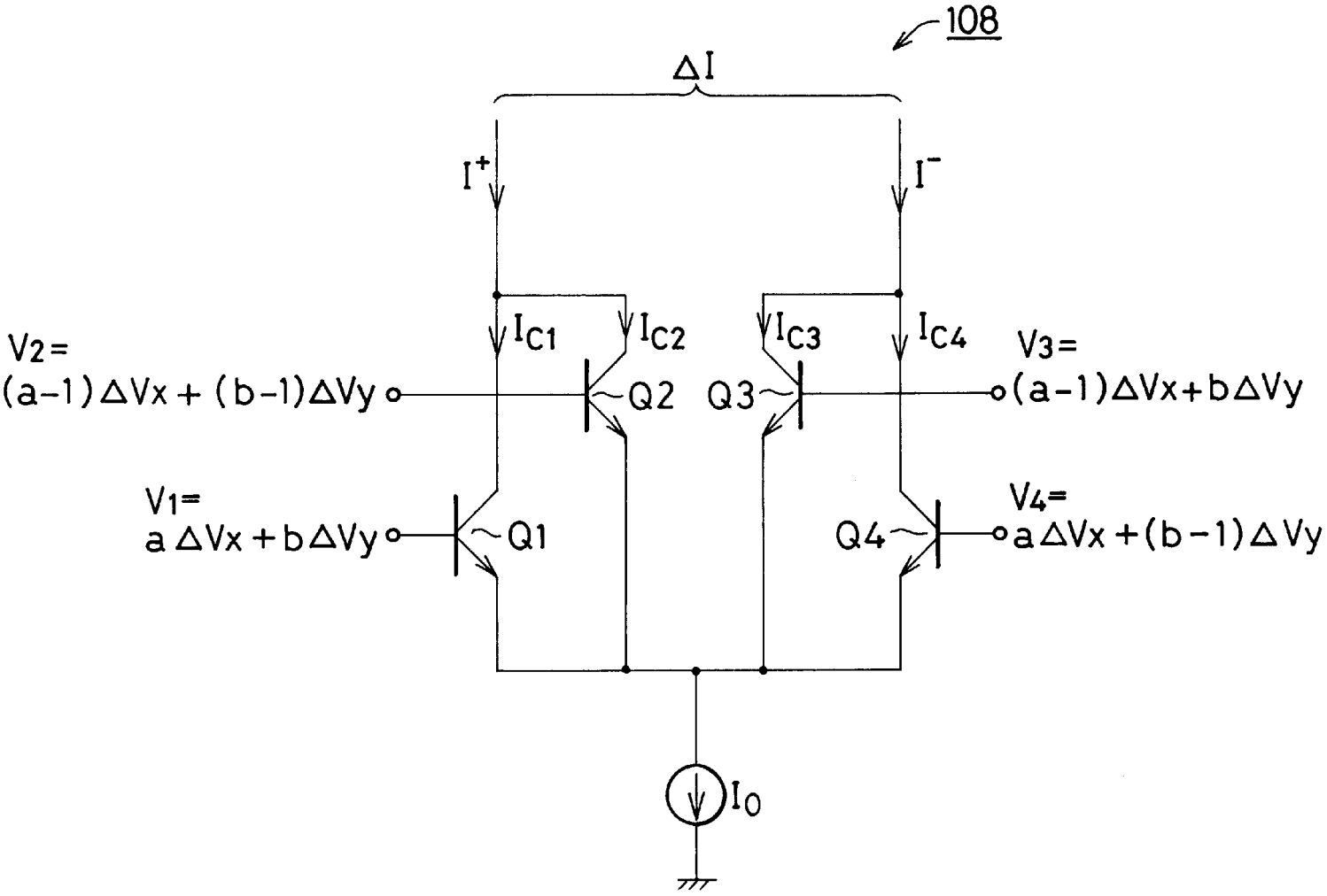
FIG. 4 is a circuit diagram of a bipolar quadritail cell used for the multiplier according to the first embodiment of FIG. 3.

As shown in FIG. 4, the quadritail cell 108 is formed by emitter-coupled npn bipolar transistors Q1, Q2, Q3, and Q4 driven by a single constant current sink sinking a constant current $I_0$. One end of the current sink is connected to the coupled emitters of the transistors Q1, Q2, Q3, and Q4, and the other end thereof is connected to the ground. The transistors Q1, Q2, Q3, and Q4 are the same in emitter area.

The transistors Q1 and Q2 form a differential pair, and the transistors Q3 and Q4 form another differential pair.

Collectors of the transistors Q1 and Q2 are coupled together to be connected to a power supply (supply voltage: $V_{cc}$) (not shown) through a first load resistor $R_L$ with a resistance $R_L$. The connection point of the coupled collectors of the transistors Q1 and Q2 with the first load resistor $R_L$ is connected to a first output terminal T5.

Collectors of the transistors Q3 and Q4 are coupled together to be connected to the power supply through a second load resistor $R_L$ with the same resistance $R_L$. The connection point of the coupled collectors of the transistors Q3 and Q4 with the second load resistor $R_L$ is connected to a second output terminal T6.

An output current $I^+$ is defined as a current flowing through the coupled collectors of the transistors Q1 and Q2. An output current $I^-$ is defined as a current flowing through the coupled collectors of the transistors Q3 and Q4.

A differential output current ΔI of the multiplier according to the first embodiment of FIG. 3, which includes the multiplication result of first and second initial input voltages $V_x$ and $V_y$, is defined as the difference of the output currents $I^{30}$ and $I^-$; i.e., $\Delta I = I^+ - I^-$.

Here, the output currents $I^+$ and $I^-$ are converted by the corresponding load resistors $R_L$ to output voltages $V_{out1}$ and $V_{out2}$, respectively. Thus, the differential output current ΔI is converted to a differential output voltage $\Delta V_{out}$; i.e., $\Delta V_{out} = V_{out1} - V_{out2}$, which are derived from the first and second output terminals T5 and T6.

Bases of the transistors Q1, Q2, Q3, and Q4 are applied with four input voltages $V_1$, $V_2$, $V_3$, and $V_4$ generated by the input circuit, respectively. When the input voltages $V_1$, $V_2$, $V_3$, and $V_4$ are properly designed or determined, the quadritail cell 108 is able to provide the multiplication operation. In other words, the cell 108 serves as a multiplier core circuit. In this case, the cell 108 has the same transfer characteristic as that of the well-known Gilbert multiplier cell of FIG. 1.

As shown in FIG. 3, the first initial input signal voltage $V_x$ is differentially applied to the first linear V-I converter 101 through first and second input terminals T1 and T2. The first linear V-I converter 101 linearly converts the applied first initial input signal voltage $V_x$ to a pair of differential output currents $I_x^+$ and $I_x^-$. The pair of differential output currents $I_x^+$ and $I_x^-$ are proportional to the voltage $V_x$.

The first pair of p-n junction elements 103A and 103B convert the pair of differential output currents $I_x^+$ and $I_x^-$ to a differential output voltage $\Delta V_x$ by logarithmic compression. Thus, the differential output voltage $\Delta V_x$ is proportional to the $\tanh^{-1}$ of the first initial input voltage $V_x$. In other words, the first initial input voltage $V_x$ is $\tanh^{-1}$-converted to the differential output voltage $\Delta V_x$.

The first linear transconductance amplifier 105 amplifies the differential output voltage $\Delta V_x$ at a specific gain to generate a pair of differential output currents $I_{x1}^+$ and $I_{x1}^-$. The pair of differential output currents $I_{x1}^+$ and $I_{x1}^-$ are then applied to the current adder 107.

Similarly, the second initial input signal voltage $V_y$ is differentially applied to the second linear V-I converter 102 through third and fourth input terminals T3 and T4. The second linear V-I converter 102 linearly converts the applied second initial input signal voltage $V_y$ to a pair of differential output currents $I_y^+$ and $I_y^-$. The pair of differential output currents $I_y^+$ and $I_y^-$ are proportional to the voltage $V_y$.

The second pair of p-n junction elements 104A and 104B converts the pair of differential output currents $I_y^+$ and $I_y^-$ to a differential output voltage $\Delta V_y$ by logarithmic compression. Thus, the differential output voltage $\Delta V_y$ is proportional to the $\tanh^{-1}$ of the second initial input signal voltage $V_y$. In other words, the second initial input voltage $V_y$ is $\tanh^{-1}$-converted to the differential output voltage $\Delta V_y$.

The second linear transconductance amplifier 106 amplifies the differential output voltage $\Delta V_y$ at a specific gain to generate a pair of differential output currents $I_{y1}^+$ and $I_{y1}^-$. The pair of differential output currents $I_{y1}^+$ and $I_{y1}^-$ are then applied to the current adder 107.

The current adder 107 performs addition or summation of the applied pair of differential output currents $I_x^+$ and $I_x^-$ generated by the first linear transconductance amplifier 105 and the applied pair of differential output currents $I_y^+$ and $I_y^-$ generated by the second linear transconductance amplifier 106, thereby generating four input currents $I_1$, $I_2$, $I_3$, and $I_4$.

The I-V converter 109 converts the applied four input currents $I_1$, $I_2$, $I_3$, and $I_4$ to the four input voltages $V_1$, $V_2$, $V_3$, and $V_4$, respectively. Here, the I-V converter 109 are simply formed by four resistors R1, R2, R3, and R4. Therefore, the input currents $I_1$, $I_2$, $I_3$, and $I_4$ are linearly converted to the input voltages $V_1$, $V_2$, $V_3$, and $V_4$ by the corresponding resistors R1, R2, R3, and R4, respectively.

These input voltages $V_1$, $V_2$, $V_3$, and $V_4$ are then applied to the bases of the transistors Q1, Q2, Q3, and Q4 of the quadritail cell 108 serving as the multiplier core circuit.

As described above, with the bipolar analog multiplier according to the first embodiment of FIG. 3, the applied first initial input signal voltage $V_x$ is linearly converted to the pair of differential output currents $I_x^+$ and $I_x^-$ by the first linear V-I converter 101. Then, the pair of differential output currents $I_x^+$and $I_x^-$ thus generated are converted to the differential output voltage $\Delta V_x$ through the logarithmic compression by the first pair of p-n junction elements 103A and 103B.

Thus, the differential output voltage $\Delta V_x$ is proportional to the $\tanh^{-1}$ of the first initial input signal voltage $V_x$. In other words, the initial input signal voltage $V_x$ is $\tanh^{-1}$-converted to the differential output voltage $\Delta V_x$.

Similarly, the applied second initial input signal voltage $V_y$ is linearly converted to the pair of differential output currents $I_y^+$ and $I_y^-$ by the second linear V-I converter 102. Then, the pair of differential output currents $I_y^+$ and $I_x^-$ are converted to the differential output voltage $\Delta V_y$ through the logarithmic compression by the second pair of p-n junction elements 104A and 104B.

Thus, the differential output voltage $\Delta V_y$ is proportional to the $\tanh^{-1}$ of the second initial input signal voltage $V_y$. In other words, the second initial input signal voltage $V_y$ is $\tanh^{-1}$-converted to the differential output voltage $\Delta V_y$.

Further, the differential output voltage $\Delta V_x$ is applied to the first linear transconductance amplifier 105, thereby generating the pair of differential output currents $I_{x1}^+$ and $I_{x1}^-$ that are linearly proportional to the differential output voltage $\Delta V_x$. Similarly, the differential output voltage $\Delta V_y$ is applied to the second linear transconductance amplifier, thereby generating the pair of differential output currents $I_{y1}^+$ and $I_{y1}^-$ that are linearly proportional to the differential output voltage $\Delta V_y$.

Using the pairs of differential output currents $I_{x1}^+$ and $I_{x1}^-$, and $I_{y1}^+$, and $I_{y1}^-$, the current adder 107 generates the four input currents $I_1$, $I_2$, $I_3$, and $I_4$. The I-V converter 109 further converts the four input currents $I_1$, $I_2$, $I_3$, and $I_4$ thus generated to the four input voltages $V_1$, $V_2$, $V_3$, and $V_4$, respectively.

Accordingly, the bipolar analog multiplier according to the first embodiment of FIG. 3 is capable of perfect four-quadrant multiplication operation.

Also, since the quadritail cell 108 is used as the multiplier core circuit, this bipolar analog multiplier of FIG. 3 is operable at a power supply voltage as low as approximately 1.9 V if the first and second V-I converters 101 and 102 and the first and second linear transconductance amplifiers 105 and 106 are designed to be operable at the same power supply voltage.

To make it possible to provide the multiplication operation by the quadritail cell 108, the four input voltages $V_1$, $V_2$, $V_3$, and $V_4$ for the cell 108 need to satisfy the following relationships (13a), (13b), (13c), and (13d)

$$V_1=a\Delta V_x+b\Delta V_y, \tag{13a}$$

$$V_2=(a-1)\Delta V_x+(b-1)\Delta V_y, \tag{13b}$$

$$V_3=(a-1)\Delta V_x+b\Delta V_y, \tag{13c}$$

and $$V_4 32\ a\Delta V_x+(b-1)\Delta V_y, \tag{13d}$$

where a and b are constants.

The expressions (13a), (13b), (13c), and (13d) mean that each of the four input voltages $V_1$, $V_2$, $V_3$, and $V_4$ is expressed by the sum of the two differential output voltages $\Delta V_x$ and $\Delta V_y$ generated by the first and second pairs of the p-n junction elements 103A, 103B, 104A, and 104B.

It is clear from the above expressions (13a), (13b), (13c), and (13d) that the quadritail cell 108 provides the multiplier operation when the current adder 107 and the I-V converter 109 operate to satisfy these expressions (13a), (13b), (13c), and (13d).

Next, the circuit configuration of the first and second V-I converters 101 and 102, and the first and second pairs of p-n junction elements 103A and 103B and 104A and 104B is explained below.

Figure 5:
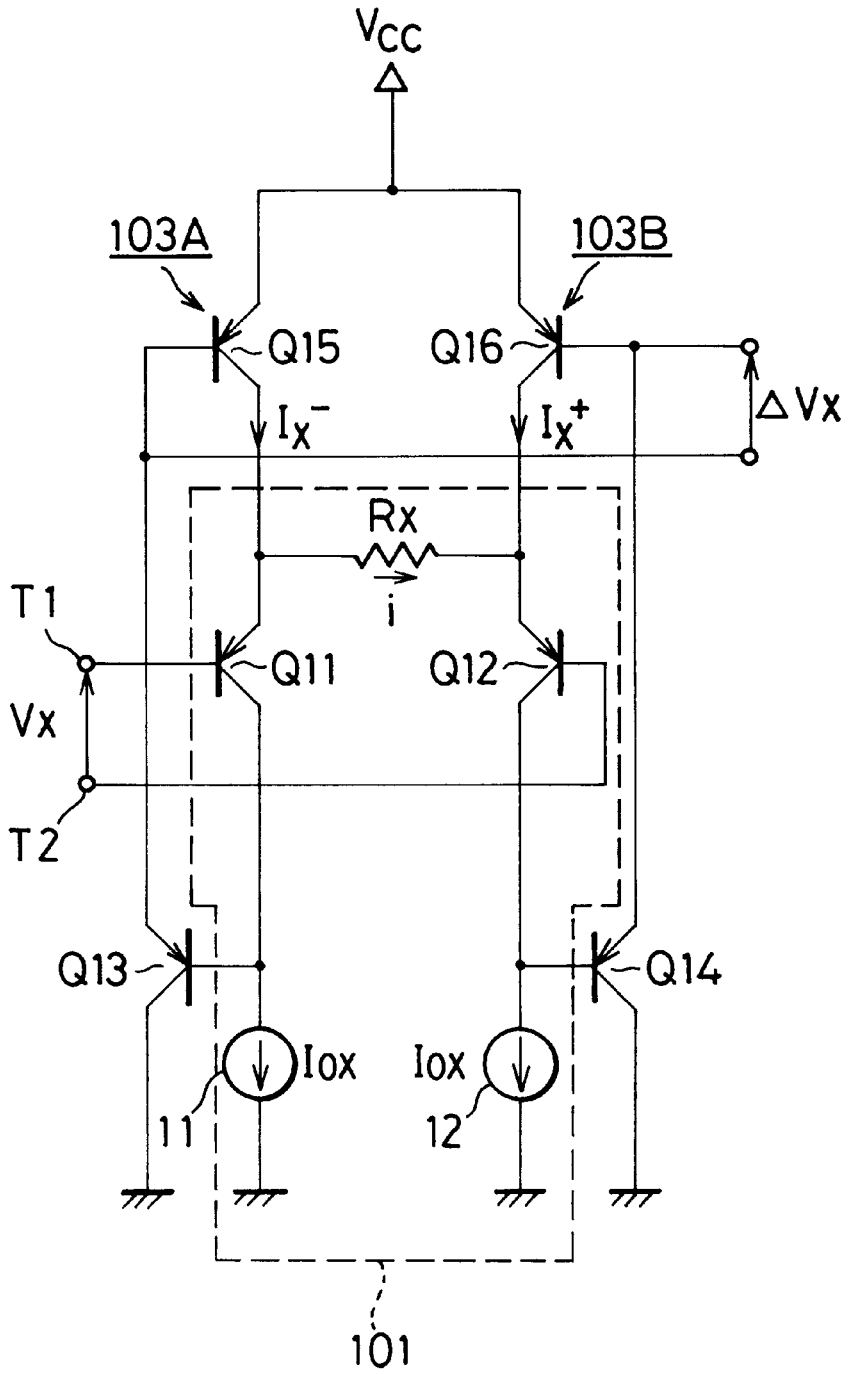
FIG. 5 is a circuit diagram of a linear V-I converter used for the multiplier according to the first embodiment of FIG. 3.

An example of the first V-I converter 101 and an example of the first pair of p-n junction elements 103A and 103B are shown in FIG. 5. The second V-I converter 102 and the second pair of p-n junction elements 104A and 104B are the same in configuration as those of the first V-I converter 101 and the first pair of p-n junction elements 103A and 103B, respectively.

As shown in FIG. 5, the first V-I converter 101 includes a balanced differential pair of pnp bipolar transistors Q11 and Q12 whose emitter areas are equal to each other. Emitters of the transistors Q11 and Q12 are coupled together through an emitter resistor $R_x$ having a resistance $R_x$.

A collector of the transistor Q11 is connected to the ground through a constant current sink 11 sinking a constant current $I_{0x}$. A collector of the transistor Q12 is connected to the ground through a constant current sink 12 sinking the same constant current $I_{0x}$.

A base of the transistor Q11 is connected to the first input terminal T1 and a base of the transistor Q12 is connected to the second input terminal T2. The first initial input signal voltage $V_x$ is differentially applied across the bases of the transistors Q11 and Q12 through the input terminals T1 and T2.

The emitter of the transistor Q11 is further connected to a collector of a pnp bipolar transistor Q15. The emitter of the transistor Q12 is further connected to a collector of a pnp bipolar transistor Q16. Emitters of the transistors Q15 and Q16 are connected in common to the power supply.

A base of the transistor Q15 is connected to an emitter of a pnp bipolar transistor Q13. A base of the transistor Q13 is connected to the collector of the transistor Q11. A collector of the transistor Q13 is connected to the ground. A base of the transistor Q16 is connected to an emitter of a pnp bipolar transistor Q14. A base of the transistor Q14 is connected to the collector of the transistor Q12. A collector of the transistor Q14 is connected to the ground.

The transistors Q15 and Q16 serve as the first pair of p-n junction elements 103A and 103B, respectively.

The two current sinks 11 and 12 serve to sink the same constant currents $I_{0x}$ from the transistors Q11 and Q12 forming the differential pair, respectively.

The transistors Q15 and Q16 serve as current sources together with the corresponding emitter-follower transistors Q13 and Q14, respectively. In other words, the transistors Q15 and Q13 serve as an emitter-follower-augmented current source, and the transistors Q16 and Q14 serves as another emitter-follower-augmented current source.

The differential output voltage $\Delta V_x$ is derived from the bases of the transistors Q15 and Q16 through the emitter-follower transistors Q13 and Q14.

With the first V-I converter 101 and the first pair of p-n junction elements 103A and 103B shown in FIG. 5, the same constant currents $I_{0x}$ flow through the transistors Q11 and Q12 by the corresponding current sinks 11 and 12 and therefore, the base-to-emitter voltages $V_{BE11}$ and $V_{BE12}$ of the transistors Q11 and Q12 are equal to each other. Accordingly, the voltage applied across the emitter resistor $R_x$ is equal to the first initial input signal voltage $V_x$, resulting in a current i flowing through the emitter resistor $R_x$ according to the value of the input signal voltage $V_x$. This means that the following equation (14) is established.

$$V_x = R_x i \tag{14}$$

Accordingly, the current i is given by $$i = \frac{V_x}{R_x} \tag{15}$$

Thus, the pair of differential output currents $I_x^+$ and $I_x^-$ of the first V-I converter 101 are expressed by the following equations (16a) and (16b), respectively.

$$I_x^+ = I_{0x} + i = I_{0x} + \frac{V_x}{R_x} \tag{16a}$$

$$I_x^- = I_{0x} - i = I_{0x} - \frac{V_x}{R_x} \tag{16b}$$

It is seen from the equations (16a) and (16b) that the emitter resistor $R_x$ serves as a "floating resistor", and that the pair of differential output currents $I_x^+$ and $I_x^-$ flowing through the transistors Q16 and Q15 have the perfect-linear characteristics with respect to the input signal voltage $V_x$.

As described above, the combination of the first V-I converter 101 and the first pair of p-n junction elements 103A and 103B shown in FIG. 5 has the perfect-linear transfer characteristic. Therefore, it can be used as the linear transconductance amplifiers 105 and 106 if it is able to generate the pair of differential output currents $I_{x1}^+$ and $I_{x1}^-$ or the pair of differential output currents $I_{y1}^+$ and $I_{y1}^-$. Four examples of the circuit configuration of the linear transconductance amplifiers 105 and 106 are shown in FIGS. 6, 7, 8, and 9.

Next, the operation of the quadritail cell 108 shown in FIG. 4 is explained in detail below.

Supposing that the transistors Q1, Q2, Q3, and Q4 are matched in characteristics, the collector currents $I_{C1}$, $I_{C2}$, $I_{C3}$, and $I_{C4}$ of the transistors Q1, Q2, Q3, and Q4 are expressed as the following equations (17), (18), (19), and (20), respectively.

$$I_{C1} = I_S \exp\left(\frac{V_1 + V_R - V_E}{V_T}\right) \tag{17}$$

$$I_{C2} = I_S \exp\left(\frac{V_2 + V_R - V_E}{V_T}\right) \tag{18}$$

$$I_{C3} = I_S \exp\left(\frac{V_3 + V_R - V_E}{V_T}\right) \tag{19}$$

$$I_{C4} = I_S \exp\left(\frac{V_4 + V_R - V_E}{V_T}\right) \tag{20}$$

where $V_R$ is the dc component of the input voltages $V_1$, $V_2$, $V_3$, and $V_4$, and $V_E$ is the common emitter voltage.

On the other hand, since the transistors Q1, Q2, Q3, and Q4 are driven by the common tail current $I_0$, the following equation (21) is established.

$$I_{C1} + I_{C2} + I_{C3} + I_{C4} = \alpha_F I_0 \tag{21}$$

where $\alpha_F$ is the common-base current gain factor of the transistors Q1, Q2, Q3, and Q4.

By solving the equations (17), (18), (19), (20), and (21), the following equation (22) is obtained as $$I_S\exp\left(\frac{V_R - V_E}{V_T}\right) = \frac{\alpha_F I_0}{\exp\left(\frac{V_1}{V_T}\right) + \exp\left(\frac{V_2}{V_T}\right) + \exp\left(\frac{V_3}{V_T}\right) + \exp\left(\frac{V_4}{V_T}\right)} \tag{22}$$

As a result, the differential output current $\Delta I$ ($=I^+-I^-$) of the multiplier of FIG. 3 or quadritail cell 108 is expressed as the following equation (23).

$$\Delta I = (I_{C1} + I_{C2}) - (I_{C3} + I_{C4}) \tag{23}$$

$$= \frac{\alpha_F I_O\left\{\exp\left(\frac{V_1}{V_T}\right) + \exp\left(\frac{V_2}{V_T}\right) - \exp\left(\frac{V_3}{V_T}\right) - \exp\left(\frac{V_4}{V_T}\right)\right\}}{\exp\left(\frac{V_1}{V_T}\right) + \exp\left(\frac{V_2}{V_T}\right) + \exp\left(\frac{V_3}{V_T}\right) + \exp\left(\frac{V_4}{V_T}\right)}$$

As previously stated, in the quadritail cell 108 shown in FIG. 4, the four input voltages $V_1$, $V_2$, $V_3$ and $V_4$ are expressed as $$V_1 = a\Delta V_x + b\Delta V_y, \tag{13a}$$

$$V_2 = (a-1)\Delta V_x + (b-1)\Delta V_y, \tag{13b}$$

$$V_3 = (a-1)\Delta V_x + b\Delta V_y, \tag{13c}$$

and $$V_4 = a\Delta V_x + (b-1)\Delta V_y. \tag{13d}$$

By substituting the equations (13a), (13b), (13c), and (13d) into the equation (23), the differential output current $\Delta I$ is rewritten to the following equation (24).

$$\Delta I = \alpha_F I_O \tanh\left(\frac{\Delta V_x}{2V_T}\right)\tanh\left(\frac{\Delta V_y}{2V_T}\right) \tag{24}$$

If $\alpha_F$ is multiplied to the both sides of the equation (24), the right side will be equal to the transfer characteristic of the well-known double-balanced differential amplifier, i.e., the Gilbert multiplier cell of FIG. 1. This means that the equations (13a), (13b), (13c), and (13d) make it possible to realize the multiplication operation by the quadritail cell 108.

Typically, the obtainable value of $\alpha_F$ is 0.98 to 0.99 for the popular bipolar processes, which is approximately equal to unity. Therefore, the coefficient of $\alpha_F$ can be ignored in the equation (24).

To provide the multiplication operation, the approximation of "tanh z≈z" is necessary in the equation (24). Therefore, it cannot be said that the obtainable multiplication operation is perfectly linear or translinear.

However, in the multiplier according to the first embodiment of FIG. 3, the perfect-linear multiplication operation can be realized with the use of the equation (24), the reason of which is as follows.

The pair of differential output currents $I_x^+$ and $I_x^-$ of the first V-I converter 101 are given by the following expressions (25a) and (25b) using the above expressions (16a) and (16b), respectively $$I_x^+ = I_{Ox} + \frac{V_x}{R_x} = I_S\exp\left(\frac{V_{BE15}}{V_T}\right) \tag{25a}$$

-continued $$I_x^- = I_{Ox} - \frac{V_x}{R_x} = I_S\exp\left(\frac{V_{BE16}}{V_T}\right) \tag{25b}$$

where $V_{BE15}$ and $V_{BE16}$ are the base-to-emitter voltages of the transistors Q15 and Q16, respectively.

Therefore, the differential output voltage $\Delta V_x$ of the first pair of p-n junction element 103A and 103B is expressed as the following equation (26).

$$\Delta V_x = V_{BE16} - V_{BE15} = V_T \cdot \ln\left(\frac{I_{0x} + \frac{V_x}{R_x}}{I_{0x} - \frac{V_x}{R_x}}\right) \tag{26}$$

Similarly, the differential output voltage $\Delta V_y$ of the second pair of p-n junction element 104A and 104B is expressed as the following equation (27)

$$\Delta V_y = V_T \cdot \ln\left(\frac{I_{0y} + \frac{V_y}{R_y}}{I_{0y} - \frac{V_y}{R_y}}\right) \tag{27}$$

where $I_{0y}$ is the driving current for the corresponding transistors (not shown) to the transistors Q11 and Q12 in FIG. 5, and $R_y$ is the resistance of the corresponding emitter resistor to the resistor $R_x$.

By substituting the equations (26) and (27) into the above equation (24), the following equation (28) is obtained.

$$\Delta I = \alpha_F I_0 \cdot \tanh\left\{\frac{1}{2}\ln\left(\frac{I_{0x} + \frac{V_x}{R_x}}{I_{0x} - \frac{V_x}{R_x}}\right)\right\} \cdot \tanh\left\{\frac{1}{2}\ln\left(\frac{I_{0y} + \frac{V_y}{R_y}}{I_{0y} - \frac{V_y}{R_y}}\right)\right\} \tag{28}$$

$$= \alpha_F I_0 V_x \frac{V_y}{I_{0x} I_{0y} R_x R_y}$$

The equation (28) is obtained by using the following identity (29).

$$\tanh^{-1} z = \frac{1}{2}\ln\left(\frac{1+z}{1-z}\right),\ z = \frac{V_x}{I_{0x}R_x} \text{ or } \frac{V_y}{I_{0y}R_y} \tag{29}$$

It is seen from the expression (28) that the multiplier according to the first embodiment of FIG. 3 is capable of the perfect four-quadrant multiplier operation. In other words, it can be said to be a translinear analog multiplier.

As seen from the above explanation about the operation principle, the constants or coefficients a and b of the input voltages $V_1$, $V_2$, $V_3$, and $V_4$ shown in the equations (13a), (13b), (13c), and (13d) may be theoretically optional.

However, practically, the constants a and b are not able to be freely determined in the first and second linear transconductance amplifiers 105 and 106. The constants a and b need to be suitably designed at specific values in order to realize the bipolar perfect four-quadrant analog multiplier.

Figure 6:
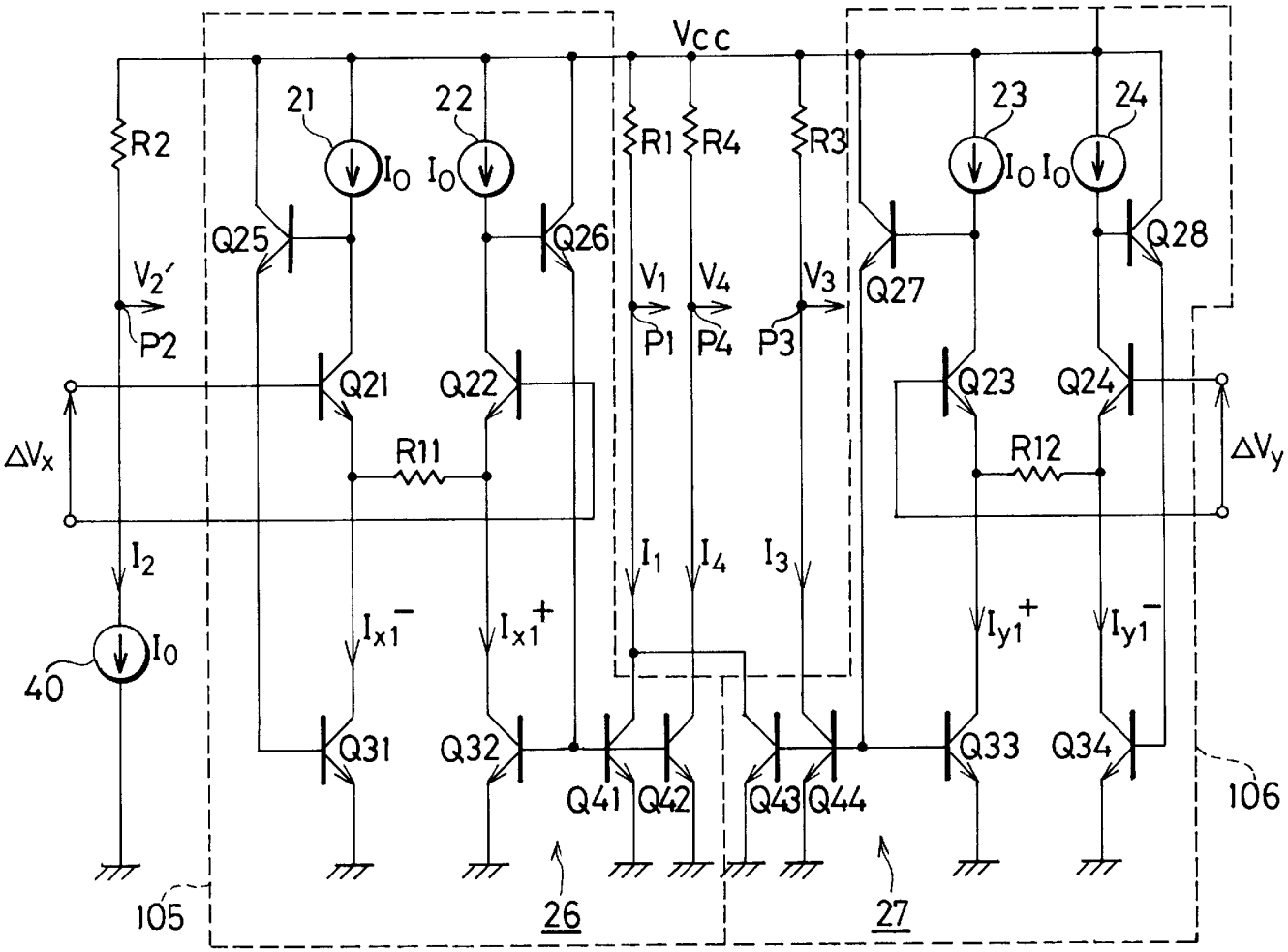
FIG. 6 is a circuit diagram showing the combination of first and second linear transconductance amplifiers, a wired current adder, and resistors serving as an I-V converter, which is used for the multiplier according to the first embodiment of FIG. 3, where a=b=1.

FIG. 6 shows the combination of first and second linear transconductance amplifiers 105 and 106, the current adder 107, and the I-V converter 109, which is used for the multiplier according to the first embodiment of FIG. 3, where a=b=1.

Since a=b=1, from the above equations (13a), (13b), (13c), (13d), the four input voltages $V_1$, $V_2$, $V_3$, and $V_4$ are expressed as $$V_1=\Delta V_x+\Delta V_y \quad (30a)$$

$$V_2=0 \quad (30b)$$

$$V_3=\Delta V_y \quad (30c)$$

$$V_4=\Delta V_x \quad (30d)$$

Therefore, the first and second linear transconductance amplifiers 105 and 106, the current adder 107, and the I-V converter 109 are designed to satisfy the above relationships (30a), (30b), (30c), and (30d).

The first linear transconductance amplifier 105 in FIG. 6 has the following configuration.

As shown in FIG. 6, the first linear transconductance amplifier 105 includes abalanced differential pair of npn bipolar transistors Q21 and Q22 whose emitter areas are eoual to each other. Emitters of the transistors Q21 and Q22 are coupled together through an emitter resistor R11 having a resistance R11.

A collector of the transistor Q21 is connected to the power supply through a constant current source 21 supplying a constant current $I_0$. A collector of the transistor Q22 is connected to the power supply through a constant current source 22 supplying the same constant current $I_0$.

The differential output voltage $\Delta V_x$ is applied across bases of the transistors Q21 and Q22.

The emitter of the transistor Q21 is further connected to a collector of an npn bipolar transistor Q31. The emitter of the transistor Q22 is further connected to a collector of an npn bipolar transistor Q32. Emitters of the transistors Q31 and Q32 are connected to the ground.

A base of the transistor Q31 is connected to an emitter of an npn bipolar transistor Q25. A base of the transistor Q25 is connected to the collector of the transistor Q21. A collector of the transistor Q25 is connected to the power supply. A base of the transistor Q32 is connected to an emitter of a pnp bipolar transistor Q26. A base of the transistor Q26 is connected to the collector of the transistor Q22. A collector of the transistor Q26 is connected to the power supply.

The two current sources 21 and 22 serve to supply the same constant currents $I_0$ to the transistors Q21 and Q22 forming the differential pair, respectively.

The transistors Q31 and Q32 serve as current sources together with the emitter-follower transistors Q25 and Q26, respectively. In other words, the transistors Q31 and Q25 serve as an emitter-follower-augmented current source, and the transistors Q32 and Q26 serve as another emitter-follower-augmented current source.

The pair of differential output currents $I_{x1}^+$ and $I_{x1}^-$ are derived from the bases of the transistors Q32 and Q31, respectively.

In the linear transconductance amplifier 105 in FIG. 6, two npn bipolar transistors Q41 and Q42 are additionally provided to the transistor Q32, thereby forming an emitter-follower-augmented current mirror circuit 26. The output current $I_{x1}^+$ is derived through the current mirror circuit 26. Therefore, the same currents $I_{x1}^+$ flow through the transistors Q41 and Q42.

Emitters of the transistors Q41 and Q42 are connected to the ground. A collector of the transistor Q41 is connected to the power supply through a resistor R1 with a resistance R1. A collector of the transistor Q42 is connected to the power supply through a resistor R4 with a resistance R4.

The input current $I_1$ flows through the resistor R1, thereby generating the input voltage $V_1$ The input voltage $V_1$ is derived from the connection point P1 of the collector of the transistor Q41 and the resistor R1.

The input current $I_4$ flows through the resistor R4, thereby generating the input voltage $V_4$. The input voltage $V_4$ is derived from the connection point P4 of the collector of the transistor Q44 and the resistor R4.

Similarly, the second linear transconductance amplifier 106 includes a balanced differential pair of npn bipolar transistors Q23 and Q24 whose emitter areas are equal to each other. Emitters of the transistors Q23 and Q24 are coupled together through an emitter resistor R12 having a resistance R12.

A collectorof the transistor Q23 is connected to the power supply through a constant current source 23 supplying a constant current $I_0$. A collector of the transistor Q24 is connected to the power supply through a constant current source 24 supplying the same constant current $I_0$.

The differential output voltage $\Delta V_y$ is applied across bases of the transistors Q23 and Q24.

The emitter of the transistor Q23 is further connected to a collector of an npn bipolar transistor Q33. The emitter of the transistor Q24 is further connected to a collector of an npn bipolar transistor Q34. Emitters of the transistors Q33 and Q34 are connected to the ground.

A base of the transistor Q33 is connected to an emitter of an npn bipolar transistor Q2$^7$. A base of the transistor Q27 is connected to the collector of the transistor Q23. A collector of the transistor Q27 is connected to the power supply. A base of the transistor Q34 is connected to an emitter of a pnp bipolar transistor Q28. A base of the transistor Q28 is connected to the collector of the transistor Q24. A collector of the transistor Q28 is connected to the power supply.

The two current sources 23 and 24 serve to supply the same constant currents $I_0$ to the transistors Q23 and Q24 forming the differential pair, respectively.

The transistors Q33 and Q34 serve as current sources together with the emitter-follower transistors Q27 and Q28, respectively. In other words, the transistors Q33 and Q27 serve as an emitter-follower-augmented current source, and the transistors Q34 and Q28 serve as another emitter-follower-augmented current source.

The pair of differential output currents $I_{x1}^+$ and $I_{x1}^-$ are derived from the bases of the transistors Q33 and Q34, respectively.

In the linear transconductance amplifier 106 in FIG. 6, npn bipolar transistors Q43 and Q44 are additionally provided to the transistor Q33, thereby forming an emitter-follower-augmented current mirror circuit 27. The output current $I_{y1}^+$ is derived through the current mirror circuit 27. Therefore, the same currents $I_{y1}^+$ flow through the transistors Q43 and Q44.

Emitters of the transistors Q43 and Q44 are connected to the ground. A collector of the transistor Q43 is connected to the collector of the transistor Q41 to thereby be connected to the power supply through the resistor R1. A collector of the transistor Q44 is connected to the power supply through a resistor R3 with a resistance R3.

The input current $I_3$ flows through the resistor R3, thereby generating the input voltage $V_3$. The input voltage $V_3$ is derived from the connection point P3 of the collector of the transistor Q44 and the resistor R3.

In this case, the input voltage $V_2$ is zero. Therefore, a constant current sink 40 sinking a constant current $I_0$ and a resistor R2 with a resistance R2 are additionally provided, as shown in FIG. 6. One end of the current sink 40 is connected to the power supply through the resistor R2, and the other end thereof is connected to the ground.

The input current $I_2$, which is a constant current, flows through the resistor R2, thereby generating a constant dc bias voltage $V_2'$ at the connection point P2 of the current sink 40 and the resistor R2. Only the constant dc bias voltage $V_2'$ is applied to the base of the transistor Q2 in the quadritail cell 108.

The current adder 107 in FIG. 6 is formed by wiring connection of the transistors Q41, Q42, Q43, and Q44, and the resistors R1, R3, and R4. In other words, the current adder 107 is a wired configuration.

Each of the first and second linear transconductance amplifiers 105 and 106 has substantially the same configuration as that of the combination of the first V-I converter 101 and the first pair of p-n junction elements 103A and 103B shown in FIG. 5. Therefore, the perfect-linear operation can be provided.

To satisfy the above relationships (30a), (30b), (30c), and (30d), the constants a and b may be adjusted by setting at least one of (i) the resistance R11 of the emitter resistor R11 (ii) the resistance R12 of the emitter resistor R12, (iii) the resistance R1, R2, R3 or R4 of the resistors R1, R2, R3, and R4, and (iv) the mirror ratio (or, the emitter area ratio) of the current mirror circuits 26 and 27.

SECOND EMBODIMENT

Figure 7:
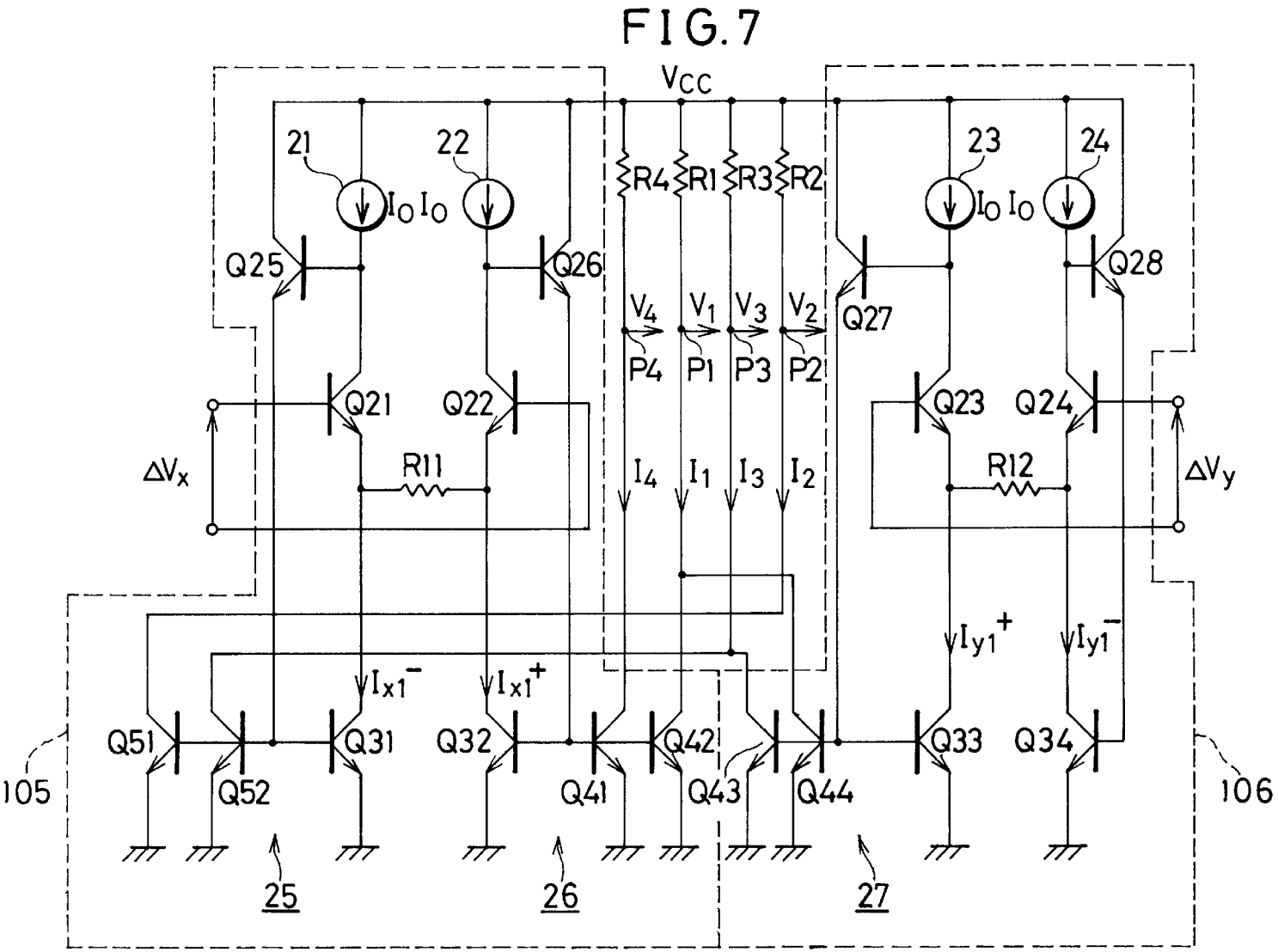
FIG. 7 is a circuit diagram showing the combination of first and second linear transconductance amplifiers, a wired current adder, and resistors serving as an I-V converter, which is used for a multiplier according to a second embodiment of the present invention, where a=½ and b=1.

FIG. 7 shows the combination of the first and second linear transconductance amplifiers 105 and 106, the wired current adder 107, and the I-V converter 109, which is used for a multiplier according to a second embodiment, where a=½ and b=1.

The multiplier according to the second embodiment has the basic configuration shown in FIG. 3, and the same configuration as those in FIGS. 4 and 5.

The circuit configuration of FIG. 7 is the same as that of FIG. 6 except for the following. Therefore, by adding the same reference characters to the corresponding elements in FIG. 7, the explanation relating to the same configuration is omitted here for the sake of simplification of description.

Since a=½ and b=1, from the equations (13a), (13b), (13c), and (13d), the four input voltages $V_1$, $V_2$, $V_3$, and $V_4$ are expressed as $$V_1=(½)\Delta V_x+\Delta V_y \tag{31a}$$

$$V_2=-(½)\Delta V_x \tag{31b}$$

$$V_3=-(½)\Delta V_x+\Delta V_y \tag{31c}$$

$$V_4=(½)\Delta V_x \tag{31d}$$

To satisfy the above relationships (31a), (31b), (31c), and (31d), the first and second linear transconductance amplifiers 105 and 106, the current adder 107, and the I-V converter 109 are configured as shown in FIG. 7.

In FIG. 7, compared with the configuration of FIG. 6, an emitter-follower-augmented current mirror circuit 25 formed by npn bipolar transistors Q51 and Q52 is additionally provided for the transistor Q31. Bases of the transistors Q51 and Q52 are connected in common to the base of the transistors Q31 and the emitter of the transistor Q25. Emitters of the transistors Q51 and Q52 are connected to the ground. A collector of the transistor Q51 is connected to the resistor R2. A collector of the transistor Q52 is connected to the resistor R3.

The collector of the transistor Q41 is connected to the resistor R4. The collector of the transistor Q42 is connected to the resistor R1. The collector of the transistor Q43 is connected to the resistor R3. The collector of the transistor Q44 is connected to the resistor R1.

To satisfy the above relationships (31a), (31b), (31c) and (31d), the constants a and b may be adjusted by setting at least one of (i) the resistance R11 of the emitter resistor R11, (ii) the resistance R12 of the emitter resistor R12, (iii) the resistance R1, R2, R3 or R4 of the resistors R1, R2, R3, and R4, and (iv) the mirror ratio (or, the emitter area ratio) of the current mirror circuits 25, 26 and 27.

THIRD EMBODIMENT

Figure 8:
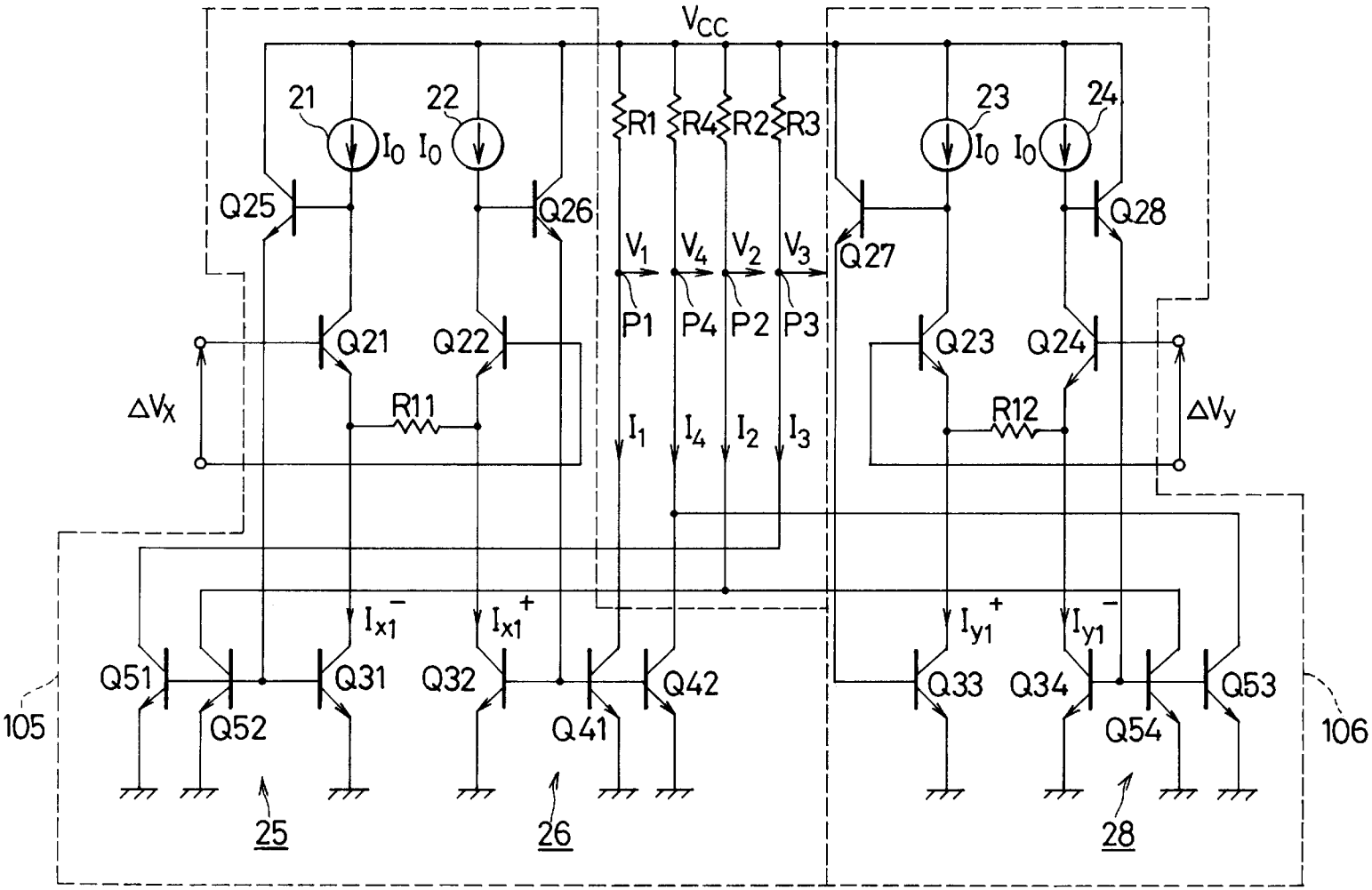
FIG. 8 is a circuit diagram showing the combination of first and second linear transconductance amplifiers, a wired current adder, and resistors serving as an I-V converter, which is used for a multiplier according to a third embodiment of the present invention, where a=½ and b=0.

FIG. 8 shows the combination of the first and second linear transconductance amplifiers 105 and 106, the wired current adder 107, and the I-V converter 109, which is used for a multiplier according to a third embodiment, where a=½ and b=0.

The multiplier according to the third embodiment has the basic configuration shown in FIG. 3, and the same configuration as those in FIGS. 4 and 5.

The circuit configuration of FIG. 8 is the same as that of FIG. 6 except for the following. Therefore, by adding the same reference characters to the corresponding elements in FIG. 8, the explanation relating to the same configuration is omitted here for the sake of simplification of description.

Since a=½ and b=0, from the equations (13a), (13b), (13c), and (13d), the four input voltages $V_1$, $V_2$, $V_3$, and $V_4$ are expressed as $$V_1=(½)\Delta V_x \tag{32a}$$

$$V_2=-(½)\Delta V_x-\Delta V_y \tag{32b}$$

$$V_3=-(½)\Delta V_x \tag{32c}$$

$$V_4=(½)\Delta V_x-\Delta V_y \tag{32d}$$

To satisfy the above relationships (32a), (32b), (32c), and (32d), the first and second linear transconductance amplifiers 105 and 106, the current adder 107, and the I-V converter 109 are configured as shown in FIG. 8.

In FIG. 8, compared with the configuration of FIG. 6, an emitter-follower-augmented current mirror circuit 25 formed by npn bipolar transistors Q51 and Q52 is additionally provided for the transistor Q31. Further, an emitter-follower-augmented current mirror circuit 28 formed by npn bipolar transistors Q53 and Q54 is additionally provided for the transistor Q34. The current mirror circuit 27 formed by the transistors Q43 and Q44 is deleted.

Bases of the transistors Q51 and Q52 are connected in common to the base of the transistors Q31 and the emitter of the transistor Q25. Emitters of the transistors Q51 and Q52 are connected to the ground. A collector of the transistor Q51 is connected to the resistor R3. A collector of the transistor Q52 is connected to the resistor R2.

Bases of the transistors Q53 and Q54 are connected in common to the base of the transistors Q34 and the emitter of the transistor Q28. Emitters of the transistors Q53 and Q54 are connected to the ground. A collector of the transistor Q53 is connected to the resistor R4. A collector of the transistor Q54 is connected to the resistor R2.

The collector of the transistor Q41 is connected to the resistor R1. The collector of the transistor Q42 is connected to the resistor R4.

To satisfy the above relationships (32a), (32b), (32c), and (32d), the constants a and b may be adjusted by setting at least one of (i) the resistance R11 of the emitter resistor R11, (ii) the resistance R12 of the emitter resistor R12, (iii) the resistance R1, R2, R3 or R4 of the resistors R1, R2, R3, and R4, and (iv) the mirror ratio (or, the emitter area ratio) of the current mirror circuits 25, 26 and 28.

FOURTH EMBODIMENT

Figure 9:
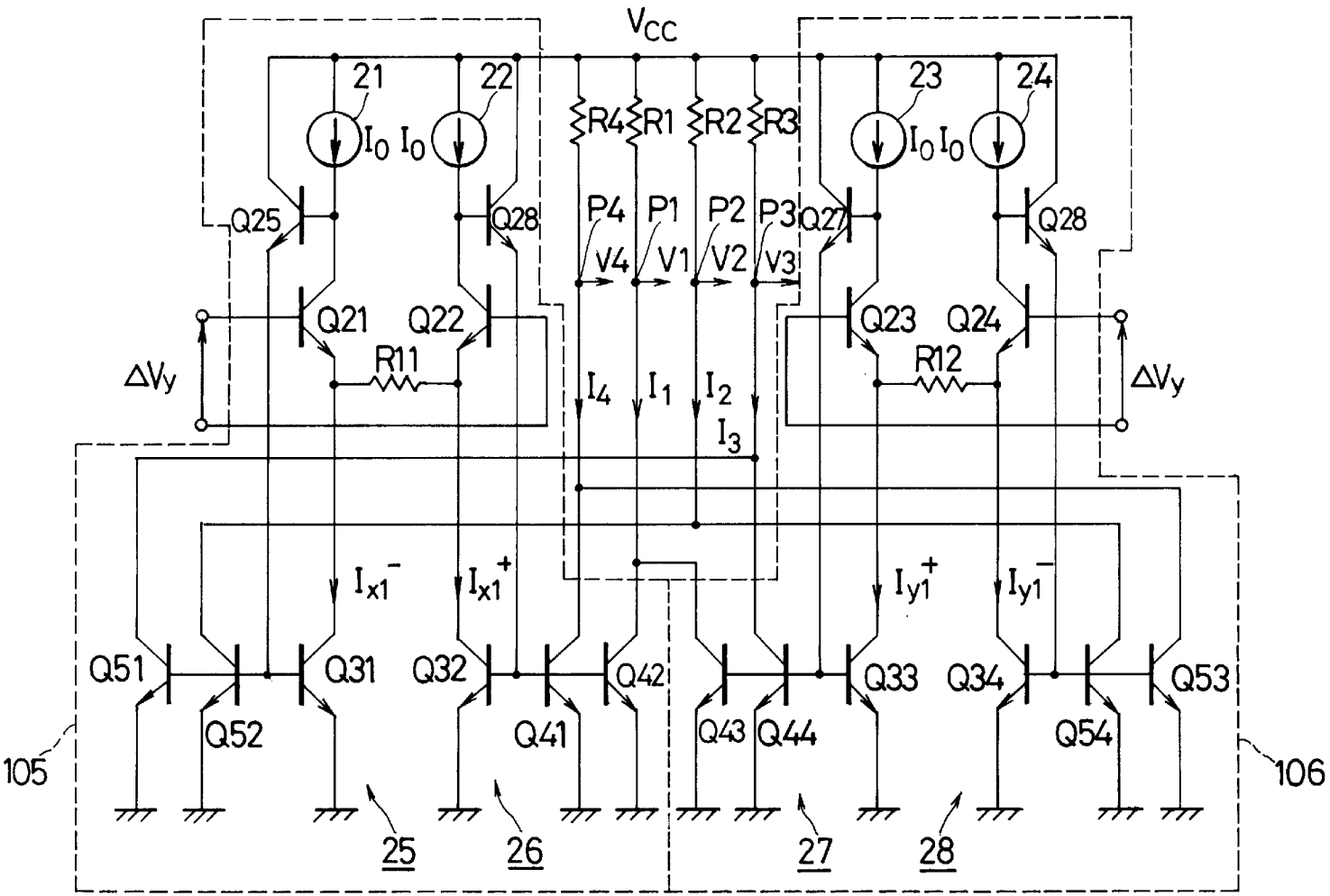
FIG. 9 is a circuit diagram showing the combination of first and second bipolar linear transconductance amplifiers, a wired current adder, and resistors serving as an I-V converter, which is used for a multiplier according to a fourth embodiment of the present invention, where a=b=½.

FIG. 9 shows the combination of the first and second linear transconductance amplifiers 105 and 106, the wired current adder 107, and the I-V converter 109, which is used for a multiplier according to a fourth embodiment, where a=b=½.

The multiplier according to the fourth embodiment has the basic configuration shown in FIG. 3, and the same configuration as those in FIGS. 4 and 5.

The circuit configuration of FIG. 9 is the same as that of FIG. 6 except for the following. Therefore, by adding the same reference characters to the corresponding elements in FIG. 9, the explanation relating to the same configuration is omitted here for the sake of simplification of description.

Since a=b=½, from the equations (13a), (13b), (13c), and (13d), the four input voltages $V_1$, $V_2$, $V_3$, and $V_4$ are expressed as $$V_1=(½)\Delta V_x+(½)\Delta V_y \quad (33a)$$

$$V_2=-(½)\Delta V_x-(½)\Delta V_y \quad (33b)$$

$$V_3=-(½)\Delta V_x+(½)\Delta V_y \quad (33c)$$

$$V_4=(½)\Delta V_x-(½)\Delta V_y \quad (33d)$$

To satisfy the above relationships (33a), (33b), (33c), and (33d), the first and second linear transconductance amplifiers 105 and 106, the current adder 107, and the I-V converter 109 are configured as shown in FIG. 9.

In FIG. 9, compared with the configuration of FIG. 6, an emitter-follower-augmented current mirror circuit 25 formed by npn bipolar transistors Q51 and Q52 is additionally provided for the transistor Q31. Further, an emitter-follower-augmented current mirror circuit 28 formed by npn bipolar transistors Q53 and Q54 is additionally provided for the transistor Q34.

Bases of the transistors Q51 and Q52 are connected in common to the base of the transistors Q31 and the emitter of the transistor Q25. Emitters of the transistors Q51 and Q52 are connected to the ground. A collector of the transistor Q51 is connected to the resistor R3. A collector of the transistor Q52 is connected to the resistor R2.

Bases of the transistors Q53 and Q54 are connected in common to the base of the transistors Q34 and the emitter of the transistor Q28. Emitters of the transistors Q53 and Q54 are connected to the ground. A collector of the transistor Q53 is connected to the resistor R4. A collector of the transistor Q54 is connected to the resistor R2.

The collector of the transistor Q41 is connected to the resistor R4. The collector of the transistor Q42 is connected to the resistor R1. The collector of the transistor Q43 is connected to the resistor R1. The collector of the transistor Q44 is connected to the resistor R3.

To satisfy the above relationships (33a), (33b), (33c), and (33d), the constants a and b may be adjusted by setting at least one of (i) the resistance R11 of the emitter resistor R11, (ii) the resistance R12 of the emitter resistor R12, (iii) the resistance R1, R2, R3 or R4 of the resistors R1, R2, R3, and R4, and (iv) the mirror ratio (or, the emitter area ratio) of the current mirror circuits 25, 26, 27, and 28.

FIFTH EMBODIMENT

Figure 10:
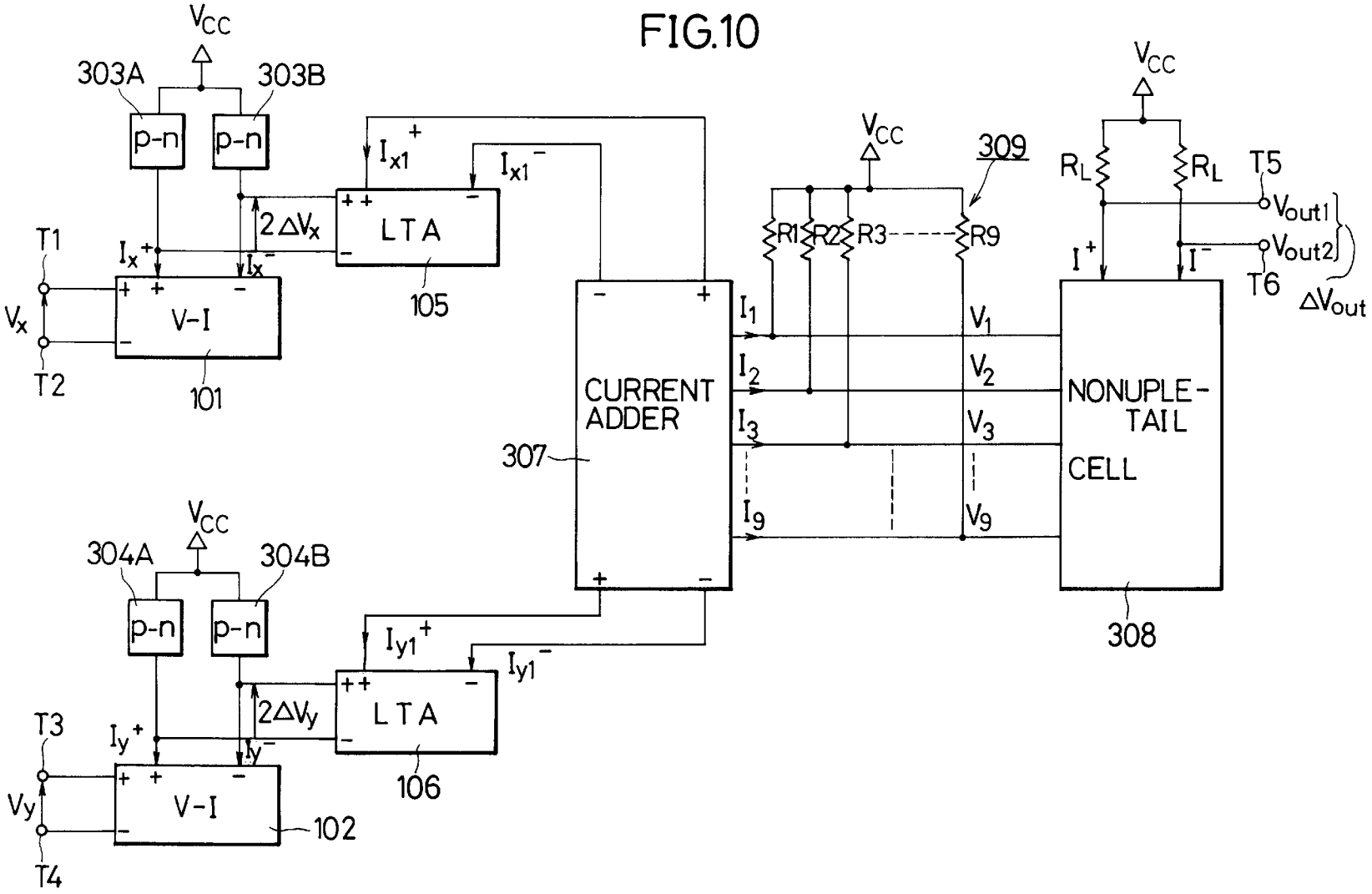
FIG. 10 is a block diagram showing a bipolar perfect four-quadrant analog multiplier according to a fifth embodiment of the present invention, where a nonuple-tail cell is used as a multiplier core circuit.

FIG. 10 shows a bipolar perfect four-quadrant analog multiplier according to a fifth embodiment, which corresponds to a multiplier obtained by replacing the quadritail cell 108 serving as the multiplier core circuit in the multiplier according to the first embodiment of FIG. 3 with a nonuple-tail cell 308.

In response to the replacement of the nonuple-tail cell 308, a first pair of p-n junction elements 303A and 303B, a second pair of p-n junction elements 304A and 304B, a current adder 307, and an I-V converter 309 are replaced, respectively. Therefore, the input circuit has the first and second linear V-I converters 101 and 102, the first pair of p-n junction elements 303A and 303B, the second pair of p-n junction elements 304A and 304B, the first and second linear transconductance amplifiers (LTAs) 105 and 106, the current adder 307, and the I-V converter 309.

Figure 11:
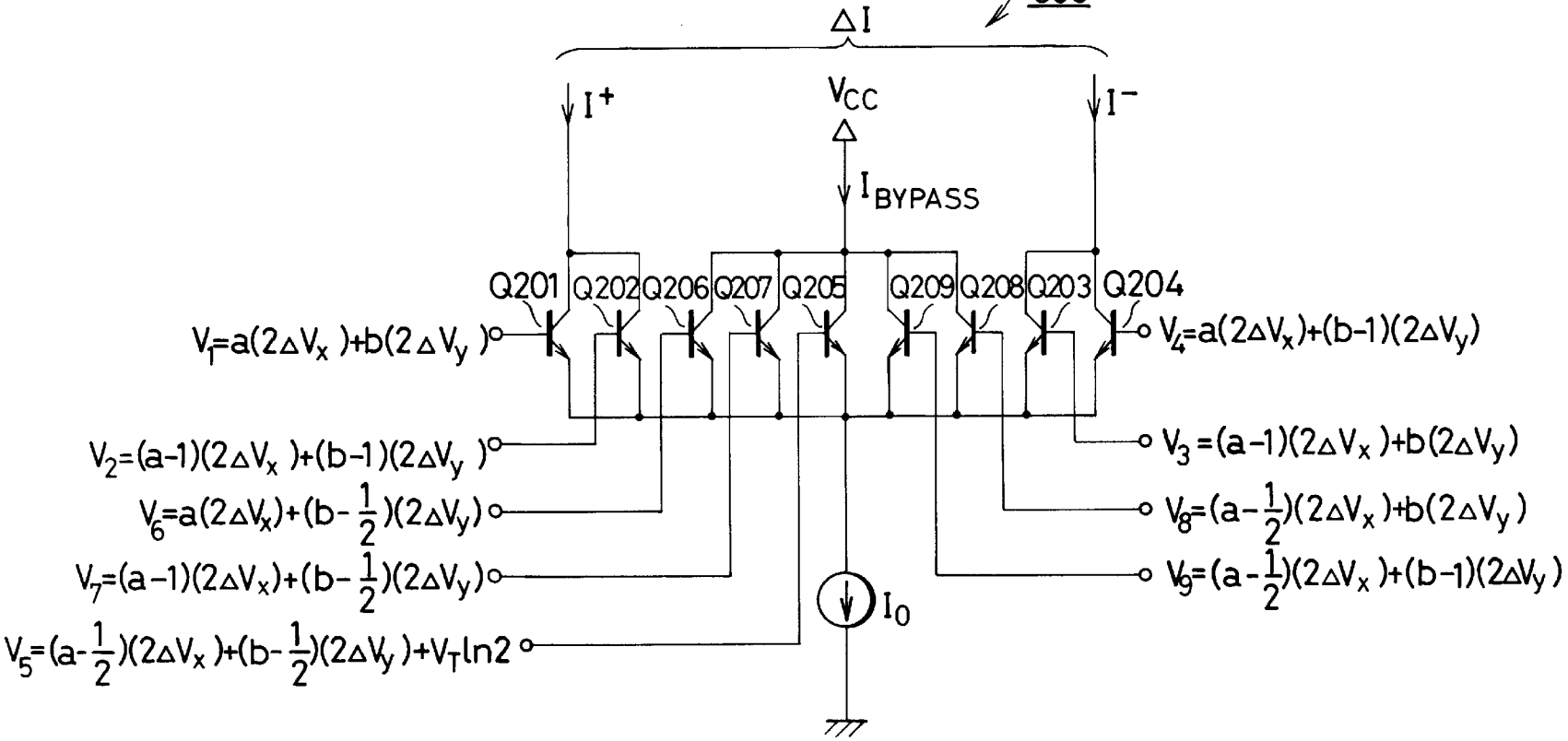
FIG. 11 is a circuit diagram of a bipolar nonuple-tail cell used for the multiplier according to the fifth embodiment of FIG. 10.

As shown in FIG. 11, the nonuple-tail cell 308 is formed by nine emitter-coupled npn bipolar transistors Q201, Q202, Q203, Q204, Q205, Q206, Q207, Q208, and Q209 driven by a single constant current sink sinking a constant current $I_0$. One end of the current sink is connected to the coupled emitters of the transistors Q201, Q202, Q203, Q204, Q205, Q206,Q207, Q208, and Q209 and the other end thereof is connected to the ground. The transistors Q201, Q202, Q203, Q204, Q205, Q206, Q207, Q208, and Q209 are the same in emitter area.

The transistors Q201 and Q202 form a differential pair, and the transistors Q203 and Q204 form another differential pair.

Collectors of the transistors Q201 and Q202 are coupled together to be connected to a power supply (supply voltage: $V_{cc}$) (not shown) through a first load resistor $R_L$ with a resistance $R_L$. The connection point of the coupled collectors of the transistors Q201 and Q202 with the first load resistor $R_L$ is connected to a first output terminal T5.

Collectors of the transistors Q203 and Q204 are coupled together to be connected to the power supply through a second load resistor $R_L$ with the same resistance $R_L$. The connection point of the coupled collectors of the transistors Q203 and Q204 with the second load resistor $R_L$ is connected to a second output terminal T6.

An output current $I^+$ is defined as a current flowing through the coupled collectors of the transistors Q201 and Q202. An output current $I^-$ is defined as a current flowing through the coupled collectors of the transistors Q203 and Q204.

A differential output current ΔI of the multiplier according to the fifth embodiment of FIG. 11, which includes the multiplication result of first and second initial input voltages $V_x$ and $V_y$, is defined as the difference of the output currents $I^+$ and $I^-$; i.e., $\Delta I=I^+-I^-$.

Here, the output currents $I^+$ and $I^-$ are converted by the corresponding load resistors $R_L$ to output voltages $V_{out1}$ and $V_{out2}$, respectively. Thus, the differential output current ΔI is converted to a differential output voltage $\Delta V_{out}$; i.e., $\Delta V_{out}=V_{out1}-V_{out2}$, which are derived from the first and second output terminals T5 and T6.

Collectors of the transistors Q205, Q206, Q207, Q208, and Q209 are coupled together to be connected to the power supply. A bypass current $I_{BYPASS}$ flows through the transistors Q205, Q206, Q207, Q208, and Q209.

Bases of the transistors Q201, Q202, Q203, Q204, Q205, Q206, Q207, Q208, and Q209 are applied with nine input voltages $V_1$, $V_2$, $V_3$, $V_4$, $V_5$, $V_6$, $V_7$, $V_8$, and $V_9$ generated by the input circuit, respectively. When the input voltages $V_1$, $V_2$, $V_3$, $V_4$, $V_5$, $V_6$, $V_7$, $V_8$, and $V_9$ are properly designed or determined, the nonuple-tail cell 308 is able to provide the multiplication operation. In other words, the cell 308 serves as a multiplier core circuit. In this case, the cell 308 has the same transfer characteristic as that of the well-known Gilbert multiplier cell of FIG. 1.

As shown in FIG. 10, the first initial input signal voltage $V_x$ is differentially applied to the first linear V-I converter 101 through the first and second input terminals T1 and T2. The first linear V-I converter 101 linearly converts the applied first initial input signal voltage $V_x$ to the pair of differential output currents $I_x^+$ and $I_x^-$. The pair of differential output currents $I_x^+$ and $I_x^-$ are proportional to the voltage $V_x$.

The first pair of p-n junction elements 303A and 303B convert the pair of differential output currents $I_x^+$ and $I_x^-$ to a differential output voltage $2\Delta V_x$ by logarithmic compression. Thus, the differential output voltage $2\Delta V_x$ is proportional to the $\tanh^{-1}$ of the first initial input voltage $V_x$. In other words, the first initial input voltage $V_x$ is $\tanh^{-1}$-converted to the differential output voltage $2\Delta V_x$.

The first linear transconductance amplifier 105 amplifies the differential output voltage $2\Delta V_x$ at a specific gain to generate the pair of differential output currents $I_{x1}^+$ and $I_x^-$. The pair of differential output currents $I_{x1}^+$ and $I_{x1}^-$ are then applied to the current adder 307.

Similarly, the second initial input signal voltage $V_y$ is differentially applied to the second linear V-I converter 102 through the third and fourth input terminals T3 and T4. The second linear V-I converter 102 linearly converts the applied second initial input signal voltage $V_y$ to a pair of differential output currents $I_y^+$ and $I_y^-$ The pair of differential output currents $I_y^+$ and $I_y^-$ are proportional to the voltage $V_y$.

The second pair of p-n junction elements 304A and 304B converts the pair of differential output currents $I_y^+$ and $I_y^-$ to a differential output voltage $2\Delta V_y$ by logarithmic compression. Thus, the differential output voltage $2\Delta V_y$ is proportional to the $\tanh^{-1}$ of the second initial inputsignal voltage $V_y$. In other words, the second initial input voltage $V_y$ is $\tanh^{-1}$-converted to the differential output voltage $2\Delta V_y$.

The second linear transconductance amplifier 106 amplifies the differential output voltage $2\Delta V_y$ at a specific gain to generate a pair of differential output currents $I_{y1}^+$ and $I_{y1}^-$. The pair of differential output currents $I_{y1}^+$ and $I_{y1}^-$ are then applied to the current adder 307.

The current adder 307 performs addition or summation of the applied pair of differential output currents $I_x^+$ and $I_x^-$ generated by the first linear transconductance amplifier 105 and the applied pair of differential output currents $I_y^+$ and $I_y^-$ generated by the second linear transconductance amplifier 106, thereby generating nine input currents $I_1$, $I_2$, $I_3$, $I_4$, $I_5$, $I_6$, $I_7$, $I_8$, and $I_9$.

The I-V converter 309 converts the applied four input currents $I_1$, $I_2$, $I_3$, $I_4$, $I_5$, $I_6$, $I_7$, $I_8$, and $I_9$ to the nine input voltages $V_1$, $V_2$, $V_3$, $V_4$, $V_5$, $V_6$, $V_7$, $V_8$, and $V_9$, respectively. Here, the I-V converter 309 are simply formed by four resistors R1, R2, R3, R4, R5, R6, R7, R8, and R9. Therefore, the input currents $I_1$, $I_2$, $I_3$, $I_4$, $I_5$, $I_6$, $I_7$, $I_8$, and $I_9$ are converted to the input voltages $V_1$, $V_2$, $V_3$, $V_4$, $V_5$, $V_6$, $V_7$, $V_8$, and $V_9$ by the corresponding resistors R1, R2, R3, R4, R5, R6, R7, R8, and R9, respectively.

These input voltages $V_1$, $V_2$, $V_3$, $V_4$, $V_5$, $V_6$, $V_7$, $V_8$, and $V_9$ are then applied to the bases of the transistors Q201, Q202, Q203, Q204, Q205, Q206, Q207, Q208, and Q209 of the nonuple-tail cell 308 serving as the multiplier core circuit, respectively.

As described above, with the bipolar analog multiplier according to the fifth embodiment of FIG. 10, the applied first initial input signal voltage $V_x$ is linearly converted to the pair of differential output currents $I_x^+$ and $I_x^-$ by the first linear V-I converter 101. Then, the pair of differential output currents $I_x^+$ and $I_x^-$ thus generated are converted to the differential output voltage $2\Delta V_x$ through the logarithmic compression by the first pair of p-n junction elements 303A and 303B.

Thus, the differential output voltage $2\Delta V_x$ is proportional to the $\tanh^{-1}$ of the first initial input signal voltage $V_x$. In other words, the initial input signal voltage $V_x$ is $\tanh^{-1}$-converted to the differential output voltage $2\Delta V_x$.

Similarly, the applied second initial input signal voltage $V_y$ is linearly converted to the pair of differential output currents $I_y^+$ and $I_y^-$ by the second linear V-I converter 102. Then, the pair of differential output currents $I_y^+$ and $I_y^-$ are converted to the differential output voltage $2\Delta V_y$ through the logarithmic compression by the second pair of p-n junction elements 304A and 304B.

Thus, the differential output voltage $2\Delta V_y$ is proportional to the $\tanh^{-1}$ of the second initial input signal voltage $V_y$. In other words, the second initial input signal voltage $V_y$ is $\tanh^{-1}$-converted to the differential output voltage $2\Delta V_y$.

Further, the differential output voltage $2\Delta V_x$ is applied to the first linear transconductance amplifier 105, thereby generating the pair of differential output currents $I_{x1}^+$ and $I_{x1}^-$ that are linearly proportional to the differential output voltage $2\Delta V_x$. Similarly, the differential output voltage $2\Delta V_y$ is applied to the second linear transconductance amplifier 106, thereby generating the pair of differential output currents $I_{y1}^+$ and $I_{y1}^-$ that are linearly proportional to the differential output voltage $2\Delta V_y$.

Using the pairs of differential output currents $I_{x1}^+$ and $I_{x1}^-$, and $I_{y1}^+$, and $I_{y1}^-$, the current adder 307 generates the nine input currents $I_1$, $I_2$, $I_3$, $I_4$, $I_5$, $I_6$, $I_7$, $I_8$, and $I_9$. The I-V converter 309 further converts the nine input currents $I_1$, $I_2$, $I_3$, $I_4$, $I_5$, $I_6$, $I_7$, $I_8$, and $I_9$ thus generated to the nine input voltages $V_1$, $V_2$, $V_3$, $V_4$, $V_5$, $V_6$, $V_7$, $V_8$, and $V_9$, respectively.

Accordingly, the bipolar analog multiplier according to the fifth embodiment of FIG. 10 is capable of perfect four-quadrant multiplication operation.

Also, since the nonuple-tail cell 308 is used as the multiplier core circuit, this bipolar analog multiplier of FIG. 10 is operable at a power supply voltage as low as approximately 1.9 V if the first and second V-I converters 101 and 102 and the first and second linear transconductance amplifiers 105 and 106 are designed to be operable at the same power supply voltage.

To make it possible to provide the multiplication operation by the nonuple-tail cell 308, the nine input voltages $V_1$, $V_2$, $V_3$, $V_4$, $V_5$, $V_6$, $V_7$, $V_8$, and $V_9$ for the cell 308 need to satisfy the following relationships (34a), (34b), (34c), (34d), (34e), (34f), (34g), (34h), and (34i), respectively.

$$V_1=a(2\Delta V_x)+b(2\Delta V_y) \tag{34a}$$

$$V_2=(a-1)(2\Delta V_x)+(b-1)(2\Delta V_x) \tag{34b}$$

$$V_3=(a-1)(2\Delta V_x)+b(2\Delta V_x) \tag{34c}$$

$$V_4=a(2\Delta V_x)+(b-1)(2\Delta V_x) \tag{34d}$$

$$V_5=(a-½)(2\Delta V_x)+(b-½)(2\Delta V_y)+V_T\bullet ln2, \tag{34e}$$

$$V_6=a(2\Delta V_x)+(b-½)(2\Delta V_x) \tag{34f}$$

$$V_7=(a-1)(2\Delta V_x)+(b-½)(2\Delta V_x) \tag{34g}$$

$$V_8=(a-½)(2\Delta V_x)+b(2\Delta V_x) \tag{34h}$$

$$V_9=(a-½)(2\Delta V_x)+(b-1)(2\Delta V_x) \quad (34i)$$

Each of the nine input voltages $V_1$, $V_2$, $V_3$, $V_4$, $V_5$, $V_6$, $V_7$, $V_8$, and $V_9$ is expressed by the sum of the two ditferential output voltages $2\Delta V_x$ and $2\Delta V_y$ generated by the first and second pairs of the p-n junction elements 303A, 303B, 304A, and 304B. It is clear from the above expressions (34a), (34b), (34c), (34d), (34e), (34f), (34g), (34h), and (34i) that the nonuple-tail cell 308 provides the multiplier operation when the current adder 307 and the I-V converter 309 operate to satisfy these expressions (34a) (34b), (34c), (34d), (34e), (34f), (34g), (34h), and (34i).

Next, the circuit configuration of the first and second V-I converters 101 and 102, and the first and second pairs of p-n junction elements 303A and 303B and 304A and 304B is explained below.

Figure 13:
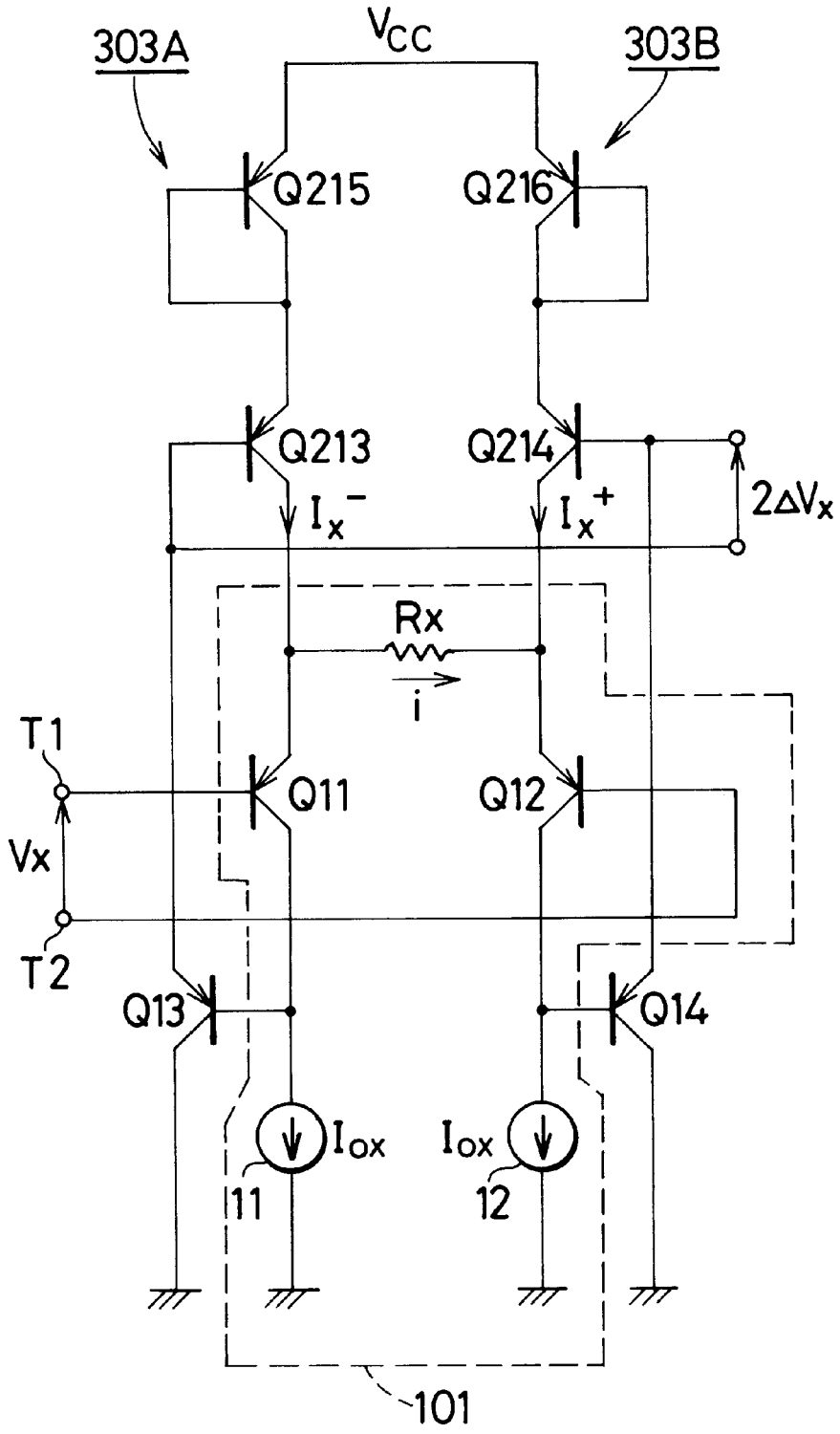
FIG. 13 is a circuit diagram of a linear V-I converter used for the multiplier according to the fifth embodiment of FIG. 10.

An example of the first V-I converter 101 and an example of the first pair of p-n junction elements 303A and 303B are shown in FIG. 13. The second V-I converter 102 and the second pair of p-n junction elements 304A and 304B are the same in configuration as those of the first V-I converter 101 and the first pair of p-n junction elements 303A and 303B, respectively.

As shown in FIG. 13, the first V-I converter 101 has the same configuration as that of FIG. 5. Therefore, for simplicity, the description relating to the converter 101 is omitted here by adding the same reference characters to the corresponding elements in FIG. 13.

In FIG. 13, instead of the transistors Q15 and Q16 in FIG. 5, pnp bipolar transistors Q213 and Q214, and diode-connected pnp bipolar transistors Q215, and Q216 are provided as the pair of p-n junction elements 303A and 303B. Since the diode-connected pnp bipolar transistors Q215 and Q216 are connected in cascode to the transistors Q213 and Q214, respectively, the obtainable differential output voltage becomes $2\Delta V_x$.

The emitter of the transistor Q11 is further connected to a collector of the transistor Q213. A base of the transistor Q213 is connected to the emitter of the transistor Q13. An emitter of the transistor Q213 is connected to the coupled collector and base of the transistor Q215. An emitter of the transistor Q215 is connected to the power supply.

The emitter of the transistor Q12 is further connected to a collector of the transistor Q214. A base of the transistor Q214 is connected to the emitter of the transistor Q14. An emitter of the transistor Q214 is connected to the coupled collector and base of the transistor Q216. An emitter of the transistor Q216 is connected to the power supply.

The combination of the transistors Q213 and Q215 corresponds to the p-n junction element 303A. The combination of the transistors Q214 and Q216 corresponds to the p-n junction element 303B.

The two current sinks 11 and 12 serve to sink the same constant currents $I_{0x}$ from the transistors Q11 and Q12 forming the differential pair, respectively.

The transistors Q213 and Q214 serve as current sources together with the corresponding emitter-follower transistors Q13 and Q14, respectively. In other words, the transistors Q213 and Q13 serve as an emitter-follower-augmented current source, and the transistors Q214 and Q14 serve as another emitter-follower-augmented current source.

The differential output voltage $2\Delta V_x$ is derived from the bases of the transistors Q213 and Q214 through the emitter-follower transistors Q13 and Q14.

With the first V-I converter 101 and the first pair of p-n junction elements 303A and 303B shown in FIG. 13, because of the same reason as that of the configuration in FIG. 5, the pair of differential output currents $I_x^+$ and $I_x^-$ have the complete-linear characteristics with respect to the input signal voltage $V_x$.

Also, the combination of the first V-I converter 101 and the first pair of p-n junction elements 303A and 303B shown in FIG. 13 has the complete-linear transfer characteristic. Therefore, it can be used as the linear transconductance amplifiers 105 and 106 if it is able to generate the pair of differential output currents $I_x^+$ and $I_x^-$ or the pair of differential output currents $I_{y1}^+$ and $I_{y1}^-$ Four examples of the circuit configuration of the linear transconductance amplifiers 105 and 106 are shown in FIGS. 14, 15, 16, and 17.

Next, the operation of the nonuple-tail cell 308 shown in FIG. 11 is explained in detail below.

Supposing that the transistors Q201, Q202, Q203, Q204, Q205, Q206, Q207, Q208, and Q209 are matched in characteristics, the collector currents $I_{c1}$, $I_{c2}$, $I_{c3}$, $I_{c4}$, $I_{c5}$, $I_{c6}$, $I_{c7}$, $I_{c8}$, and $I_{c9}$ of the transistors Q201, Q202, Q203, Q204, Q205, Q206, Q207, Q208, and Q209 are expressed as the following equations (35), (36), (37), (38), (39), (40), (41), (42), (43), respectively.

$$I_{C1} = I_S\exp\left(\frac{V_1 + V_R - V_E}{V_T}\right) \quad (35)$$

$$I_{C2} = I_S\exp\left(\frac{V_2 + V_R - V_E}{V_T}\right) \quad (36)$$

$$I_{C3} = I_S\exp\left(\frac{V_3 + V_R - V_E}{V_T}\right) \quad (37)$$

$$I_{C4} = I_S\exp\left(\frac{V_4 + V_R - V_E}{V_T}\right) \quad (38)$$

$$I_{C5} = I_S\exp\left(\frac{V_5 + V_R - V_E}{V_T}\right) \quad (39)$$

$$I_{C6} = I_S\exp\left(\frac{V_6 + V_R - V_E}{V_T}\right) \quad (40)$$

$$I_{C7} = I_S\exp\left(\frac{V_7 + V_R - V_E}{V_T}\right) \quad (41)$$

$$I_{C8} = I_S\exp\left(\frac{V_8 + V_R - V_E}{V_T}\right) \quad (42)$$

$$I_{C9} = I_S\exp\left(\frac{V_9 + V_R - V_E}{V_T}\right) \quad (43)$$

where $V_R$ is the dc component of the input voltages $V_1$, $V_2$, $V_3$, $V_4$, $V_5$, $V_6$, $V_7$, $V_8$, and $V_9$, and $V_E$ is the common emitter voltage.

On the other hand, since the transistors Q1, Q2, Q3, Q4, Q5, Q6, Q7, Q8, and Q9 are driven by the common tail current $I_0$, the following equation (44) is established.

$$I_{C1}+I_{c2}+I_{c3}+I_{c4}+I_{c5}+I_{c6}+I_{c7}+I_{c8}+I_{c9}=\alpha_F I_O \quad (44)$$

where $\alpha_F$ is the common-base current gain factor of the transistors Q1, Q2, Q3, and Q4.

By solving the equations (35), (36), (37), (38), (39), (40), (41), (42), (43), and (44), the following equation (45) is obtained as $$I_S\exp\left(\frac{V_R - V_E}{V_T}\right) = \frac{\alpha_F I_O}{\sum_{j=1}^{9}\left\{\exp\left(\frac{V_j}{V_T}\right)\right\}} \quad (45)$$

As a result, the differential output current $\Delta I$ ($=I^+-I^-$) of the multiplier according to the fifth embodiment of FIG. 10 or the nonuple-tail cell 308 is expressed as the following equation (46).

$$\Delta I = (I_{C1} + I_{C2}) - (I_{C3} + I_{C4}) \tag{46}$$

$$= \frac{\alpha_F I_O\left\{\exp\left(\frac{V_1}{V_T}\right) + \exp\left(\frac{V_2}{V_T}\right) - \exp\left(\frac{V_3}{V_T}\right) - \exp\left(\frac{V_4}{V_T}\right)\right\}}{\sum_{j=1}^{9} \exp\left(\frac{V_j}{V_T}\right)}$$

As previously stated, in the nonuple-tail cell 308 shown in FIG. 11, the nine input voltages $V_1$, $V_2$, $V_3$, $V_4$, $V_5$, $V_6$, $V_7$, $V_8$, and $V_9$ are expressed as $$V_1 = a(2\Delta V_x) + b(2\Delta V_y) \tag{34a}$$

$$V_2 = (a-1)(2\Delta V_x) + (b-1)(2\Delta V_x), \tag{34b}$$

$$V_3 = (a-1)(2\Delta V_x) + b(2\Delta V_x), \tag{34c}$$

$$V_4 = a(2\Delta V_x) + (b-1)(2\Delta V_x), \tag{34d}$$

$$V_5 = (a-½)(2\Delta V_x) + (b-½)(2\Delta V_y) + V_T \cdot ln2, \tag{34e}$$

$$V_6 = a(2\Delta V_x) + (b-½)(2\Delta V_x), \tag{34f}$$

$$V_7 = (a-1)(2\Delta V_x) + (b-½)(2\Delta V_x), \tag{34g}$$

$$V_8 = (a-½)(2\Delta V_x) + b(2\Delta V_x), \tag{34h}$$

and $$V_9 = (a-½)(2\Delta V_x) + (b-1)(2\Delta V_x), \tag{34i}$$

By substituting the equations (34a), (34b), (34c), (34d), (34e), (34f), (34g), (34h), and (34i) into the equation (46), the differential output current ΔI of the multiplier of FIG. 10 or nonuple-tail cell 308 is rewritten to the following equation (47).

$$\Delta I = \frac{\alpha_F I_O \cdot \sinh\left(\frac{\Delta V_x}{V_T}\right) \cdot \sinh\left(\frac{\Delta V_y}{V_T}\right)}{\left\{\cosh\left(\frac{\Delta V_x}{V_T}\right) + 1\right\} \cdot \left\{\cosh\left(\frac{\Delta V_y}{V_T}\right) + 1\right\}} \tag{47}$$

The obtainable value of $\alpha_F$ is typically 0.98 to 0.99 for the popular bipolar processes, and it is approximately equal to unity. Therefore, the coefficient of $\alpha_F$ can be ignored in the equation (47).

However, in the multiplier according to the fifth embodiment of FIG. 10, the perfect-linear multiplication operation can be realized with the use of the equation (47), because the term of {(sinh z)/(cosh z+1)} can be accorded to the transfer characteristic of the triple-tail cell.

The reason is as follows.

The pair of differential output currents $I_x^+$ and $I_x^-$ of the first V-I converter 101 in FIG. 13 are given by the following expressions (48a) and (48b)

$$I_x^+ = I_{0x} + \frac{V_x}{R_x} = I_S \exp\left(\frac{V_{BE215}}{V_T}\right) \tag{48a}$$

$$I_x^- = I_{0x} - \frac{V_x}{R_x} = I_S \exp\left(\frac{V_{BE216}}{V_T}\right) \tag{48b}$$

where $V_{BE215}$ and $V_{BE216}$ are the base-to-emitter voltages of the transistors Q215 and Q216, respectively.

Therefore, the differential output voltage $\Delta V_x$ of the first pair of p-n junction element 303A and 303B is expressed as the following equation (49).

$$\Delta V_x = V_{BE216} - V_{BE215} = V_T \cdot \ln\left(\frac{I_{0x} + \frac{V_x}{R_x}}{I_{0x} - \frac{V_x}{R_x}}\right) \tag{49}$$

Similarly, the differential output voltage $\Delta V_y$ of the second pair of p-n junction element 304A and 304B is expressed as the following equation (50)

$$\Delta V_y = V_T \cdot \ln\left(\frac{I_{0y} + \frac{V_y}{R_y}}{I_{0y} - \frac{V_y}{R_y}}\right) \tag{50}$$

where $I_{0y}$ is the driving current for the corresponding transistors (not shown) to the transistors Q11 and Q12 in FIG. 13, and $R_y$ is the resistance of the corresponding emitter resistor to the resistor $R_x$.

By substituting the equations (49) and (50) into the above equation (47), the following equation (51) is obtained.

$$\Delta I = \frac{\alpha_F I_0 \cdot \sinh\left\{\ln\left(\frac{I_{0x} + \frac{V_x}{R_x}}{I_{0x} - \frac{V_x}{R_x}}\right)\right\} \cdot \sinh\left\{\ln\left(\frac{I_{0y} + \frac{V_y}{R_y}}{I_{0y} - \frac{V_y}{R_y}}\right)\right\}}{\cosh\left\{\ln\left(\frac{I_{0x} + \frac{V_x}{R_x}}{I_{0x} - \frac{V_x}{R_x}}\right) + 1\right\} \cdot \cosh\left\{\ln\left(\frac{I_{0y} + \frac{V_y}{R_y}}{I_{0y} - \frac{V_y}{R_y}}\right) + 1\right\}} \tag{51}$$

$$= \alpha_F I_0 V_x \frac{V_y}{I_{0x} I_{0y} R_x R_y}$$

The equation (51) is obtained by using the following identity (52).

$$z = \frac{\sinh\left\{\ln\left(\frac{1+z}{1-z}\right)\right\}}{\cosh\left\{\ln\left(\frac{1+z}{1-z}\right)\right\} + 1} \qquad z = \frac{V_x}{I_{0x} R_x}, \text{ or } \frac{V_y}{I_{0y} R_y} \tag{52}$$

It is seen from the expression (51) that the multiplier according to the fifth embodiment of FIG. 10 is capable of the perfect four-quadrant multiplier operation.

As seen from the above explanation about the operation principle, the constants or coefficients a and b of the nine input voltages $V_1$, $V_2$, $V_3$, $V_4$, $V_5$, $V_6$, $V_7$, $V_8$, and $V_9$ shown in the equations (34a), (34b), (34c), (34d), (34e), (34f), (34g), (34h), and (34i) may be theoretically optional.

However, practically, the constants a and b are not able to be freely determined in the first and second linear transconductance amplifiers 105 and 106. The constants a and b need to be suitably designed at specific values in order to realize the bipolar complete four-quadrant analog multiplier.

Figure 14:
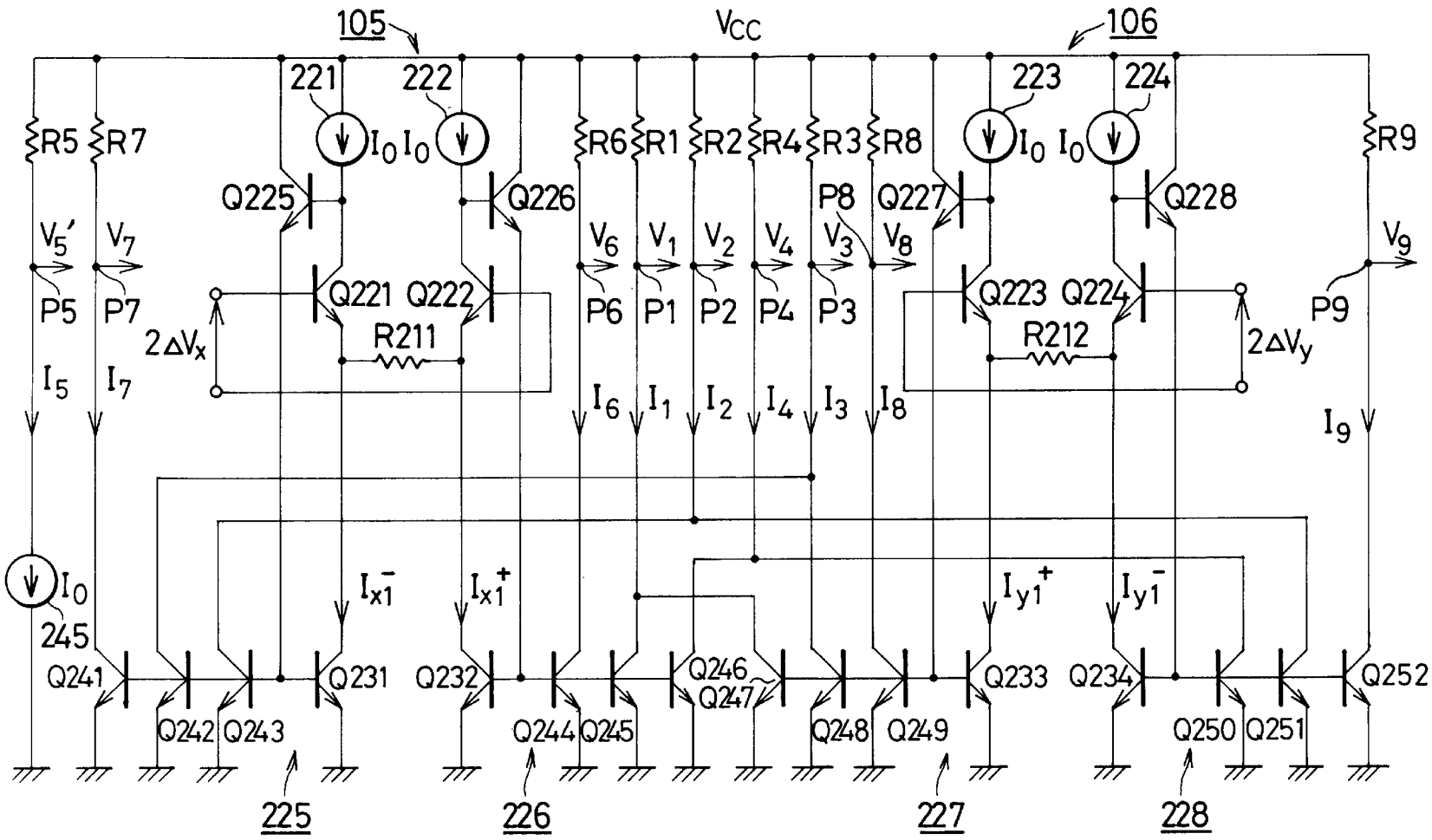
FIG. 14 is a circuit diagram showing the combination of first and second bipolar linear transconductance amplifiers, a wired current adder, and resistors serving as an I-V converter, which is used for the multiplier according to the fifth embodiment of FIG. 10, where a=b=½.

FIG. 14 shows the combination of first and second linear transconductance amplifiers 105 and 106, the current adder 307, and the I-V converter 309, which is used for the multiplier according to the fifth embodiment of FIG. 10, where a=b=½.

Since a=b=½, from the equations (34a), (34b), (34c), (34d), (34e), (34f), (34g), (34h), and (34i), the nine input voltages $V_1$, $V_2$, $V_3$, $V_4$, $V_5$, $V_6$, $V_7$, $V_8$, and $V_9$ are expressed as $$V_1=\Delta V_x+\Delta V_y \tag{53a}$$

$$V_2=-\Delta V_x-\Delta V_y \tag{53b}$$

$$V_3=-\Delta V_x+\Delta V_y \tag{53c}$$

$$V_4=\Delta V_x-\Delta V_y \tag{53d}$$

$$V_5=V_T \cdot ln2 \tag{53e}$$

$$V_6=\Delta V_x \tag{53f}$$

$$V_7=-\Delta V_x \tag{53g}$$

$$V_8=\Delta V_y \tag{53h}$$

$$V_9=-\Delta V_x \tag{53i}$$

Therefore, the first and second linear transconductance amplifiers 105 and 106, the current adder 307, and the I-V converter 309 are designed to satisfy the above relationships (53a), (53b), (53c), (53d), (53e), (53f), (53g), (53h), and (53i)

The first linear transconductance amplifier 105 in FIG. 14 has the following configuration.

As shown in FIG. 14, the first linear transconductance amplifier 105 includes a balanced differential pair of npn bipolar transistors Q221 and Q222 whose emitter areas are equal to each other. Emitters of the transistors Q221 and Q222 are coupled together through an emitter resistor R211 having a resistance R211.

A collector of the transistor Q221 is connected to the power supply through a constant current source 221 supplying a constant current $I_0$. A collector of the transistor Q222 is connected to the power supply through a constant current source 222 supplying the same constant current $I_0$.

The differential output voltage $2\Delta V_x$ is applied across bases of the transistors Q221 and Q222.

The emitter of the transistor Q221 is further connected to a collector of an npn bipolar transistor Q231. The emitter of the transistor Q222 is further connected to a collector of an npn bipolar transistor Q232. Emitters of the transistors Q231 and Q232 are connected to the ground.

A base of the transistor Q231 is connected to an emitter of an npn bipolar transistor Q225. A base of the transistor Q225 is connected to the collector of the transistor Q221. A collector of the transistor Q225 is connected to the power supply. A base of the transistor Q232 is connected to an emitter of a pnp bipolar transistor Q226. A base of the transistor Q226 is connected to the collector of the transistor Q222. Acollector of the transistor Q226 is connected to the power supply.

The two current sources 221 and 222 serve to supply the same constant currents $I_0$ to the transistors Q221 and Q222 forming the differential pair, respectively.

The transistors Q231 and Q232 serve as current sources together with the corresponding emitter-follower transistors Q225 and Q226, respectively. In other words, the transistors Q231 and Q225 serves as an emitter-follower-augmented current source, and the transistors Q232 and Q226 serves as another emitter-follower-augmented current source. The pair of differential output currents $I_{x1}^+$ and $I_{x1}^-$ are derived from the bases of the transistors Q232 and Q231, respectively.

In the linear transconductance amplifier 105 in FIG. 14, npn bipolar transistors Q241, Q242, and Q243 are additionally provided to the transistor Q231, thereby forming an emitter-follower-augmented current mirror circuit 225. The output current $I_{x1}^-$ is derived through the current mirror circuit 225. Therefore, the same currents $I_{x1}^-$ flow through the transistors Q241, Q242 and Q243.

Emitters of the transistors Q241, Q242, and Q243 are connected to the ground. A collector of the transistor Q241 is connected to the power supply through a resistor R7 with a resistance R7. A collector of the transistor Q242 is connected to the power supply through a resistor R3 with a resistance R3. A collector of the transistor Q243 is connected to the power supply through a resistor R2 with a resistance R2.

Further, npnbipolar transistors Q244, Q245, and Q246 are additionally provided to the transistor Q232, thereby forming an emitter-follower-augmented current mirror circuit 226. The output current $I_{x1}^+$ is derived through the current mirror circuit 226. Therefore, the same currents $I_{x1}^+$ flow through the transistors Q244, Q245 and Q246.

Emitters of the transistors Q244, Q245, and Q246 are connected to the ground. A collector of the transistor Q244 is connected to the power supply through a resistor R6 with a resistance R6. A collector of the transistor Q245 is connected to the power supply through a resistor R1 with a resistance R1 A collector of the transistor Q246 is connected to the power supply through a resistor R4 with a resistance R4.

Similarly, the second linear transconductance amplifier 106 includes. a balanced differential pair of npn bipolar transistors Q223 and Q224 whose emitter areas are equal to each other. Emitters of the transistors Q223 and Q224 are coupled together through an emitter resistor R212 having a resistance R212.

A collector of the transistor Q223 is connected to the power supply through a constant current source 223 supplying a constant current $I_0$. The transistor Q223 is driven by the constant current $I_0$. A collector of the transistor Q224 is connected to the power supply through a constant current source 224 supplying the same constant current $I_0$. The transistor Q224 is driven by the constant current $I_0$.

The differential output voltage $2\Delta V_y$ is applied across bases of the transistors Q223 and Q224.

The emitter of the transistor Q223 is further connected to a collector of an npn bipolar transistor Q233. The emitter of the transistor Q224 is further connected to a collector of an npn bipolar transistor Q234. Emitters of the transistors Q233 and Q234 are connected to the ground.

A base of the transistor Q233 is connected to an emitter of an npn bipolar transistor Q227. A base of the transistor Q227 is connected to the collector of the transistor Q223. A collector of the transistor Q227 is connected to the power supply. A base of the transistor Q234 is connected to an emitter of a pnp bipolar transistor Q228. A base of the transistor Q228 is connected to the collector of the transistor Q224. Acollector of the transistor Q228 is connected to the power supply.

The two current sources 223 and 224 serve to supply the same constant currents $I_0$ to the transistors Q223 and Q224 forming the differential pair, respectively.

The transistors Q233 and Q234 serve as current sources together with the corresponding emitter-follower transistors Q227 and Q228, respectively. In other words, the transistors Q233 and Q227 serves as an emitter-follower-augmented current source, and the transistors Q234 and Q222 serves as another emitter-follower-augmented current source. The pair of differential output currents $I_{y1}^+$ and $I_{y1}^-$ are derived from the bases of the transistors Q233 and Q234.

In the linear transconductance amplifier 106 in FIG. 14, npn bipolar transistors Q247, Q248, and Q249 are additionally provided to the transistor Q233, thereby forming an emitter-follower-augmented current mirror circuit 227. The output current $I_{y1}^{+}$ is derived through the current mirror circuit 227. Therefore, the same currents $I_{y1}^{+}$ flow through the transistors Q247, Q248, and Q249.

Emitters of thne transistors Q247, Q248, and Q249 are connected to the ground. A collector of the transistor Q247 is connected to the power supply through the resistor R1. A collector of the transistor Q248 is connected to the power supply through the resistor R3. A collector of the transistor Q249 is connected to the power supply through a resistor R8 with a resistance R8.

Further, npn bipolar transistors Q250, Q251, and Q252 are additionally provided to the transistor Q234, thereby forming an emitter-follower-augmented current mirror circuit 228. The output current $I_{y1}^{-}$ is derived through the current mirror circuit 228. Therefore, the same currents $I_{y1}^{-}$ flow through the transistors Q250, Q251 and Q252.

Emitters of the transistors Q250, Q251, and Q252 are connected to the ground. A collector of the transistor Q250 is connected to the power supply through the resistor R4. A collector of the transistor Q251 is connected to the power supply through the resistor R2. A collector of the transistor Q252 is connected to the power supply through a resistor R9 with a resistance R9.

The input current $I_1$ flows through the resistor R1, thereby generating the input voltage $V_1$ The input voltage $V_1$ is derived from the connection point P1 of the collector of the transistor Q245 and the resistor R1.

The input current $I_2$ flows through the resistor R2, thereby generating the input voltage $V_2$. The input voltage $V_2$ is derived from the connection point P2 of the coupled collectors of the transistor Q243 and Q251 and the resistor R2.

The input current $I_3$ flows through the resistor R3, thereby generating the input voltage $V_3$. The input voltage $V_3$ is derived from the connection point P3 of the coupled collectors of the transistors Q242 and Q248 and the resistor R3.

The input current $I_4$ flows through the resistor R4, thereby generating the input voltage $V_4$. The input voltage $V_4$ is derived from the connection point P4 of the coupled collectors of the transistors Q246 and Q250 and the resistor R4.

The input current $I_6$ flows through the resistor R6, thereby generating the input voltage $V_6$. The input voltage $V_6$ is derived from the connection point P6 of the collector of the transistor Q244 and the resistor R6.

The input current $I_7$ flows through the resistor R7, thereby generating the input voltage $V_7$. The input voltage $V_7$ is derived from the connection point P7 of the collector of the transistor Q241 and the resistor R7.

The input current $I_8$ flows through the resistor R8, thereby generating the input voltage $V_8$. The input voltage $V_8$ is derived from the connection point P8 of the collector of the transistor Q249 and the resistor R8.

The input current $I_9$ flows through the resistor R9, thereby generating the input voltage $V_9$. The input voltage $V_9$ is derived from the connection point P9 of the collector of the transistor Q252 and the resistor R9.

In this case, the input voltage $V_5$ is constant; i.e., $V_5=V_T \cdot \ln 2$. Therefore, a constant current sink 245 sinking a constant current $I_0$ and a resistor R5 with a resistance R5 are additionally provided. One end of the current sink 245 is connected to the power supply through the resistor R5, and the other end thereof is connected to the ground.

The input current $I_5$, which is a constant current, flows through the resistor R5, thereby generating a constant dc bias voltage $V_5'$ at the connection point P5 of the current sink 245 and the resistor R5. Only the constant dc bias voltage $V_5'$ is applied to the base of the transistor Q5 in the nonuple-tail cell 308.

The current adder 307 in FIG. 14 is formed by wiring of the transistors Q241, Q242, Q243, Q244, Q245, Q246, Q247, Q248, Q249, Q250, Q251, and Q252, and the resistors R1, R2, R3, R4, R5, R6, R7, R8, and R9. In other words, the current adder 307 is a wired configuration.

Each of the first and second linear transconductance amplifiers 105 and 106 has substantially the same configuration as that of the combination of the first V-I converter 101 and the first pair of p-n junction elements 103A and 103B shown in FIG. 5. Therefore, the complete-linear operation can be provided.

To satisfy the above relationships (54a), (54b), (54c), (54d), (54e), (54f), (54g), (54h), and (54i), the constants a and b may be adjusted by setting at least one of (i) the resistance R211 of the emitter resistor R211, (ii) the resistance R212 of the emitter resistor R212, (iii) the resistance R1, R2, R3, R4, R5, R6, R7, R8, and R9 of the resistors R1, R2, R3, R4, R5, R6, R7, R8, and R9, and (iv) the mirror ratio (or, the emitter area ratio) of the current mirror circuits 225, 226, 227, and 228.

Figure 12:
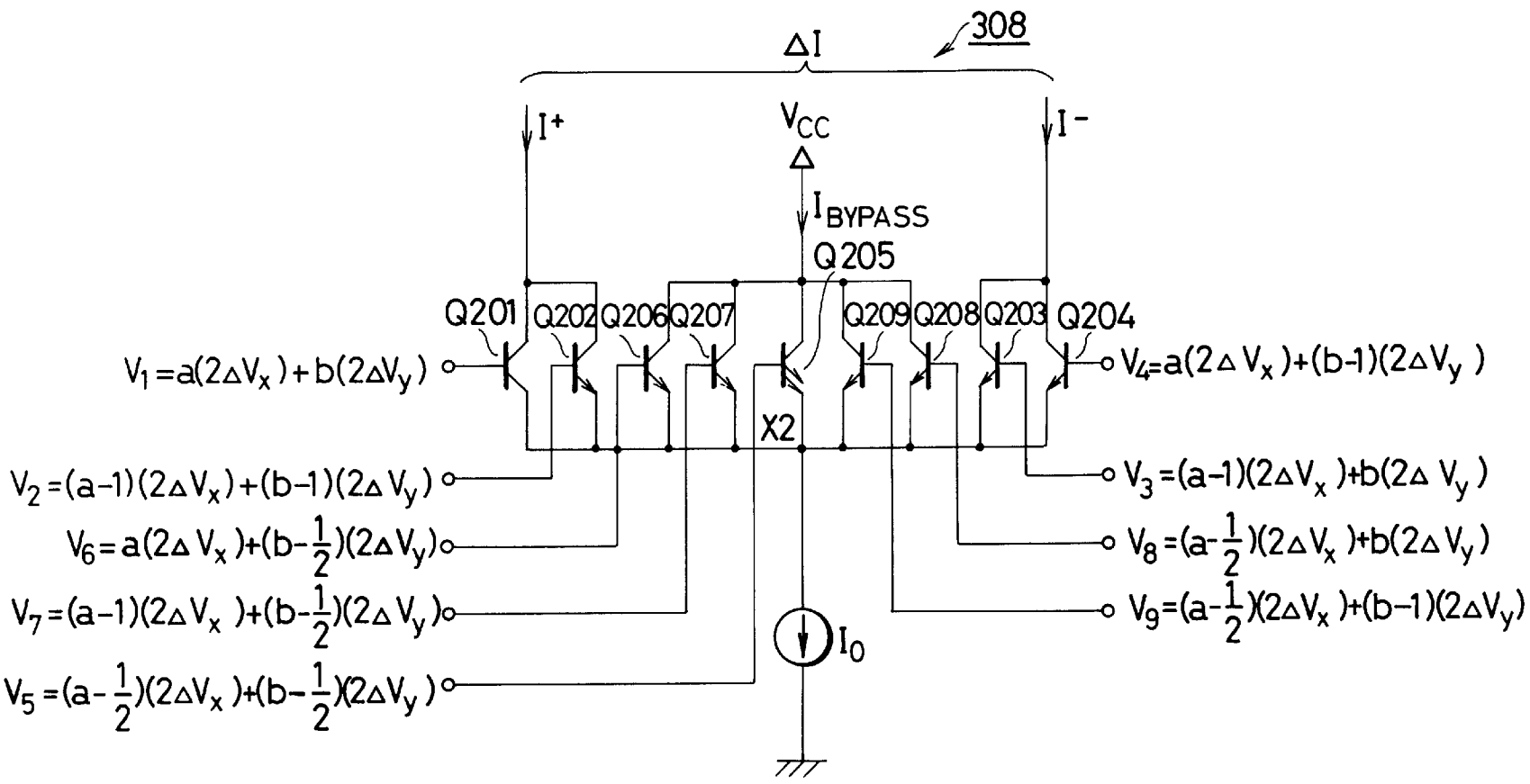
FIG. 12 is a circuit diagram of another bipolar nonuple-tail cell used for the multiplier according to the fifth embodiment of FIG. 10.

Additionally, in the multiplier according to the fifth embodiment of FIG. 10, the input voltage $V_5$ is constant; i.e., $V_5=V_T \cdot \ln 2$. The resistor R5 and the constant current sink 245 can be omitted if the emitter area of the transistor Q205 is set to be twice as large as that of the remaining transistors Q201, Q202, Q203, Q204, Q206, Q207, Q208, and Q209, as shown in FIG. 12.

SIXTH EMBODIMENT

Figure 15:
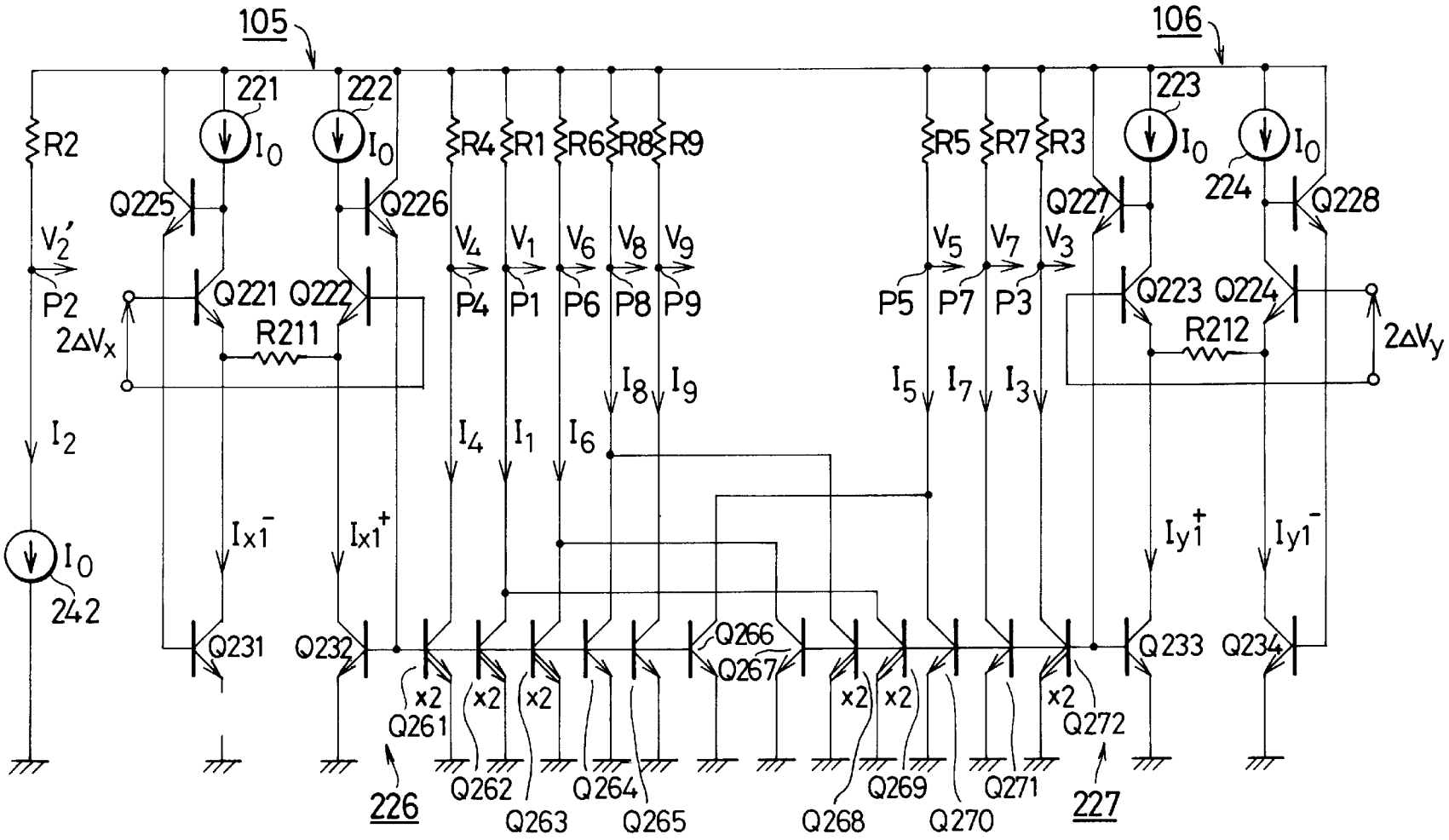
FIG. 15 is a circuit diagram showing the combination of first and second bipolar linear transconductance amplifiers, a wired current adder, and resistors serving as an I-V converter, which is used for a multiplier according to a sixth embodiment of the present invention, where a=b=1.

FIG. 15 shows the combination of the first and second linear transconductance amplifiers 105 and 106, the wired current adder 307, andthe I-V converter 309, which is used for a multiplier according to a sixth embodiment, where a=b=1.

The multiplier according to the sixth embodiment has the basic configuration shown in FIG. 10, and the same configuration as those in FIGS. 11 and 13.

The circuit configuration of FIG. 15 is the same as that of FIG. 14 except for the following. Therefore, by adding the same reference characters to the corresponding elements in FIG. 15, the explanation relating to the same configuration is omitted here for the sake of simplification of description.

Since a=b=1, from the equations (34a), (34b), (34c), (34d), (34e), (34f), (34g), (34h), and (34i), the nine input voltages $V_1$, $V_2$, $V_3$, $V_4$, $V_5$, $V_6$, $V_7$, $V_8$, and $V_9$ are expressed as $$V_1=2\Delta V_x+2\Delta V_y \tag{54a}$$

$$V_2=0 \tag{54b}$$

$$V_3=2\Delta V_y \tag{54c}$$

$$V_4=2\Delta V_x \tag{54d}$$

$$V_5=\Delta V_x+\Delta V_y+V_T \cdot ln2 \tag{54e}$$

$$V_6=2\Delta V_x+\Delta V_y \tag{54f}$$

$$V_7=\Delta V_y \tag{54g}$$

$$V_8=\Delta V_x+2\Delta V_y \tag{54h}$$

$$V_9=\Delta V_x \tag{54i}$$

Therefore, the first and second linear transconductance amplifiers 105 and 106, the current adder 307, and the I-V converter 309 are designed to satisfy the above relationships (54a), (54b), (54c), (54d), (54e), (54f), (54g), (54h), and (54i)

To satisfy the above relationships (54a), (54b), (54c), (54d), (54e), (54f), (54g), (54h), and (54i), the first and second linear transconductance amplifiers 105 and 106, the current adder 307, and the I-V converter 309 are configured as shown in FIG. 15.

In FIG. 15, compared with the configuration of FIG. 14, the emitter-follower-augmented current mirror circuit 225 formed by the transistors Q241, Q242, and Q243 and the emitter-follower-augmented current mirror circuit 228 formed by the transistors Q250, 0251, and Q252 are deleted. Further, the emitter-follower-augmented current mirror circuit 226 is formed by six npn bipolar transistors Q261, Q262, Q263, Q264, Q265, and Q266, and the emitter-follower-augmented current mirror circuit 227 is formed by six npn bipolar transistors Q267, Q268, Q269, Q270, Q271, and Q272.

The transistors Q261, Q262, Q263, Q268, Q269, and Q272 are twice in emitter area as large as that of the remaining transistors Q264, Q265, Q266, Q267, Q270, and Q271.

Bases of the transistors Q261, Q262, Q263, Q264, Q265, and Q266 are connected in common to the base of the transistors Q232 and the emitter or the transistor Q226. Emitters of the transistors Q261, Q262, Q263, Q264, Q265, and Q266 are connected to the ground.

A collector of the transistor Q261 is connected to the resistor R4. A collector of the transistor Q262 is connected to the resistor R1. A collector of the transistor Q263 is connected to the resistor R6. A collector of the transistor Q264 is connected to the resistor R8. A collector of the transistor Q265 is connected to the resistor R9. A collector of the transistor Q266 is connected to the resistor R5.

Bases of the transistors Q267, Q268, Q269, Q270, Q271, and Q272 are connected in common to the base of the transistors Q233 and the emitter of the transistor Q227. Emitters of the transistors Q267, Q268, Q269, Q270, Q271, and Q272 are connected to the ground.

A collector of the transistor Q267 is connected to the resistor R6. A collector of the transistor Q268 is connected to the resistor R8. A collector of the transistor Q269 is connected to the resistor R1. A collector of the transistor Q270 is connected to the resistor R5. A collector of the transistor Q271 is connected to the resistor R7. A collector of the transistor Q272 is connected to the resistor R3.

In this case, the input voltage $V_2$ is zero; i.e., $V_2=0$. Therefore, a constant current sink 242 sinking a constant current $I_O$ and a resistor R2 with a resistance R2 are additionally provided. One end of the current sink 242 is connected to the power supply through the resistor R2, and the other end thereof is connected to the ground.

The input current $I_2$, which is a constant current, flows through the resistor R2, thereby generating a constant dc bias voltage $V_2'$ at the connection point P2 of the current sink 242 and the resistor R2. Only the constant dc bias voltage $V_2'$ is applied to the base of the transistor Q2 in the nonuple-tail cell 308.

To satisfy the above relationships (54a), (54b), (54c), (54d), (54e), (54f), (54g), (54h), and (54i), the constants a and b may be adjusted by setting at least one of (i) the resistance R211 of the emitter resistor R211, (ii) the resistance R212 of the emitter resistor R212, (iii) the resistance R1, R2, R3, R4, R5, R6, R7, R8, and R9 of the resistors R1, R2, R3, R4, R5, R6, R7, R8, and R9, and (iv) the mirror ratio (or, the emitter area ratio) of the current mirror circuits 226 and 227.

Additionally, in the multiplier according to the sixth embodiment of FIG. 15, the term of $V_T \cdot \ln 2$ in the equation (54e) can be deleted if the emitter area of the transistor Q205 is set to be twice as large as that of the remaining transistors Q201, Q202, Q203, Q204, Q206, Q207, Q208, and Q209, as shown in FIG. 12.

SEVENTH EMBODIMENT

Figure 16:
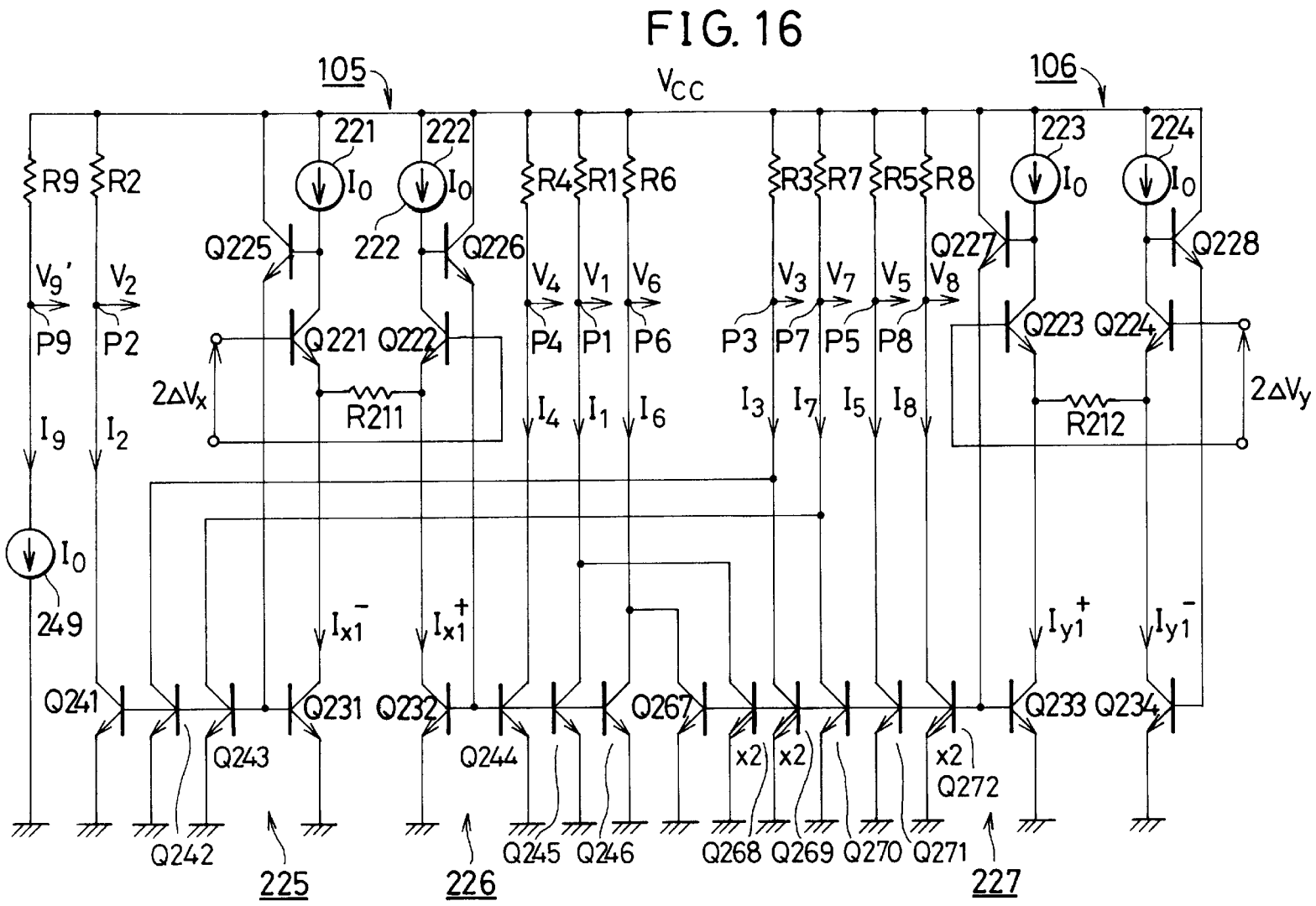
FIG. 16 is a circuit diagram showing the combination of first and second bipolar linear transconductance amplifiers, a wired current adder, and resistors serving as an I-V converter, which is used for a multiplier according to a seventh embodiment of the present invention, where a=½ and b=1.

FIG. 16 shows the combination of the first and second linear transconductance amplifiers 105 and 106, the wired current adder 307, and the I-V converter 309, which is used for a multiplier according to a seventh embodiment, where a=½ and b=1.

The multiplier according to the seventh embodiment has the basic configuration shown in FIG. 10, and the same configuration as those in FIGS. 11 and 13.

The circuit configuration of FIG. 16 is the same as that of FIG. 14 except for the following. Therefore, by adding the same reference characters to the corresponding elements in FIG. 16, the explanation relating to the same configuration is omitted here for the sake of simplification of description.

Since a=½ and b=1, from the equations (34a), (34b), (34c), (34d), (34e), (34f), (34g), (34h), and (34i), the nine input voltages $V_1$, $V_2$, $V_3$, $V_4$, $V_5$, $V_6$, $V_7$, $V_8$, and $V_9$ are expressed as $$V_1=\Delta V_x+2\Delta V_y \tag{55a}$$

$$V_2=-\Delta V_x \tag{55b}$$

$$V_3=-\Delta V_x+2\Delta V_y \tag{55c}$$

$$V_4=\Delta V_x \tag{55d}$$

$$V_5=\Delta V_y+V_T \cdot ln2 \tag{55e}$$

$$V_6=\Delta V_x+\Delta V_y \tag{55f}$$

$$V_7=-\Delta V_x+\Delta V_y \tag{55g}$$

$$V_8=2\Delta V_y \tag{55h}$$

$$V_9=0 \tag{55i}$$

Therefore, the first and second linear transconductance amplifiers 105 and 106, the current adder 307, and the I-V converter 309 are designed to satisfy the above relationships (55a), (55b), (55c), (55d), (55e), (55f), (55g), (55h), and (55i)

To satisfy the above relationships (55a), (55b), (55c), (55d), (55e), (55f), (55g), (55h), and (55i), the first and second linear transconductance amplifiers 105 and 106, the current adder 307, and the I-V converter 309 are configured as shown in FIG. 16.

In FIG. 16, compared with the configuration of FIG. 14, the emitter-follower-augmented current mirror circuit 226 formed by the transistors Q250, Q251, and Q252 is omitted. The emitter-follower-augmented current mirror circuits 225 and 226 are the same as those of the fifth embodiment of FIG. 14. Further, the emitter-follower-augmented current mirror circuit 227 is the same as that of the sixth embodiment of FIG. 15.

The collector of the transistor Q241 is connected to the resistor R2. The collector of the transistor Q242 is connected to the resistor R3. The collector of the transistor Q243 is connected to the resistor R7. The collector of the transistor Q244 is connected to the resistor R4. The collector of the transistor Q245 is connected to the resistor R1. The collector of the transistor Q246 is connected to the resistor R6. The collector of the transistor Q267 is connected to the resistor R6. The collector of the transistor Q268 is connected to the resistor R1. The collector of the transistor Q269 is connected to the resistor R3. The collector of the transistor Q270 is connected to the resistor R7. The collector of the transistor Q271 is connected to the resistor R5. The collector of the transistor Q272 is connected to the resistor R8.

In this case, the input voltage V9 is zero; i.e., $V_9=0$. Therefore, a constant current sink 249 sinking a constant current $I_0$ and a resistor R9 with a resistance R9 are additionally provided. One end of the current sink 249 is connected to the power supply through the resistor R9, and the other end thereof is connected to the ground.

The input current $I_9$, which is a constant current, flows through the resistor R9, thereby generating a constant dc bias voltage $V_9'$ at the connection point P9 of the current sink 249 and the resistor R9. Only the constant dc bias voltage $V_9'$ is applied to the base of the transistor Q9 in the nonuple-tail cell 308.

To satisfy the above relationships (55a), (55b), (55c), (55d), (55e), (55f), (55g), (55h), and (55i), the constants a and b may be adjusted by setting at least one of (i) the resistance R211 of the emitter resistor R211, (ii) the resistance R212 of the emitter resistor R212, (iii) the resistance R1, R2, R3, R4, R5, R6, R7, R8, and R9 of the resistors R1, R2, R3, R4, R5, R6, R7, R8, and R9, and (iv) the mirror ratio (or, the emitter area ratio) of the current mirror circuits 225, 226, and 227.

Additionally, in the multiplier according to the seventh embodiment of FIG. 16, the term of $V_T \cdot \ln 2$ in the equation (55e) can be deleted if the emitter area of the transistor Q205 is set to be twice as large as that of the remaining transistors Q201, Q202, Q203, Q204, Q206, Q207, Q208, and Q209, as shown in FIG. 12.

EIGHTH EMBODIENT

Figure 17:
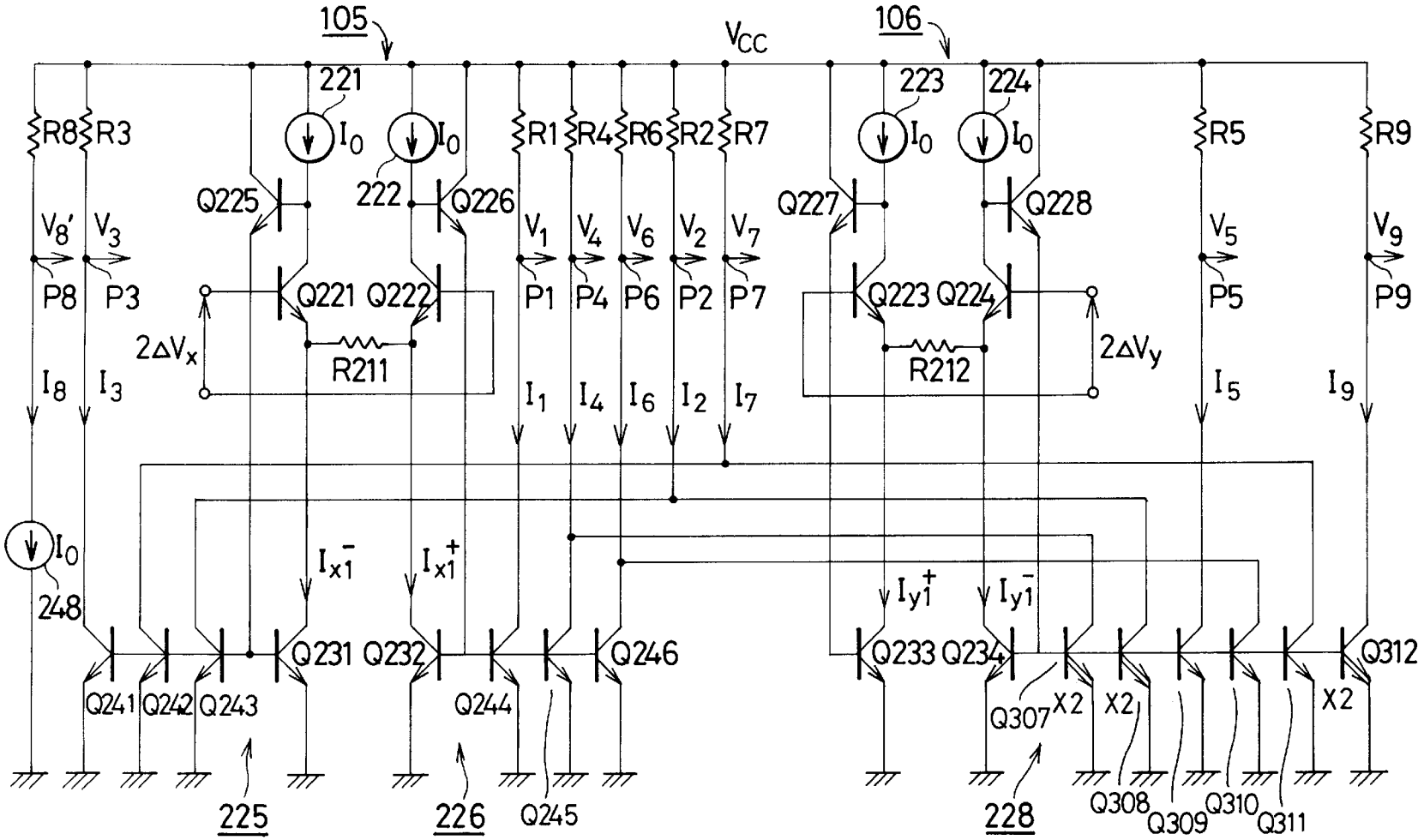
FIG. 17 is a circuit diagram showing the combination of first and second bipolar linear transconductance amplifiers, a wired current adder, and resistors serving as an I-V converter, which is used for a multiplier according to an eighth embodiment of the present invention, where a=½ and b=0.

FIG. 17 shows the combination of the first and second linear transconductance amplifiers 105 and 106, the wired current adder 307, andthe I-V converter 309, which is used for a multiplier according to an eighth embodiment, where a=½ and b=0.

The multiplier according to the eighth embodiment has the basic configuration shown in FIG. 10, and the same configuration as those in FIGS. 11 and 13.

The circuit configuration of FIG. 17 is the same as that of FIG. 14 except for the following. Therefore, by adding the same reference characters to the corresponding elements in FIG. 17, the explanation relating to the same configuration is omitted here for the sake of simplification of description.

Since a=½ and b=0, from the equations (34a), (34b), (34c) (34d), (34e), (34f), (34g), (34h), and (34i), the nine input voltages $V_1$, $V_2$, $V_3$, $V_4$, $V_5$, $V_6$, $V_7$, $V_8$, and $V_9$are expressed as $$V_1=\Delta V_x \tag{56a}$$

$$V_2=-\Delta V_x-2\Delta V_y \tag{56b}$$

$$V_3=-V_x \tag{56c}$$

$$V_4=\Delta V_x-2\Delta V_y \tag{56d}$$

$$V_5=-\Delta V_y+V_T \cdot ln2 \tag{56e}$$

$$V_6=\Delta V_x-\Delta V_y \tag{56f}$$

$$V_7=-\Delta V_x-\Delta V_y \tag{56g}$$

$$V_8=0 \tag{56h}$$

$$V_9=-2\Delta V_y \tag{56i}$$

Therefore, the first and second linear transconductance amplifiers 105 and 106, the current adder 307, and the I-V converter 309 are designed to satisfy the above relationships (56a), (56b), (56c), (56d), (56e), (56f), (56g), (56h), and (56i).

To satisfy the above relationships (56a), (56b), (56c), (56d), (56e), (56f), (56g), (56h), and (56i), the first and second linear transconductance amplifiers 105 and 106, the current adder 307, and the I-V converter 309 are configured as shown in FIG. 17.

In FIG. 17, compared with the configuration of FIG. 14, the emitter-follower-augmented current mirror circuit 227 formed by the transistors Q247, Q248, and Q249 is omitted. The emitter-follower-augmented current mirror circuits 225 and 226 are the same as those of the fifth embodiment of FIG. 14. Further, the emitter-follower-augmented current mirror circuit 227 is formed by six npn bipolar transistors Q307, Q308, Q309, Q310, Q311,and Q312.

A collector of the transistor Q307 is connected to the resistor R4. A collector of the transistor Q308 is connected to the resistor R2. A collector of the transistor Q309 is connected to the resistor R5. A collector of the transistor Q310 is connected to the resistor R6. A collector of the transistor Q311 is connected to the resistor R7. A collector of the transistor Q312 is connected to the resistor R9.

The collector of the transistor Q241 is connected to the resistor R3. The collector of the transistor Q242 is connected to the resistor R7. The collector of the transistor Q243 is connected to the resistor R2. The collector of the transistor 0244 is connected to the resistor R1. The collector of the transistor Q245 is connected to the resistor R4. The collector of the transistor Q246 is connected to the resistor R6.

In this case, the input voltage $V_8$ is zero; i.e., $V_8=0$. Therefore, a constant current sink 248 sinking a constant current $I_0$ and a resistor R8 with a resistance R8 are additionally provided. One end of the current sink 248 is connected to the power supply through the resistor R8, and the other end thereof is connected to the ground.

The input current $I_8$, which is a constant current, flows through the resistor R8, thereby generating a constant dc bias voltage $V_8'$ at the connection point P8 of the current sink 248 and the resistor R8. Only the constant dc bias voltage $V_8'$ is applied to the base of the transistor Q8 in the nonuple-tail cell 308.

To satisfy the above relationships (56a), (56b), (56c), (56d), (56e), (56f), (56g), (56h), and (56i), the constants a and b may be adjusted by setting at least one of (i) the resistance R211 of the emitter resistor R211, (ii) the resistance R212 of the emitter resistor R212, (iii) the resistance R1, R2, R3, R4, R5, R6, R7, R8, and P9 of the resistors R1, R2, R3, R4, R5, R6, R7, R8, and R9, and (iv) the mirror ratio (or, the emitter area ratio) of the current mirror circuits 225, 226, and 228.

Additionally, in the multiplier according to the eighth embodiment of FIG. 17, the term of $V_T \cdot \ln 2$ in the equation (56e) can be deleted if the emitter area of the transistor Q205 is set to be twice as large as that of the remaining transistors Q201, Q202, Q203, Q204, Q206, Q207, Q208, and Q209, as shown in FIG. 12.

NINTH EMBODIMENT

Figure 18:
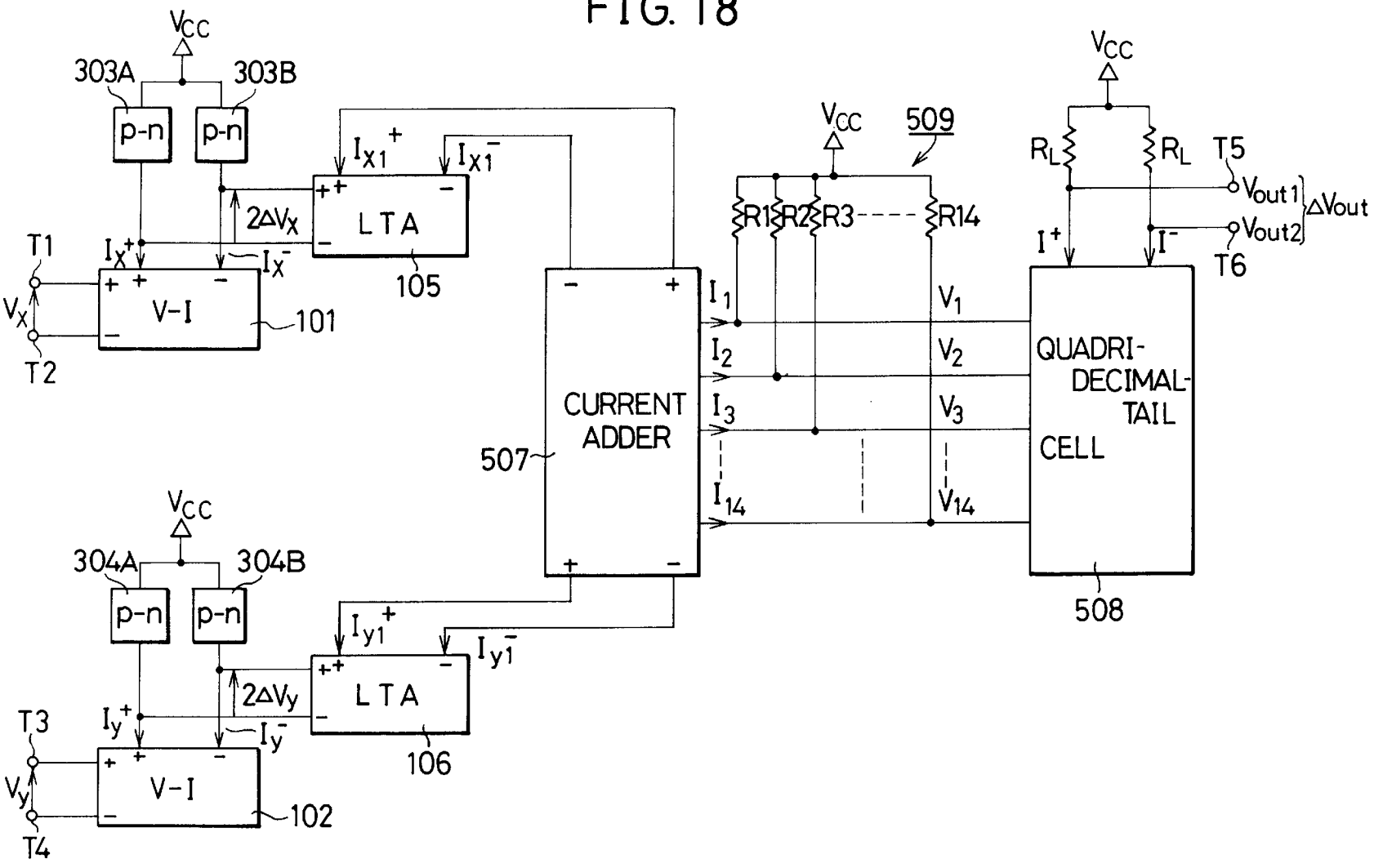
FIG. 18 is a block diagram showing a bipolar perfect four-quadrant analog multiplier according to a ninth embodiment of the present invention, where abipolar quadridecimal-tail cell is used as a multiplier core circuit.

FIG. 18 shows a bipolar complete four-quadrant analog multiplier according to a ninth embodiment, which corresponds to a multiplier obtained by replacing the quadritail cell 108 in the multiplier according to the fifth embodiment of FIG. 10 with a quadridecimal-tail cell 508.

In response to the replacement of the quadridecimal-tail cell 508, a current adder 507 and an I-V converter 509 are replaced, respectively. Therefore, the input circuit has the first and second linear V-I converters 101 and 102, the first pair of p-n junction elements 303A and 303B, the second pair of p-n junction elements 304A and 304B, the first and second linear transconductance amplifiers (LTAs) 105 and 106, the current adder 507, and the I-V converter 509.

Figure 19:
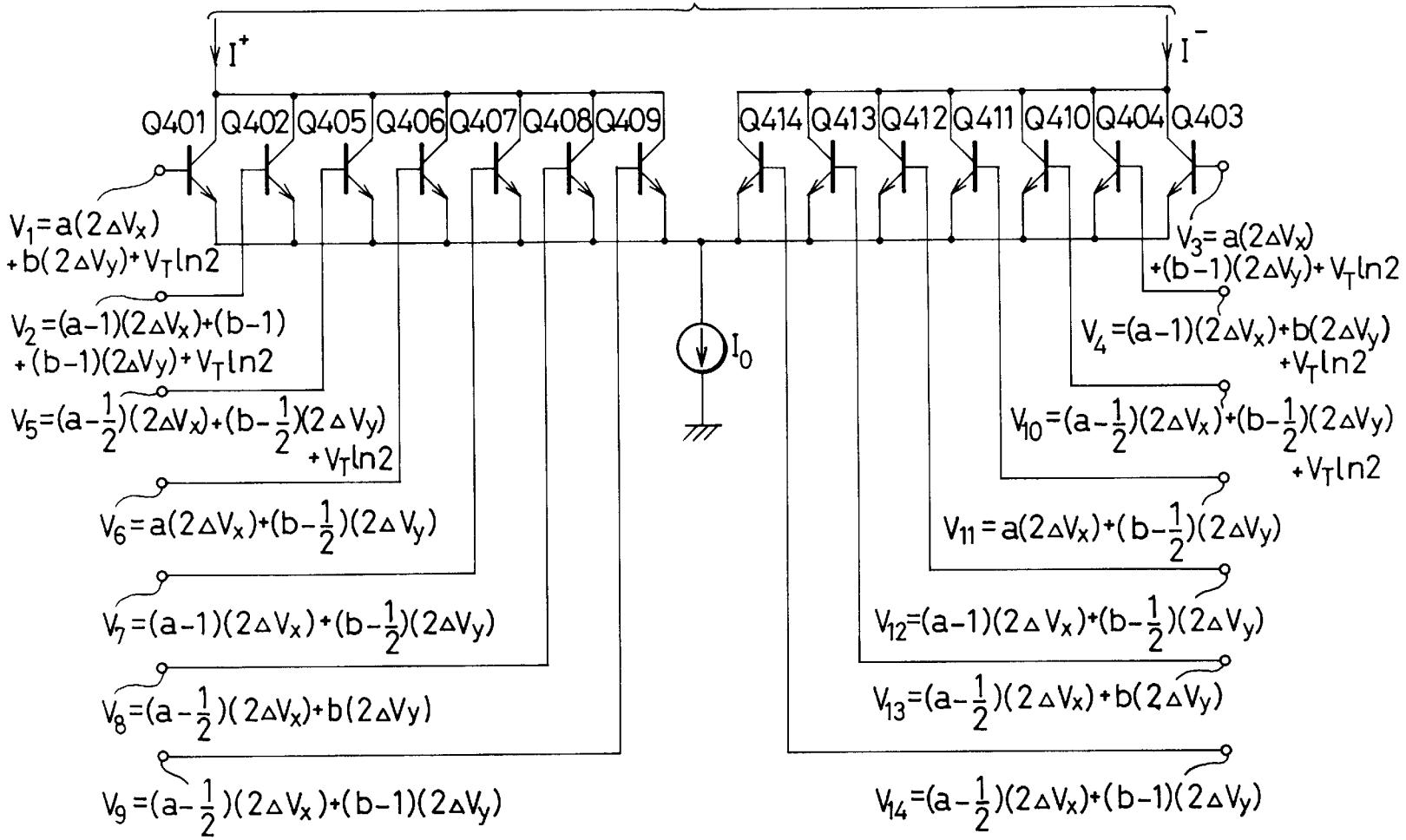
FIG. 19 is a circuit diagram of a bipolar quadridecimal tail cell used for the multiplier according to the ninth embodiment of FIG. 18.

As shown in FIG. 19, the quadridecimal-tail cell 508 is formed by fourteen emitter-coupled npn bipolar transistors Q401, Q402, Q403, Q404, Q405, Q406, Q407, Q408, Q409, Q410, Q411, Q412, Q413, and Q414 driven by a single constant current sink sinking a constant current $I_0$. One end of the current sink is connected to the coupled emitters of the transistors Q401, Q402, Q403, Q404, Q405, Q406, Q407, Q408, Q409, Q410, Q411, Q412, Q413, and Q414 and the other end thereof is connected to the ground. The transistors Q401, Q402, Q403, Q404, Q405, Q406, Q407, Q408, Q409, Q410, Q411, Q412, Q413, and Q414 are the same in emitter area.

The transistors Q401 and Q402 form a differential pair, and the transistors Q403 and Q404 form another differential pair.

Collectors of the transistors Q401 and Q402 are coupled together to be connected to a power supply (supply voltage: $V_{cc}$) (not shown) through a first load resistor $R_L$ with a resistance $R_L$. The connection point of the coupled collectors of the transistors Q401 and Q402 with the first load resistor $R_L$ is connected to the first output terminal T5.

Collectors of the transistors Q405, Q406, Q407, Q408, and Q409 are connected to the coupled collectors of the transistors Q401 and Q402.

Collectors of the transistors Q403 and Q404 are coupled together to be connected to the power supply through a second load resistor $R_L$ with the same resistance $R_L$. The connection point of the coupled collectors of the transistors Q403 and Q404 with the second load resistor $R_L$ is connected to the second output terminal T6.

Collectors of the transistors Q410, Q411, Q412, Q413, and Q414 are connected to the coupled collectors of the transistors Q403 and Q404.

An output current $I^+$ is defined as a current flowing through the coupled collectors of the transistors Q401, Q402, Q405, Q406, Q407, Q408, and Q409. An output current $I^-$ is defined as a current flowing through the coupled collectors of the transistors Q403, Q404, Q410, Q411, Q412, Q413, and Q414.

A differential output current ΔI of the multiplier according to the ninth embodiment of FIG. 18 is defined as the difference of the output currents $I^+$ and $I^-$; i.e., $\Delta I=I^+-I^-$.

Bases of the transistors Q401, Q402, Q403, Q404, Q405, Q406, Q407, Q403, Q409, Q410, Q411, Q412, Q413, and Q414 are applied with fourteen input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ generated by the input circuit, respectively. When the input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ are properly designed or determined, the quadridecimal-tail cell 508 is able to provide the multiplication operation. In other words, the cell 508 serves as a multiplier core circuit.

In the quadridecimal-tail cell 508 in FIG. 19, the output currents $I^+$ and $I^-$ are branches of the constant tail current $I_0$, respectively. Therefore, the dc operating point of the output currents $I^+$ and $I^-$ is at $(I_0/2)$. This means that the currents $I^+$ and $I^-$ will vary with respect to the operating point at $(I_0/2)$.

As a result, there is an advantage that not only the differential output current ΔI but also each of the output currents $I^+$ and $I^-$ exhibits the multiplication result.

Further, the quadridecimal-tail cell 508 corresponds to a multiplier obtained by dividing the bypass current $I_{BYPASS}$ in the nonuple-tail cell 308 of FIG. 11 into two parts, and adding the parts thus generated to the output currents $I^+$ and $I^-$, respectively.

Accordingly, the quadridecimal-tail cell 508 is capable of the multiplication operation and therefore, the multiplier according to the ninth embodiment of FIG. 18 is able to realize the perfect four-quadrant multiplication operation.

To make it possible to provide the multiplication operation by the quadridecimal-tail cell 508, the fourteen input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, and $V_{15}$ for the cell 508 need to satisfy the following relationships (57a), (57b), (57c), (57d), (57e), (57f), (57g), (57h), and (57i), respectively.

$$V_1=a(2\Delta V_x)+b(2\Delta V_y)+V_T\bullet ln2 \quad (57a)$$

$$V_2=(a-1)(2\Delta V_x)+(b-1)(2\Delta V_x)+V_T\bullet ln2 \quad (57b)$$

$$V_3=(a-1)(2\Delta V_x)+b(2\Delta V_x)+V_T\bullet ln2 \quad (57c)$$

$$V_4=a(2\Delta V_x)+(b-1)(2\Delta V_x)+V_T\bullet ln2 \quad (57d)$$

$$V_5=V_{10}=(a-½)(2\Delta V_x)+(b-½)(2\Delta Vr)+V_T\bullet ln2 \quad (57e)$$

$$V_6=V_{11}=a(2\Delta V_x)+(b-½)(2\Delta V_x) \quad (57f)$$

$$V_7=V_{12}=(a-1)(2\Delta V_x)+(b-½)(2\Delta V_x) \quad (57g)$$

$$V_8=V_{13}=(a-½)(2\Delta V_x)+b(2\Delta V_x)(57h)$$

$$V_9=V_{14}=(a-½)(2\Delta V_x)+(b-1)(2\Delta V_x) \quad (57i)$$

Each of the nine input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ is expressed by the sum of the two differential output voltages $2\Delta V_x$ and $2\Delta V_y$ generated by the first and second pairs of the p-n junction elements 303A, 303B, 304A, and 304B. It is clear from the above expressions (57a), (57b), (57c), (57d), (57e), (57f), (57g), (57h), and (57i) that the quadridecimal-tail cell 508 provides the multiplier operation when the current adder 507 and the I-V converter 509 operate to satisfy these expressions (57a), (57b), (57c), (57d), (57e), (57f), (57g), (57h), and (57i).

The constants or coefficients a and b of the fourteen input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$shown in the equations (57a), (57b), (57c), (57d), (57e), (57f), (57g), (57h), and (57i) may be theoretically optional. However, practically, the constants a and b are not able to be freely determined in the first and second linear transconductance amplifiers 105 and 106. The constants a and b need to be suitably designed at specific values in order to realize the bipolar perfect four-quadrant analog multiplier.

Figure 21:
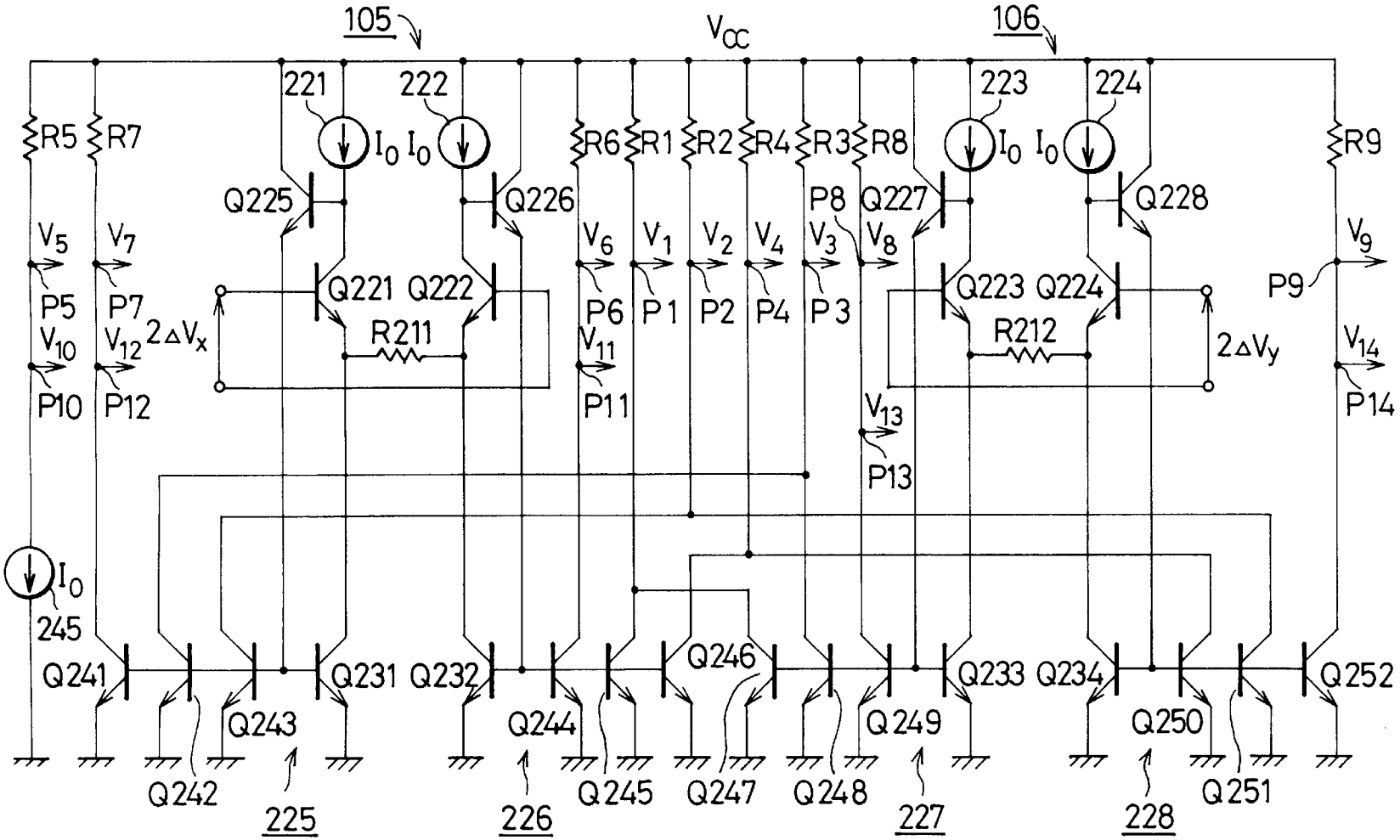
FIG. 21 is a circuit diagram showing the combination of first and second bipolar linear transconductance amplifiers, a wired current adder, and resistors serving as an I-V converter, which is used for the multiplier according to the ninth embodiment of FIG. 18, where a=b=½.

FIG. 21 shows the combination of first and second linear transconductance amplifiers 105 and 106, the current adder 507, and the I-V converter 509, which is used for the multiplier according to the ninth embodiment of FIG. 18, where a=b=½.

Since a=b=½, from the equations (57a), (57b), (57c), (57d), (57e), (57f), (57g), (57h), and (57i), the input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ are expressed as $$V_1=\Delta V_x+\Delta V_y+V_T\bullet ln2 \quad (58a)$$

$$V_2=-\Delta V_x-\Delta V_y+V_T\bullet ln2 \quad (58b)$$

$$V_3=-\Delta V_x+\Delta V_y+V_T\bullet ln2 \quad (58c)$$

$$V_4=\Delta V_x-\Delta V_y+V_T\bullet ln2 \quad (58d)$$

$$V_5=V_{10}=V_T\bullet ln2 \quad (58e)$$

$$V_6=V_{11}=\Delta V_x \quad (58f)$$

$$V_7=V_{12}=-\Delta V_x \quad (58g)$$

$$V_8=V_{13}=\Delta V_y \quad (58h)$$

$$V_9=V_{14}=-\Delta V_x \quad (58i)$$

Therefore, the first and second linear transconductance amplifiers 105 and 106, the current adder 507, and the I-V converter 509 are designed to satisfy the above relationships (58a), (58b), (58c), (58d), (58e), (58f), (58g), (58h), and (58i).

The first linear transconductance amplifier 105 in FIG. 21 has the same configuration as that of the fifth embodiment of FIG. 14.

As shown in FIG. 21, the input voltage $V_{10}$ is derived from the connection point P10 which is same as the point P5, the input voltage $V_{11}$ is derived from the connection point P11 which is same as the point P6, the input voltage $V_{12}$ is derived from the connection point P12 which is same as the point P7, the input voltage $V_{13}$ is derived from the connection point P13 which is same as the point P8, and the input voltage $V_{14}$ is derived from the connection point P14 which is same as the point P9.

Figure 20:
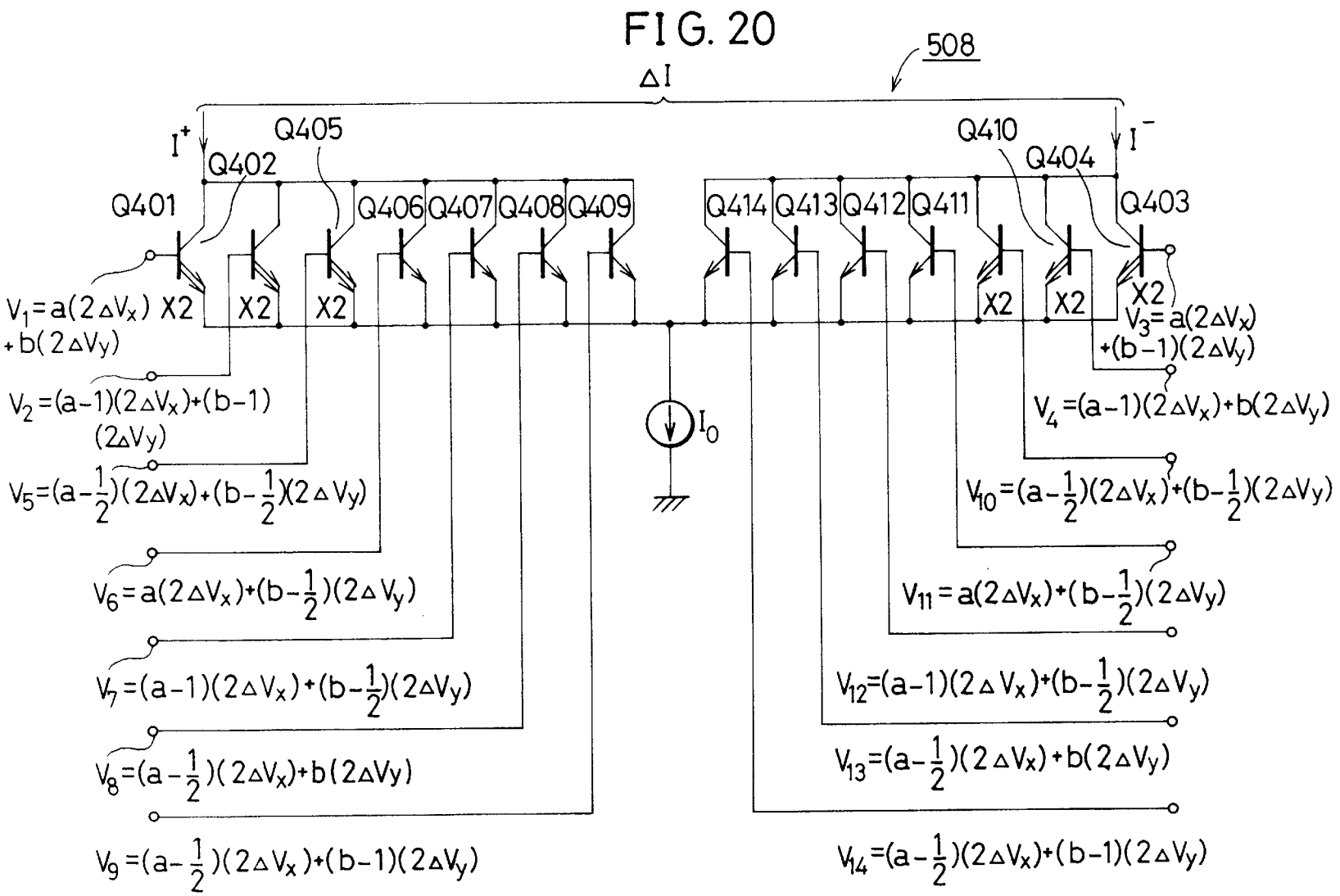
FIG. 20 is a circuit diagram of another bipolar quadridecimal tail cell used for the multiplier according to the ninth embodiment of FIG. 18.

Additionally, in the multiplier according to the ninth embodiment of FIG. 18, each of the input voltages $V_1$, $V_2$, $V_3$, $V_4$, $V_5$ contains the term of $V_T\bullet\ln 2$. The term of $V_T\bullet\ln 2$ can be deleted if the emitter area of the transistors Q401, Q402, Q403, Q404, Q405, and Q410 is set to be twice as large as that of the remaining transistors Q406, Q407, Q408, Q409, Q411, Q412, Q513, and Q414 as shown in FIG. 20.

TENTH EMBODIMENT

Figure 22:
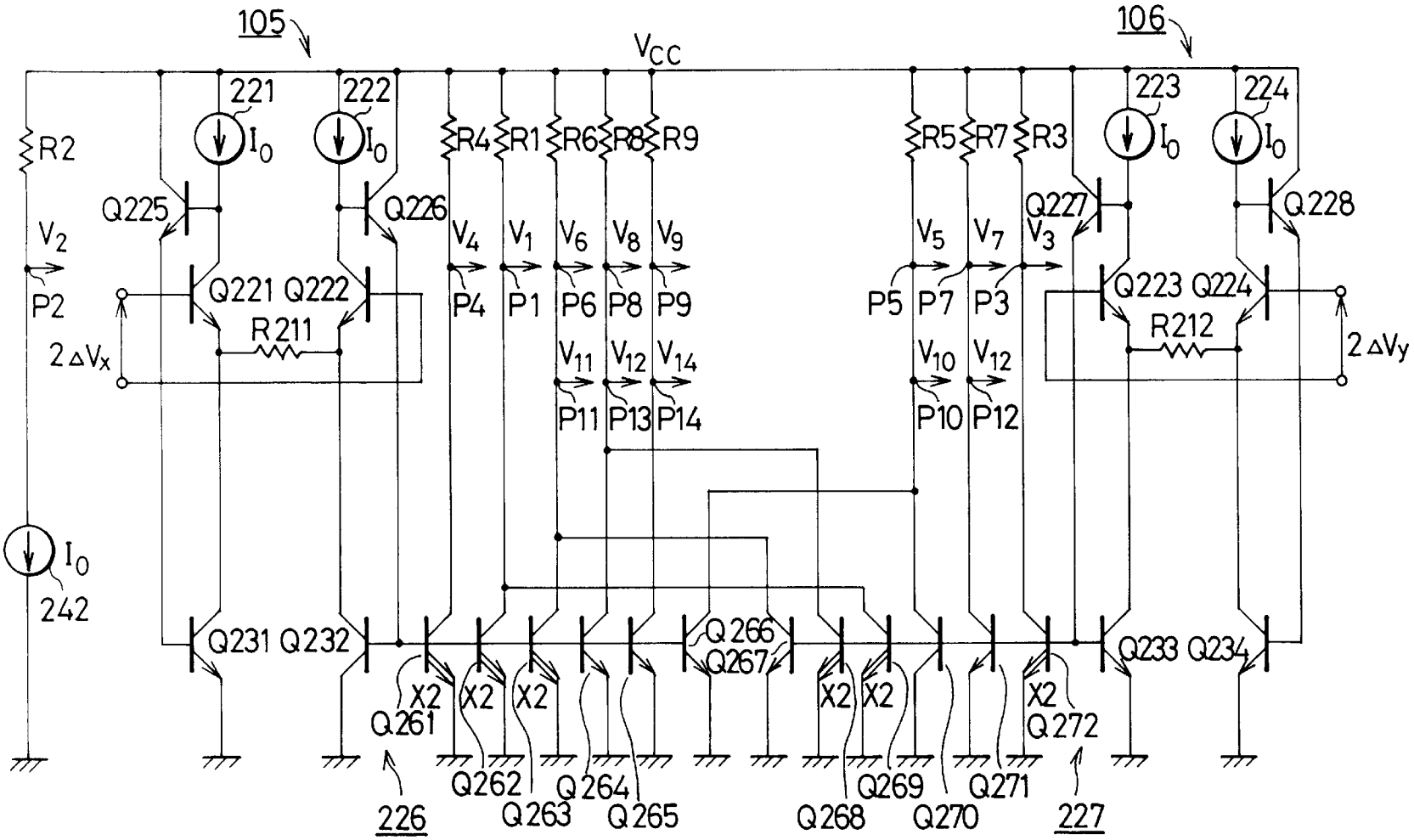
FIG. 22 is a circuit diagram showing the combination of first and second bipolar linear transconductance amplifiers, a wired current adder, and resistors serving as an I-V converter, which is used for a multiplier according to a tenth embodiment of the present invention, where a=b=1.

FIG. 22 shows the combination of the first and second linear transconductance amplifiers 105 and 106, the wired current adder 507, andthe I-V converter 509, which is used for a multiplier according to a tenth embodiment, where a=b=1.

Since a=b=1, the fourteen input voltages $V_1$, $V_2$, $V_3$, $V_4$, $V_5$, $V_6$, $V_7$, $V_8$, $V_9$, $V_{10}$, $V_{11}$, $V_{12}$, $V_{13}$ and $V_{14}$ are expressed as $$V_1=2\Delta V_x+2\Delta V_y+V_T\bullet ln2 \quad (59a)$$

$$V_2=+V_T\bullet ln2 \quad (59b)$$

$$V_3=2\Delta V_y+V_T\bullet ln2 \quad (59c)$$

$$V_4=2\Delta V_x+V_T\bullet ln2 \quad (59d)$$

$$V_5=V_{10}=\Delta V_x+\Delta V_y+V_T\bullet ln2 \quad (59e)$$

$$V_6=V_{11}=2\Delta V_x+\Delta V_y \quad (59f)$$

$$V_7=V_{12}=\Delta V_y \quad (59g)$$

$$V_8=V_{13}=\Delta V_x+2\Delta V_y \quad (59h)$$

$$V_9=V_{14}=\Delta V_x \quad (59i)$$

To satisfy the above relationships (59a), (59b), (59c), (59d), (59e), (59f), (59g), (59h), and (59i), the first and second linear transconductance amplifiers 105 and 106, the current adder 307, and the I-V converter 309 are configured as shown in FIG. 22.

The first linear transconductance amplifier 105 in FIG. 22 has the same configuration as that of the sixth embodiment of FIG. 15.

As shown in FIG. 22, the input voltage $V_{10}$ is derived from the connection point P10 which is same as the point P5, the input voltage $V_{11}$ is derived from the connection point P11 which is same as the point P6, the input voltage $V_{12}$ is derived from the connection point P12 which is same as the point F7, the input voltage $V_{13}$ is derived from the connection point P13 which is same as the point P8, and the input voltage $V_{14}$ is derived from the connection point P14 which is same as the point P9.

Additionally, in the multiplier according to the tenth embodiment of FIG. 22, the term of $V_T\bullet\ln 2$ in the equations (59a) (59b), (59c), (59d), and (59e) can be deleted if the emitter area of the transistors Q401, Q402, Q403, Q404, Q405, and Q410 is set to be twice as large as that of the remaining transistors Q406, Q407, Q408, Q409, Q411, Q412, Q513, and Q414 as shown in FIG. 20.

ELEVENTH EMBODIMENT

Figure 23:
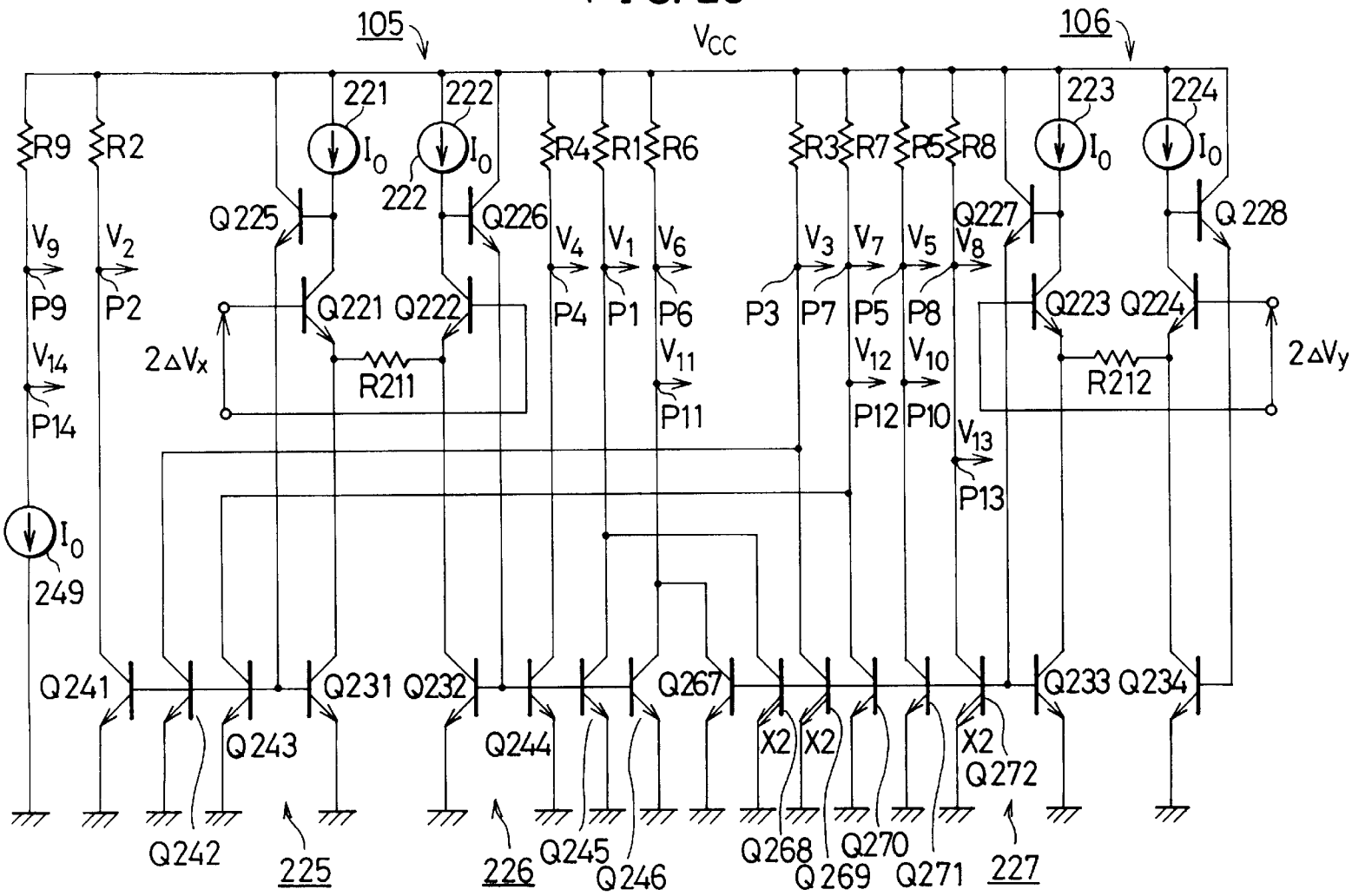
FIG. 23 is a circuit diagram showing the combination of first and second bipolar linear transconductance amplifiers, a wired current adder, and resistors serving as an I-V converter, which is used for a multiplier according to an eleventh embodiment of the present invention, where a=½ and b=1.

FIG. 23 shows the combination of the first and second linear transconductance amplifiers 105 and 106, the wired current adder 507, and the I-V converter 509, which is used for a multiplier according to an eleventh embodiment, where a=½ and b=1.

Since a=½ and b=1, the nine input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ are expressed as $$V_1=\Delta V_x+2\Delta V_y+V_T\bullet ln2 \quad (60a)$$

$$V_2=-\Delta V_x+V_T\bullet ln2 \quad (60b)$$

$$V_3=-\Delta V_x+2\Delta V_y+V_T\bullet ln2 \quad (60c)$$

$$V_4=\Delta V_x+V_T\bullet ln2 \quad (60d)$$

$$V_5=\Delta V_y+V_T\bullet ln2 \quad (60e)$$

$$V_6=\Delta V_x+\Delta V_y \quad (60f)$$

$$V_7=-\Delta V_x+\Delta V_y \quad (60g)$$

$$V_8=2\Delta V_y \quad (60h)$$

$$V_9=0 \quad (60i)$$

To satisfy the above relationships (60a), (60b), (60c), (60d), (60e), (60f), (60g), (60h), and (60i), the first and second linear transconductance amplifiers 105 and 106, the current adder 507, and the I-V converter 509 are configured as shown in FIG. 23.

The first linear transconductance amplifier 105 in FIG. 23 has the same configuration as that of the seventh embodiment of FIG. 16.

As shown in FIG. 23, the input voltage $V_{10}$ is derived from the connection point P10 which is same as the point P5, the input voltage $V_{11}$ is derived from the connection point P11 which is same as the point P6, the input voltage $V_{12}$ is derived from the connection point P12 which is same as the point P7, the input voltage $V_{13}$ is derived from the connection point P13 which is same as the point P8, and the input voltage $V_{14}$ is derived from the connection point P14 which is same as the point P9.

Additionally, in the multiplier according to the eleventh embodiment of FIG. 23, the term of $V_T\bullet\ln 2$ in the equations (60a), (60b), (60c), (60d), and (60e) can be deleted if the emitter area of the transistors Q401, Q402, Q403, Q404, Q405, and Q410 is set to be twice as large as that of the remaining transistors Q406, Q407, Q408, Q409, Q411, Q412, Q513, and Q414 as shown in FIG. 20.

TWELFTH EMBODIMENT

Figure 24:
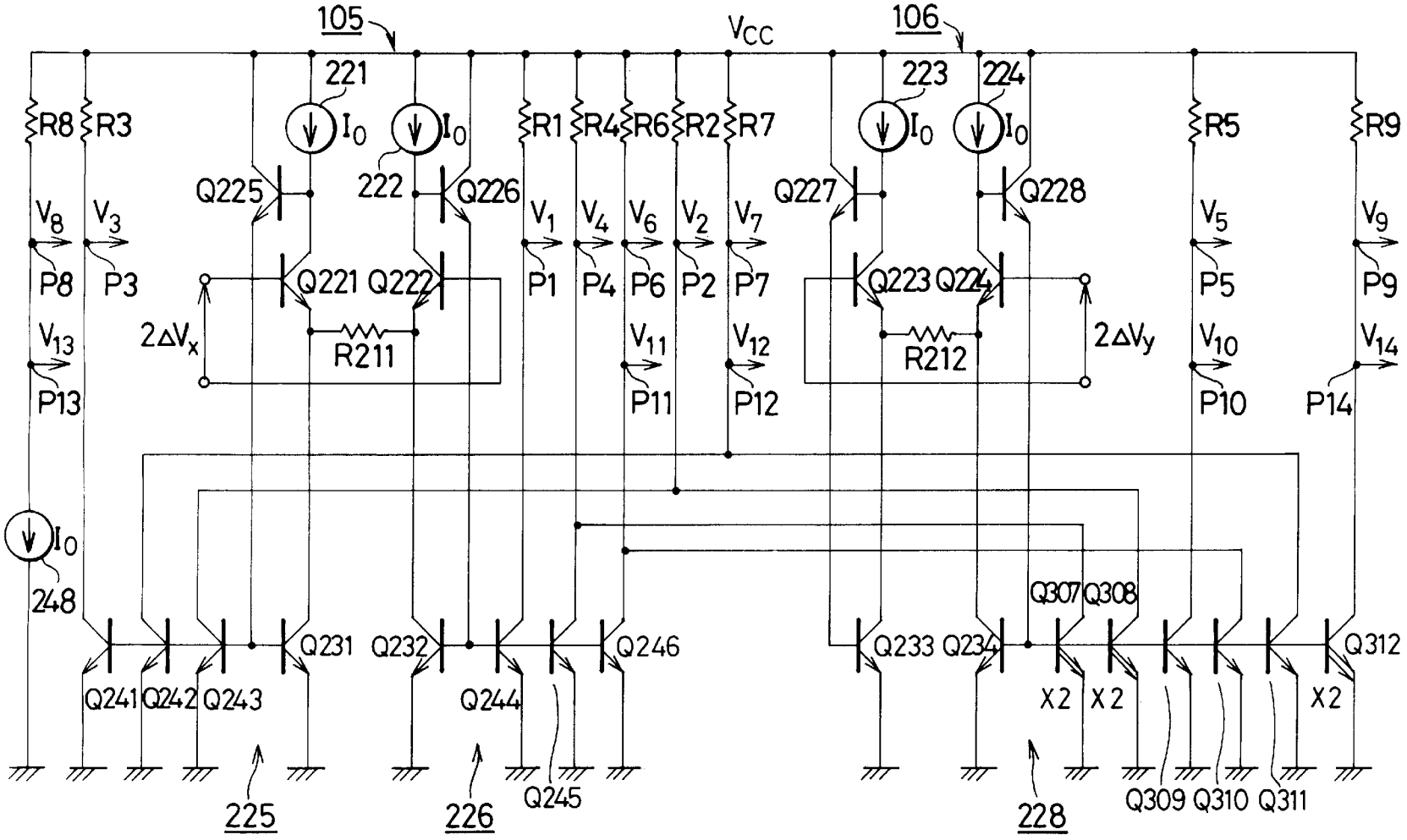
FIG. 24 is a circuit diagram showing the combination of first and second bipolar linear transconductance amplifiers, a wired current adder, and resistors serving as an I-V converter, which is used for a multiplier according to a twelfth embodiment of the present invention, where a=½ and b=0.

FIG. 24 shows the combination of the first and second linear transconductance amplifiers 105 and 106, the wired current adder 507, and the I-V converter 509, which is used for a multiplier according to an eleventh embodiment, where a=½ and b=0.

Since a=½ and b=0, the nine input voltages $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$ are expressed as $$V_1=\Delta V_x+V_T\bullet ln2 \quad (61a)$$

$$V_2=-\Delta V_x+2\Delta V_y+V_T\bullet ln2 \quad (61b)$$

$$V_3=-\Delta V_x+V_T\bullet ln2 \quad (61c)$$

$$V_4=\Delta V_x-2\Delta V_y+V_T\bullet ln2 \quad (61d)$$

$$V_5=V_{10}=-\Delta V_y+V_T\bullet ln2 \quad (61e)$$

$$V_6=V_{11}=\Delta V_x-\Delta V_y \quad (61f)$$

$$V_7=V_{12}=-\Delta V_x-\Delta V_y \quad (61g)$$

$$V_8=V_{13}=0 \quad (61h)$$

$$V_9=V_{14}=-2\Delta V_y \quad (61i)$$

To satisfy the above relationships (61a), (61b), (61c) (61d), (61e), (61f), (61g), (61h), and (61i), the first and second linear transconductance amplifiers 105 and 106, the current adder 507, and the I-V converter 509 are configured as shown in FIG. 24.

The first linear transconductance amplifier 105 in FIG. 24 has the sane configuration as that of the eighth embodiment of FIG. 17.

As shown in FIG. 24, the input voltage $V_{10}$ is derived from the connection point P10 which is same as the point P5, the input voltage $V_{11}$ is derived from the connection point P11 which is same as the point P6, the input voltage $V_{12}$ is derived from the connection point P12 which is same as the point P7, the input voltage $V_{13}$ is derived from the connection point P13 which is same as the point P8, and the input voltage $V_{14}$ is derived from the connection point P14 which is same as the point P9.

Additionally, in the multiplier according to the twelfth embodiment of FIG. 24, the term of $V_T\bullet$ln2 in the equations (61a), (61b), (61c), (61d), and (61e) can be deleted if the emitter area of the transistors Q401, Q402, Q403, Q404, Q405, and Q410 is set to be twice as large as that of the remaining transistors Q406, Q407, Q408, Q409, Q411, Q412, Q513, and Q414 as shown in FIG. 20.

In the present invention, it is needless to say that any other linear V-I converter, any other linear transconductance amplifier, any other current adder, any other I-V converter than those used in the above embodiments may be used.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A bipolar analog multiplier for multiplying first and second initial input signal voltages;

said multiplier comprising:

(a) a quadritail cell serving as a multiplier core circuit;

said quadritail cell being formed by emitter-coupled first, second, third, and fourth bipolar transistors driven by a single constant current sink;

collectors of said first and second transistors being coupled together to form a first output terminal;

collectors of said third and fourth transistors being coupled together to form a second output terminal;

bases of said first, second, third, and fourth transistors being applied with first, second, third, and fourth input voltages, respectively;

an output of the multiplier including the multiplication result of said first and second initial input signal voltages being differentially derived from said first and second output terminals; and (b) an input circuit for generating said first, second, third, and fourth input voltages;

said input circuit including:

(b-1) a first linear V-I converter for linearly converting said applied first initial input voltage to a first pair of differential output currents;

(b-2) a first pair of p-n junction elements for converting said first pair of differential output currents to a first differential output voltage due to logarithmic compression;

(b-3) a first linear transconductance amplifier for amplifying said first differential output voltage to generate a second pair of differential output currents;

(b-4) a second linear V-I converter for converting said applied second initial input voltage to a third pair of differential output currents;

(b-5) a second pair of p-n junction elements for converting said third pair of differential output currents to a second differential output voltage due to logarithmic compression;

(b-6) a second linear transconductance amplifier for amplifying said second differential output voltage to generate a fourth pair of differential output currents;

(b-7) a current adder for adding said second pair of differential output currents generated by said first linear transconductance amplifier and said fourth pair of differential output currents generated by said second linear transconductance amplifier to generate first, second, third, and fourth input currents;

(b-8) an I-V converter for converting said first, second, third, and fourth input currents to said first, second, third, and fourth input voltages, respectively.

2. A multiplier as claimed in claim 1, wherein said first, second, third, and fourth input voltages are defined as $V_1$, $V_2$, $V_3$, and $V_4$, and said first and second differential output voltages are defined as $\Delta V_x$ and $\Delta V_y$, respectively, said first, second, third, and fourth input voltages are expressed as $$V_1=a\Delta V_x+b\Delta V_y,$$

$$V_2=(a-1)\Delta V_x+(b-1)\Delta V_y,$$

$$V_3=(a-1)\Delta V_x+b\Delta V_y,$$

and $$V_4=a\Delta V_x+(b-1)\Delta V_y,$$

where a and b are constants.

3. A multiplier as claired in claim 2, wherein said constants a and b are set as a=b=1.

4. A multiplier as claimed in claim 2, wherein said constants a and b are set as a=½ and b=1.

5. A multiplier as claimed in claim 2, wherein said constants a and b are set as a=½ and b=0.

6. A multiplier as claimed in claim 2, wherein said constants a and b are set as a=b=½.

7. A multiplier as claimed in claim 1, wherein each of said first and second linear transconductance amplifiers includes a respective differential pair of bipolar transistors with an emitter resistor connected between emitters of the respective differential pair of transistors;

and wherein a corresponding one of said first and second initial input signal voltages is applied across bases of the respective differential pair of transistors.

8. A multiplier as claimed in claim 1, wherein each of said first and second linear transconductance amplifiers further includes first and second current mirror circuits;

and wherein said second pair of output currents and said fourth pair of output currents are derived through said first and second current mirror circuits, respectively.

9. A multiplier as claimed in claim 8, wherein each of said first and second current mirror circuits has a respective emitter-follower bipolar transistor.

10. A bipolar analog multiplier for multiplying first and second initial input signal voltages;

said multiplier comprising:

(a) a nonuple-tail cell serving as a multiplier core circuit;

said nonuple-tail cell being formed by emitter-coupled first, second, third, fourth, fifth, sixth, seventh, eighth, and ninth bipolar transistors driven by a single constant current source;

collectors of said first and second transistors being coupled together to form a first output terminal;

collectors of said third and fourth transistors being coupled together to form a second output terminal;

collectors of said fifth, sixth, seventh, eighth, and ninth transistors being connected to said coupled collectors of said first and second transistors;

a bypass current flowing through said fifth, sixth, seventh, eighth, and ninth transistors;

bases of said first, second, third, fourth, fifth, sixth, seventh, eighth, and ninth transistors being applied with first, second, third, fourth, fifth, sixth, seventh, eighth, and ninth input voltages, respectively;

an output of the multiplier including the multiplication result of said first and second initial input voltages being derived from at least one of said first and second output terminals; and (b) an input circuit for generating said first, second, third, fourth, fifth, sixth, seventh, eighth, and ninth input voltages;

said input circuit including:

(b-1) a first linear V-I converter for linearly converting said applied first initial input voltage to a first pair of differential output currents;

(b-2) a first pair of p-n junction elements for converting said first pair of differential output currents to a first differential output voltage due to logarithmic compression;

(b-3) a first linear transconductance amplifier for amplifying said first differential output voltage to generate a second pair of differential output currents;

(b-4) a second linear V-I converter for converting said 4; applied second initial input voltage to a third pair of differential output currents;

(b-5) a second pair of p-n junction elements for converting said third pair of differential output currents to a second differential output voltage due to logarithmic compression;

(b-6) a second linear transconductance amplifier for amplifying said second differential output voltage to generate a fourth pair of differential output currents;

(b-7) a current adder for adding said second pair of differential output currents generated by said first linear transconductance amplifier and said fourth pair of differential output currents generated by said second linear transconductance amplifier to generate first, second, third, fourth, fifth, sixth, seventh, eighth, and ninth input currents;

(b-8) an I-V converter for converting said first, second, third, fourth, fifth, sixth, seventh, eighth, and ninth input currents to said first, second, third, fourth, fifth, sixth, seventh, eighth, and ninth input voltages, respectively.

11. A multiplier as claimed in claim 10, wherein said first, second, third, fourth, fifth, sixth, seventh, eighth, and ninth input voltages are defined as $V_1$, $V_2$, $V_3$, $V_4$, $V_5$, $V_6$, $V_7$, $V_8$, and $V_9$, and said first and second differential output voltages are defined as $\Delta V_x$ and $\Delta V_y$, respectively, said first, second, third, fourth, fifth, sixth, seventh, eighth, and ninth input voltages are expressed as $$V_1=a(2\Delta V_x)+b(2\Delta V_y),$$

$$V_2=(a-1)(2\Delta V_x)+(b-1)(2\Delta V_x),$$

$$V_3=(a-1)(2\Delta V_x)+b(2\Delta V_x),$$

$$V_4=a(2\Delta V_x)+(b-1)(2\Delta V_x),$$

$$V_5=(a-½)(2\Delta V_x)+(b-½)\ (2\Delta V_y)+V_T\bullet ln2,$$

$$V_6=a(2\Delta V_x)+(b-½)(2\Delta V_x),$$

$$V_7=(a-1)(2\Delta V_x)+(b-½)(2\Delta V_x),$$

$$V_8=(a-½)(2\Delta V_x)+b(2\Delta V_x),$$

and $$V_9=(a-½)(2\Delta V_x)+(b-1)(2\Delta V_x),$$

where a and b are constants and $V_T$ is the thermal voltage.

12. A multiplier as claimed in claim 11, wherein said constants a and b are set as a=b=1.

13. A multiplier as claimed in claim 11, wherein said constants a and b are set as a=½ and b=1.

14. A multiplier as claimed in claim 11, wherein said constants a and b are set as a=½ and b=0.

15. A multiplier as claimed in claim 11, wherein said constants a and b are set as a=b=½.

16. A multiplier as claimed in claim 10, wherein each of said first and second linear transconductance amplifiers includes a respective differential pair of bipolar transistors with an emitter resistor connected between emitters of the respective differential pair of transistors;

and wherein a corresponding one of said first and second initial input signal voltages is applied across bases of the respective differential pair of transistors.

17. A multiplier as claimed in claim 10, wherein each of said first and second linear transconductance amplifiers further includes first and second current mirror circuits;

and wherein said second pair of output currents and said fourth pair of output currents are derived through said first and second current mirror circuits, respectively.

18. A multiplier as claimed in claim 17, wherein each of said first and second current mirror circuits has a respective emitter-follower bipolar transistor.

19. A bipolar analog multiplier for multiplying first and second initial input signal voltages;

said multiplier comprising:

(a) a quadridecimal-tail cell serving as a multiplier core circuit;

said quadridecimal-tail cell being formed by emitter-coupled first, second, third, fourth, fifth, sixth, seventh, eighth, ninth, tenth, eleventh, twelfth, thirteenth, and fourteenth bipolar transistors driven by a single constant current sink;

said first and second transistors forming a differential pair, and said third and fourth transistors forming another differential pair;

collectors of said first and second transistors being coupled together to form a first output terminal;

collectors of said fifth, sixth, seventh, eighth, and ninth transistors being connected to said coupled collectors of said first and second transistors;

collectors of said third and fourth transistors being coupled together to form a second output terminal;

collectors of said tenth, eleventh, twelfth, thirteenth, and fourteenth transistors being connected to said coupled collectors of said third and fourth transistors;

bases of said first, second, third, fourth, fifth, sixth, seventh, eighth, ninth, tenth, eleventh, twelfth, thirteenth, and fourteenth bipolar transistors being applied with first, second, third, fourth, fifth, sixth, seventh, eighth, ninth, tenth, eleventh, twelfth, thirteenth, and fourteenth input voltages, respectively;

an output of the multiplier including the multiplication result of said first and second initial input voltages being derived from at least one of said first and second output terminals; and (b) an input circuit for generating said first, second, third, fourth, fifth, sixth, seventh, eighth, ninth, tenth, eleventh, twelfth, thirteenth, and fourteenth input voltages;

said input circuit including:

(b-1) a first linear V-I converter for linearly converting said applied first initial input voltage to a first pair of differential output currents;

(b-2) a first pair of p-n junction elements for converting said first pair of differential output currents to a first differential output voltage due to logarithmic compression;

(b-3) a first linear transconductance amplifier for amplifying said first differential output voltage to generate a second pair of differential output currents;

(b-4) a second linear V-I converter for converting said applied second initial input voltage to a third pair of differential output currents;

(b-5) a second pair of p-n junction elements for converting said third pair of differential output currents to a second differential output voltage due to logarithmic compression;

(b-6) a second linear transconductance amplifier for amplifying said second differential output voltage to generate a fourth pair of differential output currents;

(b-7) a current adder for adding said second pair of differential output currents generated by said first linear transconductance amplifier and said fourth pair of differential output currents generated by said second linear transconductance amplifier to generate first, second, third, fourth, fifth, sixth, seventh, eighth, ninth, tenth, eleventh, twelfth, thirteenth, and fourteenth input currents;

(b-8) an I-V converter for converting said first, second, third, fourth, fifth, sixth, seventh, eighth, and ninth input currents to said first, second, third, fourth, fifth, sixth, seventh, eighth, ninth, tenth, eleventh, twelfth, thirteenth, and fourteenth input voltages, respectively.

20. A multiplier as claimed in claim 19, wherein said first, second, third, fourth, fifth, sixth, seventh, eighth, ninth, tenth, eleventh, twelfth, thirteenth, and fourteenth input voltages are defined as $V_1$, $V_2$, $V_3$, $V_4$, $V_5$, $V_6$, $V_7$, $V_8$, $V_9$, $V_{10}$, $V_{11}$, $V_{12}$, $V_{13}$, and $V_{14}$, and said first and second differential output voltages are defined as $\Delta V_x$ and $\Delta V_y$, respectively, said first, second, third, fourth, fifth, sixth, seventh, eighth, ninth, tenth, eleventh, twelfth, thirteenth, and fourteenth input voltages are expressed as $$V_1=a(2\Delta V_x)+b(2\Delta V_y)+V_T\bullet ln2,$$

$$V_2=(a-1)(2\Delta V_x)+(b-1)\ (2\Delta V_x)+V_T\bullet ln2,$$

$$V_3=(a-1)(2\Delta V_x)+b(2\Delta V_x)+V_T\bullet ln2,$$

$$V_4=a(2\Delta V_x)+(b-1)(2\Delta V_x)+V_T\bullet ln2,$$

$$V_5=V_{10}=(a-½)(2\Delta V_x)+(b-½)(2\Delta V_y)+V_T\bullet ln2,$$

$$V_6=V_{11}=a(2\Delta V_x)+(b-½)(2\Delta V_x),$$

$$V_7=V_{12}=(a-1)(2\Delta V_x)+(b-½)(2\Delta V_x),$$

$$V_8=V_{13}=(a-½)(2\Delta V_x)+b(2\Delta V_x),$$

and $$V_9=V_{14}=(a-½)(2\Delta V_x)+(b-1)(2\Delta V_x),$$

where a and b are constants and $V_T$ is the thermal voltage.

21. A multiplier as claimed in claim 19, wherein said constants a and b are set as a=b=1.

22. A multiplier as claimed in claim 19, wherein said constants a and b are set as a=½ and b=1.

23. A multiplier as claimed in claim 19, wherein said constants a and b are set as a=½ and b=0.

24. A multiplier as claimed in claim 19, wherein said constants a and b are set as a=b=½.

25. A multiplier as claimed in claim 19, wherein each of said first and second linear transconductance amplifiers includes a respective differential pair of bipolar transistors with an emitter resistor connected between emitters of the respective differential pair of transistors;

and wherein a corresponding one of said first and second initial input signal voltages is applied across bases of the respective differential pair of transistors.

26. A multiplier as claimed in claim 19, wherein each of said first and second linear transconductance amplifiers further includes first and second current mirror circuits;

and wherein said second pair of output currents and said fourth pair of output currents are derived through said first and second current mirror circuits, respectively.

27. A multiplier as claimed in claim 26, wherein each of said first and second current mirror circuits has a respective emitter-follower bipolar transistor.

* * * * *

UNITED STATES PATENT AND TRADEMARK OFFICE

CERTIFICATE OF CORRECTION

PATENT NO. : 5,912,834

DATED : June 15, 1999

INVENTOR(S) : Katsuji KIMURA

It is certified that error appears in the above-identified patent and that said Letters Patent is hereby corrected as shown below:

| | | |
|---|---|---|
| Column 2, | line 42, | delete "formedby" and insert --formed by--; |
| Column 5, | line 63, | delete "andfourth" and insert --and fourth--; |
| Column 12, | line 60, | delete "$V_4$32" and insert --$V_4$ = --; |
| Column 17, | line 17, | delete "abalanced" and insert --a balanced--; |
| Column 18, | line 13, | delete "collectorof" and insert --collector of--; |
| Column 18, | line 26, | delete "Q2$^7$" and insert --Q27--; |
| Column 22, | line 65, | delete "$_{V3}$, $V_4$, $_{V5}$" and insert --$V_3$, $V_4$, $V_5$--; |
| Column 30, | line 64, | delete "Q222" and insert --Q228--; |

UNITED STATES PATENT AND TRADEMARK OFFICE

CERTIFICATE OF CORRECTION

PATENT NO. : 5,912,834
DATED : June 15, 1999
INVENTOR(S) : Katsuji KIMURA

It is certified that error appears in the above-identified patent and that said Letters Patent is hereby corrected as shown below:

| | | |
|---|---|---|
| Column 34, | line 55, | delete "226" and insert --228--; |
| Column 37, | line 56, | delete "Q403" and insert --Q408--; |
| Column 38, | line 29, | delete "Vr" and insert --$V_y$--; |
| Column 38, | line 34, | move (57h) to the far right column; |
| Column 40, | line 12, | delete "F7" and insert --P7--; |
| Column 41, | line 38, | delete "sane" and insert --same--. |

Signed and Sealed this
First Day of February, 2000

*Attest:*

Q. TODD DICKINSON

*Attesting Officer*

*Acting Commissioner of Patents and Trademarks*